US010334904B2

(12) United States Patent
Durocher et al.

(10) Patent No.: US 10,334,904 B2
(45) Date of Patent: Jul. 2, 2019

(54) SPORTS HELMET WITH ROTATIONAL IMPACT PROTECTION

(71) Applicant: BAUER HOCKEY, LLC, Exeter, NH (US)

(72) Inventors: Jacques Durocher, St-Jerome (CA); Jean-Francois Laperriere, Prevost (CA); Marie-Claude Genereux, Ste-Therese (CA); Denis Cote, St-Colomban (CA)

(73) Assignee: BAUER HOCKEY, LLC, Blainville (CA)

( * ) Notice: Subject to any disclaimer, the term of this patent is extended or adjusted under 35 U.S.C. 154(b) by 945 days.

(21) Appl. No.: 14/139,049

(22) Filed: Dec. 23, 2013

(65) Prior Publication Data

US 2014/0109300 A1 Apr. 24, 2014

Related U.S. Application Data

(63) Continuation of application No. 13/560,546, filed on Jul. 27, 2012.

(Continued)

(51) Int. Cl.
*A42B 3/12* (2006.01)
*A42B 3/06* (2006.01)

(52) U.S. Cl.
CPC ..... *A42B 3/12* (2013.01); *A42B 3/064* (2013.01)

(58) Field of Classification Search
CPC ..... A42B 3/12; A42B 3/064
See application file for complete search history.

(56) References Cited

U.S. PATENT DOCUMENTS 3,350,718 A 11/1967 Webb
3,413,656 A 12/1968 Vogliano et al.

(Continued)

FOREIGN PATENT DOCUMENTS

BY 2273621 C 2/2008
CA 1154552 10/1983

(Continued)

OTHER PUBLICATIONS

Advance Impact Defence, 6D Helmets, http://www.6dhelmets.com/#!ods/c10b6, consulted on Nov. 26, 2014.

(Continued)

*Primary Examiner* — Shaun R Hurley
*Assistant Examiner* — Andrew Wayne Sutton
(74) *Attorney, Agent, or Firm* — Wolf, Greenfield & Sacks, P.C.

(57) ABSTRACT

A sports helmet for protecting a head of a wearer, that comprises: an outer shell comprising an external surface of the sports helmet; inner padding disposed between the outer shell and the wearer's head; an adjustment mechanism operable by the wearer to vary an internal volume of the cavity to adjust a fit of the sports helmet on the wearer's head; and a rotational impact protection device disposed between the external surface of the sports helmet and the wearer's head when the sports helmet is worn, the rotational impact protection device comprising a surface movable relative to the external surface of the sports helmet in response to a rotational impact on the outer shell to absorb rotational energy from the rotational impact, the surface of the rotational impact protection device undergoing displacement when the adjustment mechanism is operated by the wearer to vary the internal volume of the cavity.

16 Claims, 40 Drawing Sheets

Related U.S. Application Data

(60) Provisional application No. 61/587,040, filed on Jan. 16, 2012, provisional application No. 61/512,266, filed on Jul. 27, 2011.

(56) References Cited

U.S. PATENT DOCUMENTS 3,447,162 A 6/1969 Aileo
3,471,866 A 10/1969 Raney
3,609,764 A 10/1971 Morgan
3,866,243 A 2/1975 Morgan
3,897,597 A 8/1975 Kasper
4,012,794 A 3/1977 Nomiyama
4,023,213 A 5/1977 Rovani
4,055,860 A 11/1977 King
4,185,331 A 1/1980 Nomiyama
4,287,613 A 9/1981 Schulz
4,307,471 A * 12/1981 Lovell ..... A42B 3/065 2/411
4,477,929 A 10/1984 Mattson
4,685,315 A 8/1987 Comolli
4,932,076 A 6/1990 Giorgio et al.
4,942,628 A 7/1990 Freund
5,068,922 A 12/1991 Zahn
5,204,998 A * 4/1993 Liu ..... A42B 3/121 2/411
5,249,347 A 10/1993 Marinitz
5,315,718 A 5/1994 Barson et al.
5,412,814 A 5/1995 Pernicka et al.
5,483,699 A 1/1996 Pernicka et al.
5,511,250 A 4/1996 Field et al.
5,571,217 A 11/1996 Del Bon et al.
5,638,551 A 6/1997 Lallemand
D400,311 S 10/1998 Chartrand
5,832,569 A 11/1998 Berg
5,845,341 A 12/1998 Barthold et al.
5,950,244 A * 9/1999 Fournier ..... A42B 3/128 2/411
5,950,245 A 9/1999 Binduga
5,953,761 A 9/1999 Jurga et al.
5,956,776 A 9/1999 Chartrand
6,032,297 A 3/2000 Barthold et al.
6,081,931 A 7/2000 Burns et al.
6,101,636 A 8/2000 Williams
6,108,824 A 8/2000 Fournier et al.
6,125,477 A 10/2000 Crippa et al.
6,240,571 B1 6/2001 Infusino
6,256,798 B1 7/2001 Egolf et al.
6,272,692 B1 8/2001 Abraham
6,298,497 B1 10/2001 Chartrand
6,324,700 B1 12/2001 McDougall
6,338,165 B1 1/2002 Biondich
6,385,780 B1 5/2002 Racine
6,389,607 B1 5/2002 Wood
6,453,476 B1 9/2002 Moore, III
6,560,787 B2 5/2003 Mendoza
6,592,536 B1 7/2003 Argenta
6,658,671 B1 12/2003 Von Holst et al.
6,681,409 B2 1/2004 Dennis et al.
6,751,808 B2 6/2004 Puchalski
6,772,447 B2 8/2004 Morrow et al.
6,817,039 B1 11/2004 Grilliot et al.
6,862,747 B2 3/2005 Oleson
6,865,752 B2 3/2005 Udelhofen et al.
6,883,183 B2 4/2005 Morrow et al.
6,886,183 B2 5/2005 DeHaan et al.
6,920,644 B1 7/2005 Higgs
6,934,971 B2 8/2005 Ide et al.
6,952,839 B2 10/2005 Long
6,961,963 B2 11/2005 Rosie
6,964,066 B2 11/2005 Tucker
6,966,075 B2 11/2005 Racine
6,968,575 B2 11/2005 Durocher
6,981,284 B2 1/2006 Durocher
6,996,856 B2 2/2006 Puchalski
7,043,772 B2 5/2006 Bielefeld et al.
7,076,811 B2 7/2006 Puchalski
7,174,575 B1 2/2007 Scherer
7,222,374 B2 5/2007 Musal et al.
7,341,776 B1 3/2008 Milliren et al.
7,603,725 B2 10/2009 Harris
7,634,820 B2 12/2009 Rogers et al.
7,677,538 B2 3/2010 Darnell et al.
7,870,618 B2 1/2011 Pilon et al.
7,908,678 B2 3/2011 Brine, III et al.
7,930,771 B2 4/2011 Depreitere et al.
7,950,073 B2 5/2011 Ferrara
7,954,178 B2 6/2011 Durocher et al.
8,037,548 B2 10/2011 Alexander et al.
8,095,995 B2 * 1/2012 Alexander ..... A42B 3/324 2/410
8,156,574 B2 4/2012 Stokes et al.
8,296,867 B2 10/2012 Rudd et al.
8,296,868 B2 10/2012 Bélanger et al.
8,316,512 B2 11/2012 Halldin
8,448,266 B2 5/2013 Alexander et al.
8,544,118 B2 10/2013 Brine, III et al.
8,566,968 B2 10/2013 Marzec et al.
8,566,969 B2 10/2013 Glogowski et al.
8,578,520 B2 11/2013 Halldin
8,832,870 B2 9/2014 Bélanger et al.
8,887,318 B2 11/2014 Mazzarolo et al.
9,095,179 B2 8/2015 Kwan et al.
2001/0032351 A1 10/2001 Nakayama et al.
2001/0034895 A1 11/2001 Ikeda
2002/0035748 A1 3/2002 Racine
2003/0070201 A1 4/2003 McClelland
2003/0106138 A1 6/2003 Guay
2003/0135914 A1 7/2003 Racine et al.
2003/0221245 A1 12/2003 Lee et al.
2004/0025231 A1 2/2004 Ide et al.
2004/0040073 A1 3/2004 Morrow et al.
2004/0117896 A1 6/2004 Madey et al.
2004/0117897 A1 6/2004 Udelhofen et al.
2004/0168246 A1 9/2004 Phillips
2004/0172739 A1 9/2004 Racine
2004/0199981 A1 10/2004 Tucker
2004/0250340 A1 12/2004 Piper et al.
2005/0015857 A1 1/2005 Desjardins et al.
2005/0034222 A1 2/2005 Durocher
2005/0034223 A1 2/2005 Durocher
2005/0125882 A1 6/2005 Long
2005/0262619 A1 12/2005 Musal et al.
2006/0059606 A1 3/2006 Ferrara
2006/0096011 A1 5/2006 Dennis et al.
2006/0206994 A1 9/2006 Rogers et al.
2007/0044193 A1 3/2007 Durocher et al.
2007/0079429 A1 4/2007 Pilon et al.
2007/0083965 A1 4/2007 Darnell et al.
2007/0157370 A1 7/2007 Joubert Des Ouches
2007/0169251 A1 7/2007 Rogers et al.
2007/0190292 A1 8/2007 Ferrara
2007/0199136 A1 8/2007 Brine et al.
2007/0245466 A1 10/2007 Lilenthal et al.
2008/0066217 A1 3/2008 Depreitere et al.
2008/0155735 A1 7/2008 Ferrara
2008/0276354 A1 11/2008 Stokes
2009/0031482 A1 2/2009 Stokes et al.
2009/0038055 A1 2/2009 Ferrara
2009/0044315 A1 2/2009 Belanger et al.
2009/0158506 A1 6/2009 Thompson et al.
2009/0188022 A1 6/2009 Durocher et al.
2009/0178184 A1 7/2009 Brine et al.
2010/0005573 A1 1/2010 Rudd et al.
2010/0043126 A1 2/2010 Morel
2010/0050323 A1 3/2010 Durocher et al.
2010/0107317 A1 5/2010 Wang
2010/0115686 A1 5/2010 Halldin
2010/0151631 A1 6/2010 Pu et al.
2010/0180363 A1 7/2010 Glogowski et al.
2010/0186150 A1 7/2010 Ferrara et al.
2011/0004980 A1 1/2011 Leatt et al.
2011/0047679 A1 3/2011 Rogers et al.
2011/0083251 A1 4/2011 Mandell

(56) References Cited

U.S. PATENT DOCUMENTS

| | | | | |
|---|---|---|---|---|
| 2011/0117310 | A1 | 5/2011 | Anderson et al. | |
| 2011/0171420 | A1 | 7/2011 | Yang | |
| 2012/0060251 | A1 | 3/2012 | Schimpf | |
| 2012/0096631 | A1 | 4/2012 | King et al. | |
| 2012/0110720 | A1 | 5/2012 | Mazzarolo et al. | |
| 2012/0198604 | A1* | 8/2012 | Weber | A42B 3/125 2/414 |
| 2012/0204329 | A1 | 8/2012 | Faden et al. | |
| 2012/0208032 | A1 | 8/2012 | Faden et al. | |
| 2013/0000018 | A1 | 1/2013 | Rudd et al. | |
| 2013/0025032 | A1 | 1/2013 | Durocher et al. | |
| 2013/0061371 | A1* | 3/2013 | Phipps | A42B 3/064 2/411 |
| 2013/0122256 | A1 | 5/2013 | Kleiven et al. | |
| 2013/0247284 | A1 | 9/2013 | Hoshizaki et al. | |
| 2015/0089722 | A1 | 4/2015 | Berry | |
| 2015/0089724 | A1* | 4/2015 | Berry | A42B 3/064 2/414 |
| 2015/0113718 | A1* | 4/2015 | Bayer | A41D 13/0512 2/461 |
| 2015/0216248 | A1 | 8/2015 | Blair | |

FOREIGN PATENT DOCUMENTS

| | | | |
|---|---|---|---|
| CA | 1183302 | | 3/1985 |
| CA | 1217601 | | 2/1987 |
| CA | 2048028 | | 12/1994 |
| CA | 2230616 | A1 | 3/1997 |
| CA | 1290324 | | 5/2001 |
| CA | 2191683 | C | 3/2005 |
| CA | 2290324 | C | 5/2005 |
| CA | 2321399 | C | 7/2005 |
| CA | 2191693 | C | 11/2005 |
| CA | 2598015 | | 8/2006 |
| CA | 2561540 | A1 | 3/2007 |
| CA | 2567010 | C | 1/2008 |
| CA | 2357690 | C | 1/2009 |
| CA | 2638703 | A1 | 2/2009 |
| CA | 2916360 | A1 | 2/2009 |
| CA | 2963353 | A1 | 2/2009 |
| CA | 2437545 | C | 3/2009 |
| CA | 2437626 | C | 4/2009 |
| CA | 2533493 | C | 5/2009 |
| CA | 2576086 | C | 4/2010 |
| CA | 2561540 | C | 8/2010 |
| CA | 2573640 | C | 9/2010 |
| CA | 2798542 | C | 11/2011 |
| CA | 2759915 | | 2/2012 |
| CA | 2573639 | C | 5/2012 |
| CA | 2784316 | A1 | 10/2012 |
| CA | 2838103 | A1 | 10/2012 |
| CA | 2659638 | C | 7/2013 |
| CA | 2804937 | C | 11/2013 |
| CA | 2821540 | C | 1/2015 |
| CA | 2847669 | C | 2/2015 |
| CA | 2638703 | C | 2/2016 |
| CA | 2783079 | C | 3/2016 |
| CA | 2916360 | C | 5/2017 |
| DE | 100 37 461 | A1 | 2/2002 |
| EP | 1 142 495 | A1 | 10/2001 |
| EP | 1 494 990 | A2 | 1/2005 |
| EP | 1 142 495 | B1 | 7/2005 |
| EP | 1 635 664 | A2 | 3/2006 |
| EP | H03-122726 | A2 | 3/2006 |
| EP | 1 429 635 | B1 | 7/2007 |
| GB | 191419109 | | 8/1914 |
| GB | 19109 | | 2/1915 |
| JP | 2005146468 | | 6/2005 |
| SE | 518223 | | 9/2002 |
| SE | 1050458 | | 12/2011 |
| SE | 534868 | | 1/2012 |
| WO | 96/14768 | | 5/1996 |
| WO | WO 96/14768 | A1 | 5/1996 |
| WO | WO 01/45526 | A1 | 6/2001 |
| WO | WO 2004/000054 | A2 | 12/2003 |
| WO | 2006/005143 | | 1/2006 |
| WO | WO 2006/005183 | | 1/2006 |
| WO | WO 2006/099928 | A1 | 9/2006 |
| WO | WO 2007/025500 | A1 | 3/2007 |
| WO | WO 2008/085108 | A1 | 7/2008 |
| WO | WO 2008/103107 | A1 | 8/2008 |
| WO | WO 2010/082919 | A2 | 7/2010 |
| WO | 2010/122586 | | 10/2010 |
| WO | WO 2010/122586 | A1 | 10/2010 |
| WO | 2010/151631 | | 12/2010 |
| WO | WO 2010/151631 | A1 | 12/2010 |
| WO | 2011/139224 | | 11/2011 |
| WO | WO 2011/139224 | A1 | 11/2011 |
| WO | WO 2015/166598 | A1 | 11/2015 |

OTHER PUBLICATIONS

Xenith, Heads-up: Tech to Combat Concussions, http://www.xenith.com/the-game/2012/08/heads-up-tech-to-combat-concussions., consulted on Nov. 26, 2014.

Xenith Technology, Adaptive Head Protection, http://www.xenith.com/why-x/technology, consulted on Nov. 26, 2014.

International Search Report dated Mar. 16, 2015 in connection with International Patent Application PCT/CA2014/000911, 8 pages.

Written Opinion of the International Searching Authority dated Mar. 16, 2015 in connection with International Patent Application PCT/CA2014/000911, 9 pages.

[No Author Listed] 2006 Product Catalog. Nike Bauer. 2006. 98 pages.

[No Author Listed] 2007 Catalogue Des Produits. Nike Bauer. 2007. 72 pages.

[No Author Listed] 2009 Product Catalog. Bauer. 2009. 144 pages.

[No Author Listed] 2010 Product Catalog. Bauer. 2010. 174 pages.

[No Author Listed] 2011 Product Catalog. Bauer. 2011. 188 pages.

[No Author Listed] 2012 Product Catalog. Bauer. 2012. 122 pages.

[No Author Listed] 2013 Product Catalog. Bauer. 2013. 118 pages.

[No Author Listed] 2014 Product Catalog. Bauer. 2014. 105 pages.

[No Author Listed] *Bauer Hockey Corp.* v. *Sport Maska Inc. d.b.a. Reebok-CCM Hockey* (Court No. T-123-15) Amended Statement of Claim. Court No. T-123-15. Feb. 25, 2015. 201 pages.

[No Author Listed] *Bauer Hockey Corp.* v. *Sport Maska Inc. d.b.a. Reebok-CCM Hockey* (Court No. T-123-15) Amended Statement of Defence and Counterclaim. May 16, 2016. 33 pages.

[No Author Listed] *Bauer Hockey Corp.* v. *Sport Maska Inc. d.b.a. Reebok-CCM Hockey* (Court No. T-123-15) Defendant's Responding Motion Record. Jul. 19, 2016. 352 pages.

[No Author Listed] *Bauer Hockey Corp.* v. *Sport Maska Inc. d.b.a. Reebok-CCM Hockey* (Court No. T-123-15) Further Amended Statement of Claim. Mar. 19, 2015. 298 pages.

[No Author Listed] *Bauer Hockey Corp.* v. *Sport Maska Inc. d.b.a. Reebok-CCM Hockey* (Court No. T-123-15) Motion Record: Defendant's Motion Record for an Extension of Time. Jul. 3, 2015. 43 pages.

[No Author Listed] *Bauer Hockey Corp.* v. *Sport Maska Inc. d.b.a. Reebok-CCM Hockey* (Court No. T-123-15) Plaintiffs Amended Motion to Strike, for Particulars, for Production of Documents and for a Scheduling Order. Jun. 15, 2016. 119 pages.

[No Author Listed] *Bauer Hockey Corp.* v. *Sport Maska Inc. d.b.a. Reebok-CCM Hockey* (Court No. T-123-15) Plaintiffs Motion to Strike, for Particulars, for Production of Documents and for a Scheduling Order. Dec. 31, 2015. 496 pages.

[No Author Listed] *Bauer Hockey Corp.* v. *Sport Maska Inc. d.b.a. Reebok-CCM Hockey* (Court No. T-123-15) Reply and Defence to Counterclaim. Oct. 6, 2016. 13 pages.

[No Author Listed] *Bauer Hockey Corp.* v. *Sport Maska Inc. d.b.a. Reebok-CCM Hockey* (Court No. T-123-15) Reply to Defence to Counterclaim. Nov. 7, 2016. 4 pages.

[No Author Listed] *Bauer Hockey Corp.* v. *Sport Maska Inc. d.b.a. Reebok-CCM Hockey* (Court No. T-123-15) Second Amended Statement of Defence and Counterclaim. Jul. 18, 2016. 34 pages.

(56) References Cited

OTHER PUBLICATIONS

[No Author Listed] *Bauer Hockey Corp.* v. *Sport Maska Inc. d.b.a. Reebok-CCM Hockey* (Court No. T-123-15) Statement of Claim. Jan. 28, 2015. 13 pages.
[No Author Listed] *Bauer Hockey Corp.* v. *Sport Maska Inc. d.b.a. Reebok-CCM Hockey* (Court No. T-123-15) Statement of Defence and Counterclaim. Jul. 3, 2015. 29 pages.
[No Author Listed] *Bauer Hockey Corp.* v. *Sport Maska Inc. d.b.a. Reebok-CCM Hockey* (Court No. T-123-15) Thrice Amended Statement of Claim. Feb. 19, 2016. 411 pages.
[No Author Listed] *Bauer Hockey Corp.* v. *Sport Maska Inc. d.b.a. Reebok-CCM Hockey* (Court No. T-123-15, T-546-12, T-311-12) Motion Record of the Moving Party Sport Maska Inc. d.b.a. Reebok-CCM Hockey vol. 2. Oct. 4, 2017. 480 pages.
[No Author Listed] *Bauer Hockey Corp.* v. *Sport Maska Inc. d.b.a. Reebok-CCM Hockey* (Court No. T-123-15, T-546-12, T-311-12) Motion Record of the Moving Party Sport Maska Inc. d.b.a. Reebok-CCM Hockey vol. 3. Oct. 4, 2017. 321 pages.
[No Author Listed] *Bauer Hockey Corp.* v. *Sport Maska Inc. d.b.a. Reebok-CCM Hockey* (Court No. T-123-15, T-546-12, T-311-12) Motion Record of the Moving Party Sport Maska Inc. d.b.a. Reebok-CCM Hockey vol. 4. Oct. 4, 2017. 46 pages.
[No Author Listed] *Bauer Hockey Corp.* v. *Sport Maska Inc. d.b.a. Reebok-CCM Hockey* (Court No. T-123-15, T-546-12, T-311-12) Notice of Motion (Motion to Dismiss). Oct. 4, 2017. 12 pages.
[No Author Listed] *Bauer Hockey Corp.* v. *Sport Maska Inc. d.b.a. Reebok-CCM Hockey* (Court No. T-123-15, T-546-I2, T-311-12) Plaintiffs Responding Motion Record (in response to the Defendant's Motion to Dismiss) vol. 4. 31 pages [last accessed Jan. 10, 2018].
[No Author Listed] *Bauer Hockey Corp.* v. *Sport Maska Inc. d.b.a. Reebok-CCM Hockey* . Plaintiffs Notice of Motion (Plaintiffs Motion to Strike, for Particulars, for Production of Documents and for a Scheduling Order). Court No. T-123-15. Dec. 31, 2015. 46 pages.
[No Author Listed] Bauer Hockey Unveils Revolutionary New Products During BauerWorld 2012. Press Release. Oct. 27, 2011. 4 pages.
[No Author Listed] D15b—New Protective Equipment Can Halve Brain Damage. Nov. 6, 2011. 4 pages.
[No Author Listed] Easton 2011 Catalogue. Easton Hockey. 2011. 59 pages.
[No Author Listed] Easton Hockey '08. Easton Hockey. 2008. 43 pages.
[No Author Listed] Easton Hockey 2012. Easton Hockey. 2012. 46 pages.
[No Author Listed] Easton Hockey 2014. Easton Hockey. 2014. 48 pages.
[No Author Listed] Easton Hockey: 2009. Easton Hockey. 2009. 43 pages.
[No Author Listed] Easton: Engineered for Glory. Easton Hockey. 2013. 45 pages.
[No Author Listed] Fokus: Flemingsberg. Goda förutsättningar för tillväxt. Nov. 2007. 16 pages.
[No Author Listed] Get a Head Start on the Competitors. MIPS AB. 12 pages [last accessed Jan. 10, 2018].
[No Author Listed] Helmets Reinvented. MIPS AB. 1 page [last accessed Jan. 10, 2018].
[No Author Listed] *MIPS AB* v. *Bauer Hockey Corp. and Bauer Hockey, Inc.* (Court No. T56-15) Agreed Statement of Facts. Sep. 1, 2017. 30 pages.
[No Author Listed] *MIPS AB* v. *Bauer Hockey Corp. and Bauer Hockey, Inc.* (Court No. T56-15) Amended Reply and Defence to Counterclaim. Jul. 21, 2017. 14 pages.
[No Author Listed] *MIPS AB* v. *Bauer Hockey Corp. and Bauer Hockey, Inc.* (Court No. T56-15) Amended Reply to the Defence to Counterclaim. Aug. 22, 2017. 3 pages.
[No Author Listed] *MIPS AB* v. *Bauer Hockey Corp. and Bauer Hockey, Inc.* (Court No. T56-15) Amended Statement of Claim. Apr. 24, 2015. 34 pages.
[No Author Listed] *MIPS AB* v. *Bauer Hockey Corp. and Bauer Hockey, Inc.* (Court No. T56-15) Amended Statement of Defence and Counterclaim. Dec. 18, 2015. 44 pages.
[No Author Listed] *MIPS AB* v. *Bauer Hockey Corp. and Bauer Hockey, Inc.* (Court No. T56-15) Closing Arguments of Bauer Hockey Ltd. and Bauer Hockey, LLC. Oct. 14, 2017. 232 pages.
[No Author Listed] *MIPS AB* v. *Bauer Hockey Corp. and Bauer Hockey, Inc.* (Court No. T56-15) Compendium B: Closing Arguments of Bauer Hockey Ltd. and Bauer Hockey, LLC. Oct. 18, 2017. 23 pages.
[No Author Listed] *MIPS AB* v. *Bauer Hockey Corp. and Bauer Hockey, Inc.* (Court No. T56-15) Consent to Thrice Amended Statement of Claim. Jun. 19, 2017. 48 pages.
[No Author Listed] *MIPS AB* v. *Bauer Hockey Corp. and Bauer Hockey, Inc.* (Court No. T56-15) Expert Report of Michael Lowe. Jul. 10, 2017. 181 pages.
[No Author Listed] *MIPS AB* v. *Bauer Hockey Corp. and Bauer Hockey, Inc.* (Court No. T56-15) Expert Report of Remy Willinger. Jul. 10, 2017. 363 pages.
[No Author Listed] *MIPS AB* v. *Bauer Hockey Corp. and Bauer Hockey, Inc.* (Court No. T56-15) Further Amended Reply and Defence to Counterclaim. Aug. 21, 2017. 15 pages.
[No Author Listed] *MIPS AB* v. *Bauer Hockey Corp. and Bauer Hockey, Inc.* (Court No. T56-15) Further Amended Statement of Claim. Nov. 20, 2015. 44 pages.
[No Author Listed] *MIPS AB* v. *Bauer Hockey Corp. and Bauer Hockey, Inc.* (Court No. T56-15) Further Amended Statement of Defence and Counterclaim. Jun. 21, 2017. 45 pages.
[No Author Listed] *MIPS AB* v. *Bauer Hockey Corp. and Bauer Hockey, Inc.* (Court No. T56-15) Memorandum of Fact and Law of the Plaintiff. Oct. 14, 2017. 195 pages.
[No Author Listed] *MIPS AB* v. *Bauer Hockey Corp. and Bauer Hockey, Inc.* (Court No. T56-15) Non-Confidential (Public) Version of Opening Statement of Bauer Hockey Ltd. and Bauer Hockey, LLC. Sep. 5, 2017. 22 pages.
[No Author Listed] *MIPS AB* v. *Bauer Hockey Corp. and Bauer Hockey, Inc.* (Court No. T56-15) Non-Confidential Version of Statement of Christopher Withnall. Jul. 10, 2017. 122 pages.
[No Author Listed] *MIPS AB* v. *Bauer Hockey Corp. and Bauer Hockey, Inc.* (Court No. T56-15) Plaintiffs Trial Opening—Point Form Summary. 18 pages [last accessed Jan. 10, 2018].
[No Author Listed] *MIPS AB* v. *Bauer Hockey Corp. and Bauer Hockey, Inc.* (Court No. T56-15) Reply and Defence to Counterclaim. Jan. 18, 2016. 14 pages.
[No Author Listed] *MIPS AB* v. *Bauer Hockey Corp. and Bauer Hockey, Inc.* (Court No. T56-15) Reply to the Defence to Counterclaim. Jan. 27, 2016. 3 pages.
[No Author Listed] *MIPS AB* v. *Bauer Hockey Corp. and Bauer Hockey, Inc.* (Court No. T56-15) Responding Expert Report of Michael Lowe. Aug. 9, 2017. 80 pages.
[No Author Listed] *MIPS AB* v. *Bauer Hockey Corp. and Bauer Hockey, Inc.* (Court No. T56-15) Responding Expert Report of Remy Willinger. Aug. 9, 2017. 5 pages.
[No Author Listed] *MIPS AB* v. *Bauer Hockey Corp. and Bauer Hockey, Inc.* (Court No. T56-15) Responding Statement of Christopher Withnall. Aug. 14, 2017. 248 pages.
[No Author Listed] *MIPS AB* v. *Bauer Hockey Corp. and Bauer Hockey, Inc.* (Court No. T56-15) Satatment of Issues. Sep. 1, 2017. 4 pages.
[No Author Listed] *MIPS AB* v. *Bauer Hockey Corp. and Bauer Hockey, Inc.* (Court No. T56-15) Statement of Claim. Jan. 15, 2015. 24 pages.
[No Author Listed] *MIPS AB* v. *Bauer Hockey Corp. and Bauer Hockey, Inc.* (Court No. T56-15) Statement of Defence. Jul. 24, 2015. 35 pages.
[No Author Listed] *MIPS AB* v. *Bauer Hockey Corp. and Bauer Hockey, Inc.* (Court No. T56-15) Thrice Amended Statement of Defence and Counterclaim. Aug. 11, 2017. 46 pages.
[No Author Listed] *MIPS AB* v. *Bauer Hockey Corp. and Bauer Hockey, Inc.* (Court No. T56-15) Trial Record. 163 pages [last accessed Jan. 10, 2018].

(56) References Cited

OTHER PUBLICATIONS

[No Author Listed] MIPS Genomför Riktad Nyemission Till HealthCap, KTH-Chalmers Capital Och Almi Invest for Kommersialisering av MIPS-teknologin. Press release. Oct. 20, 2009. 2 pages.
[No Author Listed] MIPS Protection System. MIPS AB. Jan. 13, 2011. 5 pages.
[No Author Listed] MIPS Signs Agreement with World Snowboarding Leader Burton: MIPS Protection System to Offer Enhanced Protective Technology in Burton's R.E.D. Snow Helmets. Press Release. Jan. 17, 2011. 2 pages.
[No Author Listed] MIPS: Helmets Reinvented. MIPS AB. 2010. 32 pages.
[No Author Listed] MIPS: Helmets Reinvented. MIPS AB. 2010. 9 pages.
[No Author Listed] Mission Itech Product Catalog 2007. Mission Itech. 2007. 60 pages.
[no. Author Listed] Mission Itech Product Catalog 2008. Mission Itech. 2008. 57 pp.
[No Author Listed] New Generation Helmets for the Next Generation People: MIPS and Lazer Join Forces to Protect Childrens' Brains. Press Release. Aug. 25, 2011. 1 page.
[No Author Listed] People Love Doing Crazy Things. Let's Keep it That Way. MIPS AB. 6 pages [last accessed Jan. 10, 2018].
[No Author Listed] Reebok CCM Hockey Products 2014. Reebok CCM. 2014. 112 pages.
[No Author Listed] The Invention. MIPS AB. 6 pages [last accessed Jan. 10, 2018].
[No Author Listed] The World's Safest Helmets? MIPS AB. 2 pages [ last accessed Jan. 10, 2018].
Aare et al., A New Laboratory Rig for Evaluating Helmets Subject to Oblique Impacts. Traffic Injury Prevention. 2003;4:240-8.
Föregäende, Violence Against the Head is Shaking Hockey. SvD Sport. Nov. 27, 2011. 11 pages.
Karlsson-Ottosson, Ridhjälmen Skyddar Hjärnan Vid Cykelvurpa. NyTeknik. Oct. 6, 2009. 2 pages.
Rost, Skallskador är inte bara hjärnskakning. Hippson. Apr. 6, 2007. 19 pages.
Sani, Lazer to Add Eyewear to Helmet Line. Bicycle Retailer. Jun. 26, 2011. 3 pages.
Non-Final Office Action for U.S. Appl. No. 14/828,051, dated May 4, 2017, 42 pages.
[No Author Listed] 2004 Player Catalog: Acceleration Through Innovation. Bauer Nike Hockey. 2004, 76 pages.
[No Author Listed] 2005 Product Catalog. Bauer Nike Hockey. 2005, 100 pages.
[No Author Listed] 2007 Roller Hockey Collection. RBK Hockey. 2007, 16 pages.
[No Author Listed] *Bauer Hockey Ltd. v. Sport Maska Inc.*d.b.a. Reebok-CCM Hockey (Court No. T-123-15) Fifth Amended Statement of Claim Apr. 6, 2018. 91 pages.
[No Author Listed] *Bauer Hockey Ltd. v. Sport Maska Inc.*d.b.a. Reebok-CCM Hockey (Court No. T-123-15) Fourth Amended Statement of Claim Jan. 19, 2018. 123 pages.
[No Author Listed] *Bauer Hockey Ltd. v. Sport Maska Inc.*d.b.a. Reebok-CCM Hockey (Court No. T-123-15) Thrice Amended Statement of Defence and Counterclaim. Feb. 19, 2018. 43 pages.
[No Author Listed] Burton Red HiFi design drawings. Oct. 24, 2010, 3 pages.
[No Author Listed] CCM 06 Player. CCM Hockey. 2006, 88 pages.
[No Author Listed] U.S. Appl. No 61/333,817, filed May 12, 2010, 28 pages.
[No Author Listed] U.S. Appl. No 61/587,040, filed Jan. 16, 2012, 71 pages.
[No Author Listed] Confidential Patent Application. Jul. 29, 2011, 24 pages.
[No Author Listed] Consulting Agreement Between Bauer Hockey Corp. and MIPS AB, Mar. 15, 2011, 18 pages.
[No Author Listed] Delivery note. MIPS AB. Nov. 24, 2011, 3 pages.
[No Author Listed] Digital Mechanics silicon tooling invoice. Sep. 17, 2010, 3 pages.
[No Author Listed] Email conversation copying Daniel Lanner. Feb. 6-24, 2012, 3 pages.
[No Author Listed] Email conversation re MIPS Reebok helmet sent to Pat Brisson. Feb. 16-29, 2012, 3 pages.
[No Author Listed] Email exchanges in connection with RE-AKT order placed on May 14, 2012, 8 pages.
[No Author Listed] Email from Brian Jennings to Niklas Steenberg and Peter Halldin titled "Re: MIPS meeting in NYC." Apr. 30, 2012, 2 pages.
[No Author Listed] Email from Jean-Francois Laperriere to Johan Thiel titled "RE: MIPS in Bauer hockey helmet." Sep. 21, 2010, 3 pages.
[No Author Listed] Email from Johan Thiel to Jean-Francois Laperriere and Marie-Claude Généreux titled "Bauer in Stockholm." Jul. 9, 2011, 1 page.
[No Author Listed] Email from Johan Thiel to Marie-Claude Généreux titled "RE: MIPS patent number". Jul. 29, 2011, 1 page.
[No Author Listed] Email from Niklas Steenberg to Daniel Lanner titled "Reebok hjälm." Apr. 16, 2012, 2 pages.
[No Author Listed] Email from Niklas Steenberg to Daniel Lanner titled "Re: SV: Reebok-CCM." Apr. 16, 2012, 2 pages.
[No Author Listed] Email from Niklas Steenberg to Peter Halldin titled "NHLoch ReebokCCM." Apr. 17, 2012, 11 pages.
[No Author Listed] Gulli, et al., Hits to the head: Scientists explain Sidney Crosby's concussion: What crash-test analyses reveal about hits, helmets, and the game of hockey. Macleans. http://www.macleans.ca/society/health/the-aftershocks/, Feb. 17, 2011, 9 pages.
[No Author Listed] HKSM order. Aug. 17, 2011, 1 page.
[No Author Listed] HKSM order. Sep. 9, 2011, 1 page.
[No. Author Listed] Images in connection with Burton RED HiFi helmets, displayed at SIA Denver exhibition Jan. 27-30, 2011; 3D Model images from Dec. 2010, sample holographs incorporating HiFi sliding facilitator in hockey helmet from Jan. 20, 2011 and photographs of SIA display booth taken Jan. 27, 2011, 19 pages.
[No Author Listed] Images of MIPS Reebok Helmet, Photographs taken Dec. 29, 2014, 11 pages.
[No Author Listed] Images re display of Lazer P'Nut at "Lazer Oasiz Party", Hard Rock Cafe, Las Vegas. Sep. 21, 2010, 3 pages.
[No Author Listed] Interbike Oasiz Party Guest/Invite List, 8 pages [last accessed Feb. 17, 2016].
[No Author Listed] Internal MIPS specification document Specification: MIPS in Hockey helmets. Mar. 15, 2012, 4 pages.
[No Author Listed] Interview with Bauer Hockey: RE-AKT Helmet. Hockey World Blog. http://www.hockeyworldblog.com/2012/05/11/interview-with-bauer-hockey-re-akt-helmet/, May 11, 2012, 4 pages.
[No Author Listed] Lazer Booth at EuroBike in Friedrichshafen, Germany (Aug. 31-Sep. 2, 2011)—Public display of Lazer P'Nut Helmet with MIPS technology, with MIPS product tags, MIPS poster, MIPS PowerPoint presentation, 19 pages.
[No Author Listed] Lazer Booth at Interbike in Las Vegas (Sep. 12-16, 2011)—Public display of Lazer P'Nut Helmet with MIPS technology, with MIPS product tags, MIPS poster, MIPS PowerPoint presentation, 19 pages.
[No Author Listed] Lazer Booth at Interbike in Las Vegas (Sep. 22-24, 2010)—Public display of Lazer P'Nut Helmet with MIPS technology, with MIPS product tags, MIPS poster, MIPS PowerPoint presentation, 47 pages.
[No Author Listed] Lazer invoice for space rented at Las Vegas event. Dec. 16, 2010, 1 page.
[No Author Listed] Lazer Interbike flyer, 1 page [last accessed Feb. 17, 2016].
[No Author Listed] Letter from Kevin Davis to Niklas Steenberg titled "Re: MIPS—Bauer cooperation." Jan. 17, 2012, 2 pages.
[No Author Listed] Materiel Number Requisition (MNR) Article overview for order MQ1100535. Mar. 17, 2011, 1 page.
[No Author Listed] *MIPS AB v. Bauer Hockey Corp. and Bauer Hockey, Inc.*(Court No. T-56-15) Statement of Issues. 4 pages [last accessed Jun. 4, 2018].
[No Author Listed] *MIPS AB v. Bauer Hockey Ltd. And Bauer Hockey, Inc*(Court No. T-56-15) Judgment and Reasons. May 7, 2018. 102 pages.

(56) References Cited

OTHER PUBLICATIONS

[No Author Listed] MIPS AB Written Report. MIPS AB. Jul. 9, 2011, 14 pages.
[No Author Listed] MIPS Booth that ISPO 2011 in Munich (Feb. 6-9, 2011)—Public display of Burton RED Hi-Fi MIPS Helmet, Limar Helmet with MIPS technology, POC Receptor Backcountry with MIPS technology, MIPS product tags, MIPS poster, MIPS PowerPoint presentation, 50 pages.
[No Author Listed] MIPS Booth that Snow Sports Industries America (SIA) in Denver {Jan. 27-30, 2011)—Public display of Burton RED Hi-Fi MIPS Helmet, Limar Helmet with MIPS technology, POC Receptor Backcountry with MIPS technology, MIPS products tags, MIPS poster, MIPS Power Point presentation, 12 pages.
[No Author Listed] MIPS Patent Portfolio: Patent Family 4—Helmet. MIPS AB. Jul. 27, 2011, 2 pages.
[No Author Listed] Mission Hockey 2007 Catalog. Mission Hockey. 2007, 22 pages.
[No. Author Listed] New Helmet Technology Reduces Brain Injury. KTH. https://www.kth.se/en/aktuellt/nyheter/new-helmet-technology-reduces-brain-injury-1.299392, Mar. 7, 2012, 3 pages.
[No Author Listed] Non-Disclosure Agreement between Bauer Hockey Corp. and MIPS AB, dated Mar. 17, 2011, signed Mar. 18, 2011, 3 pages.
[No Author Listed] Petition of Canadian Patent 2,784,316, filed Jul. 27, 2012. 4 pages.
[No Author Listed] Photographs of purchased RE-AKT helmet (related to Email exchanges in connection with RE-AKT order placed on May 14, 2012); photographs taken May 31, 2012, 14 pages.
[No Author Listed] Photographs relating to display of Lazer P'Nut helmet at Eurobike exhibition 2011; exhibition held in Friedrichshafen, Germany, Aug. 31, 2011-Sep. 3, 2011; photographs taken 1 and 2 September, 17 pages.
[No Author Listed] Photographs relating to display of POC Trabec helmet at Eurobike exhibition 2011; exhibition held in Friedrichshafen, Germany, Aug. 31, 2011-Sep. 3, 2011; photographs taken Aug. 18, 2011, Sep. 2, 2011, Oct. 12, 2011 and Oct. 24, 2011, 18 pages.
[No Author Listed] Player 2006. RBK Hockey. 2006, 64 pages.
[No Author Listed] POC Booth at Eurobike in Friedrichshafen, Germany (Aug. 31-Sep. 2, 2011)—Public display of POC rabec Helmet with MIPS technology, with MIPS product tags, 18 pages.
[No Author Listed] POC Booth at Interbike in Las Vegas (Sep. 12-16, 2011)—Public display of POC rabec Helmet with MIPS technology, with MIPS product tags, 18 pages.
[No Author Listed] Presentation about the Lazer P-nut with MIPS to Lazer distributors and agents, May-Jun. 2011, including Peter Steenwegen of Lazer, 12 pages.
[No Author Listed] Promotion of MIPS technology during meetings at Intennot 2010 in Cologne, Germany Oct. 6-10, 2010)—Public display of MIPS technology, with MIPS product tags, MIPs poster, MIPS PowerPoint presentation, 15 pages.
[No Author Listed] Public presentation of Lazer P'Nut helmet with MIPS system at the LazerSports NV event Lazer Oazis Party, Hard Rock Cafe, Las Vegas, Sep. 21, 2010—Public display of Lazer P' Nut Helmet with MIPS technology, MIPS Tech-folder and poster, PowerPoint presentation, 47 pages.
[No Author Listed] Purchase order for test and sample units. MIPS AB. May 13, 2011, 2 pages.
[No Author Listed] Request for grant of a European patent filed at the European Patent Office, filed Jul. 27, 2012 in connection with European Patent Application 12178380.7, 5 pages.
[No Author Listed] Screenshot of Youtube video: Bikeskills.com: MIPS Helmet Technology. EpicWaySports. https://www.youtube.com/watch?v=9wtb_R4NxS8, Sep. 25, 2009, 1 page.
[No Author Listed] Screenshot of Youtube video: LAZER MIPS. Lazer Sport. https://www.youtube.com/watch?v=5jGxLmBP9CQ, Jul. 8, 2011, 1 page.
[No Author Listed] Screenshots from Bauer RE-AKT Hockey Helmets YouTube video. Ice Warehouse. https://www.youtube.com/watch?v=-eHK0eKT18k, uploaded Apr. 27, 2012 (screenshots taken Dec. 3, 2014), 8 pages.
[No Author Listed] Screenshots from Lazer video. MIPS AB. http://www.mipshelmet.com/video/Lazer/pnut_presentation, 5 pages [last accessed Feb. 17, 2016].
[No Author Listed] Screenshots from Limar video. http://www.mipshelmet.com/video/inmold/Limar. Dec. 2010, 2 pages.
[No Author Listed] Slides from P'Nut presentation made to Lazer distributors, 6 pages [last accessed Feb. 17, 2016].
[No Author Listed] Statement of Fact and Arguments in Support of Opposition of European Patent No. 2,550,886. Dec. 31, 2014, 54 pages.
[No Author Listed] Statement under 37 CFR 3.73(b) and two Assignments filed in connection with U.S. Appl. No 13/560,546 (U.S. Publication 2013/0025032), completed Sep. 5, 2012 and Sep. 10, 2012, 6 pages.
[No Author Listed] Transcript of Bauer RE-AKT Hockey Helmets YouTube video. Ice Warehouse. https://www.youtube.com/watch?v=-eHK0eKT18k, uploaded Apr. 27, 2012 (transcript taken Dec. 3, 2014), 3 pages.
[No Author Listed] Transcript of video shown to Lazer distributors. Video viewable at: http://www.mipshelmet.com/video/Lazer/pnut_presentation, transcript taken Dec. 16, 2014, 1 page.
[No Author Listed] USPTO, U.S. Appl. No. 61/512,266, filed Jul. 27, 2011, 27 pages.
[No Author Listed] Witness statement from Daniel Lanner dated Dec. 22, 2014, re NHL presentation in Apr. 2012 filed in the matter of an opposition to European Patent Application 2,550,886, 1 page.
[No Author Listed] Witness statement from Daniel Lanner dated Dec. 26, 2014, filed in the matter of an opposition to European Patent Application 2,550,886, 1 page.
[No Author Listed] Witness statement from Peter Halldin re NHL presentation on Apr. 19, 2012 and RBK meeting on Apr. 20, 2012 filed in the matter of an opposition to European Patent Application 2,550,886. Dec. 22, 2014, 1 page.
[No Author Listed] Witness statement of Daniel Lannerre helmet for Ludvig Steenberg, presented to Lars Steenberg on Jul. 3, 2012 filed in the matter of an opposition to European Patent Application 2,550,886. Dec. 22, 2014, 1 page.
[No Author Listed] Witness statement of Johan Thiel re display of POC Trabec at Eurobike 2011. Dec. 29, 2014, 1 page.
[No Author Listed] Witness statement of Johan Thiel re HKSM orders. Dec. 29, 2014, 1 page.
[No Author Listed] Witness statement of Johan Thiel regarding display of Burton RED HiFi helmet at SIA exhibition in Jan. 2011. Dec. 29, 2014, 1 page.
[No Author Listed] Witness Statement of Johan Thiel. Dec. 29, 2014, 1 page.
[No Author Listed] Witness statement of Johan Thielre display at Eurobike. Dec. 29, 2014, 1 page.
[No Author Listed] Witness statement of Johan Thielre Las Vegas display of Lazer P'Nut helmet filed in the matter of an opposition to European Patent Application 2,550,886. Dec. 29, 2014, 1 page.
[No Author Listed] Witness statement of Lars Steenbergre helmet for Ludvig Steenberg presented to Lars Steenberg on Jul. 3, 2012 filed in the matter of an opposition to European Patent Application 2,550,886. Dec. 29, 2015, 1 page.
[No Author Listed] Witness statement of Mattias Eidelbrekt in the matter of an opposition to European Patent Application 2,550,886. Dec. 29, 2014, 1 page.
Halstead et al., Hockey Headgear and the Adequacy of Current Designs and Standards Safety in Ice Hockey. American Society for Testing and Materials, ASTM STP 1341. 1998, 8 pages.
Pacocha, 2012 Lazer helmets and eyewear—First look: New-school "brain bucket" urban/dirt jump helmets highlight the line. BikeRadar. http://www.bikeradar.com/news/article/2012-lazer-helmets-and-eyewear-first-look-30811/, Jul. 1, 2011, 9 pages.
Schwarz, As Injuries Rise, Scant Oversight of Helmets. The New York Times. http://www.nytimes.com/2010/10/21/sports/football/21helmets.html?pagewanted=all&_r=0, Published on Oct. 20, 2010, 9 pages.

(56) References Cited

OTHER PUBLICATIONS

[No Author Listed] *Bauer Hockey Ltd. V. Sport Maska Inc.*d.b.a. CCM Hockey (Court No. T-123-15) Fourth Amended Statement of Defence and Counterclaim. May 25, 2018. 53 pages.

* cited by examiner

SPORTS HELMET WITH ROTATIONAL IMPACT PROTECTION

CROSS-REFERENCE TO RELATED APPLICATIONS

This application is a continuation of U.S. patent application Ser. No. 13/560,546 filed on Jul. 27, 2012, which claims priority to U.S. Provisional Application No. 61/512,266 filed on Jul. 27, 2011 and U.S. Provisional Application No. 61/587,040 filed on Jan. 16, 2012, the contents of which are incorporated herein by reference in their entirety.

FIELD OF THE INVENTION

The invention relates generally to a sports helmet providing protection against rotational impacts.

BACKGROUND OF THE INVENTION

Helmets are worn in sports and other activities to protect their wearers against head injuries. To that end, helmets typically comprise a rigid outer shell and inner padding to absorb energy when impacted.

Various types of impacts are possible. For example, a helmet may be subjected to a radial impact in which an impact force is normal to the helmet and thus tends to impart a translational movement to the helmet. A helmet may also be subjected to a rotational impact which tends to impart an angular movement to the helmet. The rotational impact can be a tangential impact in which an impact force is tangential to the helmet or, more commonly, an oblique impact in which an impact force is oblique to the helmet and has both a radial impact force component and a tangential impact force component.

A rotational impact results in angular acceleration of the wearer's brain within his/her skull. This can cause serious injuries such as concussions, subdural hemorrhage, or nerve damage. Linear acceleration also results if the rotational impact is oblique.

Although helmets typically provide decent protection against radial impacts, their protection against rotational impacts is usually deficient. This is clearly problematic given the severity of head injuries caused by rotational impacts.

For these and other reasons, there is a need for improvements directed to providing a sports helmet providing protection against rotational impacts.

SUMMARY OF THE INVENTION

According to an aspect of the invention, there is provided a sports helmet for protecting a head of a wearer and comprising a rotational impact protection device.

According to one aspect, the invention provides a sports helmet for protecting a head of a wearer, the sports helmet defining a cavity for receiving the wearer's head, the sports helmet comprising: (a) an outer shell comprising an external surface of the sport helmet; (b) inner padding disposed between the outer shell and the wearer's head when the sports helmet is worn; (c) an adjustment mechanism operable by the wearer to vary an internal volume of the cavity to adjust a fit of the sports helmet on the wearer's head; and (d) a rotational impact protection device disposed between the external surface of the sport helmet and the wearer's head when the sport helmet is worn, the rotational impact protection device comprising a surface movable relative to the external surface of the sport helmet in response to a rotational impact on the outer shell to absorb rotational energy from the rotational impact, the surface of the rotational impact protection device undergoing displacement when the adjustment mechanism is operated by the wearer to vary the internal volume of the cavity.

According to another aspect, the invention provides a sports helmet for protecting a head of a wearer, the sports helmet defining a cavity for receiving the wearer's head, the sports helmet comprising: (a) an outer shell comprising an external surface of the sports helmet; (b) inner padding disposed between the outer shell and the wearer's head when the sports helmet is worn; (c) an adjustment mechanism for adjusting an internal volume of the cavity to adjust a fit of the sports helmet on the wearer's head; and (d) a floating liner disposed between the inner padding and the wearer's head when the sports helmet is worn, the floating liner being movable relative to the outer shell in response to a rotational impact on the outer shell to absorb rotational energy from the rotational impact, the floating liner being configured to accommodate adjustment of the internal volume of the cavity when the adjustment mechanism is operated by the wearer.

According to another aspect, the invention provides a sports helmet for protecting a head of a wearer, the sports helmet defining a cavity for receiving the wearer's head, the sports helmet comprising: (a) an outer shell comprising an external surface of the sports helmet; (b) inner padding disposed between the outer shell and the wearer's head when the sports helmet is worn; and (c) a floating liner disposed between the inner padding and the wearer's head when the sports helmet is worn, the floating liner being movable relative to the outer shell in response to a rotational impact on the outer shell to absorb rotational energy from the rotational impact, the floating liner comprising stretchable material such that at least part of the rotational energy is absorbed by stretching of the stretchable material.

According to a further aspect, the invention provides a sports helmet for protecting a head of a wearer, the sports helmet defining a cavity for receiving the wearer's head, the sports helmet comprising: (a) an outer shell comprising an external surface of the sports helmet; (b) inner padding disposed between the outer shell and the wearer's head when the sports helmet is worn; and (c) a floating liner disposed between the inner padding and the wearer's head when the sports helmet is worn, the floating liner being movable relative to the outer shell and the inner padding in response to a rotational impact on the outer shell to absorb rotational energy from the rotational impact, the floating liner comprising an inner surface for contacting the wearer's head and an outer surface facing the inner padding, the outer surface of the floating liner being in frictional engagement with the inner padding in response to the rotational impact such that at least part of the rotational energy is dissipated by friction between the inner padding and the outer surface of the floating liner, the outer surface of the floating liner having a coefficient of friction with the inner padding of at least 0.2 measured according to ASTM G115-10.

According to another aspect, the invention provides a sports helmet for protecting a head of a wearer, the sports helmet defining a cavity for receiving the wearer's head, the sports helmet comprising: (a) an outer shell comprising an external surface of the sports helmet; (b) inner padding disposed between the outer shell and the wearer's head when the sports helmet is worn; (c) a floating liner disposed between the inner padding and the wearer's head when the sports helmet is worn, the floating liner being movable relative to the outer shell in response to a rotational impact on the outer shell to absorb rotational energy from the rotational impact; and (d) an occipital pad for engaging an occipital region of the wearer's head, the occipital pad being selectively movable relative to the outer shell, the floating liner being movable with the occipital pad during adjustment of the occipital pad.

According to a further aspect, the invention provides a sports helmet for protecting a head of a wearer, the sports helmet defining a cavity for receiving the wearer's head, the sports helmet comprising: (a) an outer shell comprising an external surface of the sports helmet; (b) inner padding disposed between the outer shell and the wearer's head when the sports helmet is worn; and (c) a floating liner disposed between the inner padding and the wearer's head when the sports helmet is worn, the floating liner being movable relative to the outer shell in response to a rotational impact on the outer shell to absorb rotational energy from the rotational impact, the floating liner comprising a top portion for contacting a top region of the wearer's head and a plurality of branches extending downwardly from the top portion of the floating liner and arranged for contacting the wearer's head.

According to another aspect, the invention provides a sports helmet for protecting a head of a wearer, the sports helmet defining a cavity for receiving the wearer's head, the sports helmet comprising: (a) an outer shell comprising an external surface of the sports helmet; (b) inner padding disposed between the outer shell and the wearer's head when the sports helmet is worn; and (c) a floating liner disposed between the inner padding and the wearer's head when the sports helmet is worn, the floating liner being movable relative to the outer shell in response to a rotational impact on the outer shell to absorb rotational energy from the rotational impact, wherein an interface between the floating liner and the inner padding is fastener-free at an apex of the interface between the floating liner and the inner padding.

According to a further aspect, the invention provides a hockey or lacrosse helmet for protecting a head of a hockey or lacrosse player, the helmet defining a cavity for receiving the player's head, the helmet comprising: (a) an outer shell comprising an external surface of the helmet, the outer shell comprising a first shell member and a second shell member moveable relative to one another for adjusting an internal volume of the cavity to adjust a fit of the helmet on the player's head; (b) inner padding disposed between the outer shell and the player's head when the helmet is worn; and (c) a floating liner disposed between the inner padding and the player's head when the helmet is worn, the floating liner being movable relative to the outer shell in response to a rotational impact on the outer shell to absorb rotational energy from the rotational impact, the floating liner being configured to accommodate adjustments of the internal volume of the cavity when the first shell member and the second shell member are moved relative to one another.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

Figure 1:
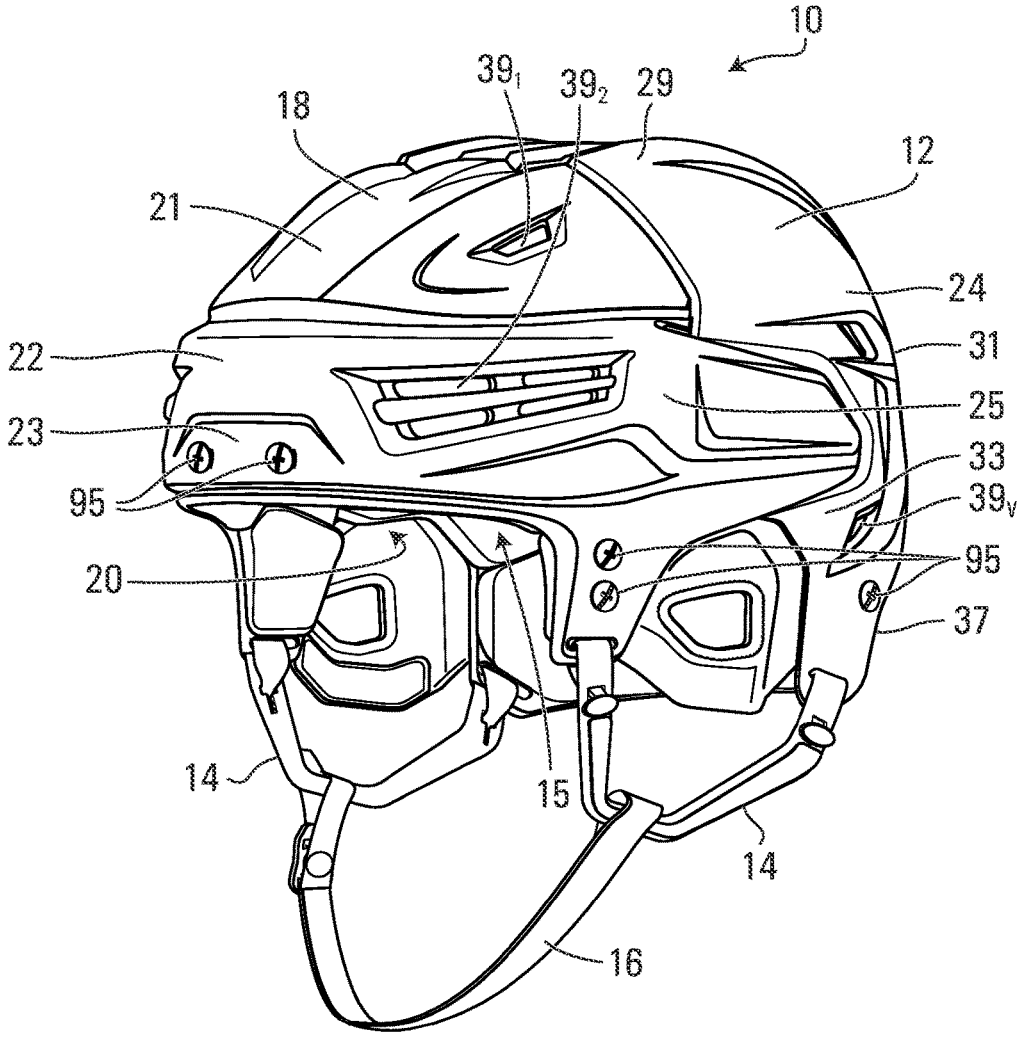
FIG. 1 shows an example of a sports helmet for protecting a head of a wearer in accordance with an embodiment of the invention.
Figure 2:
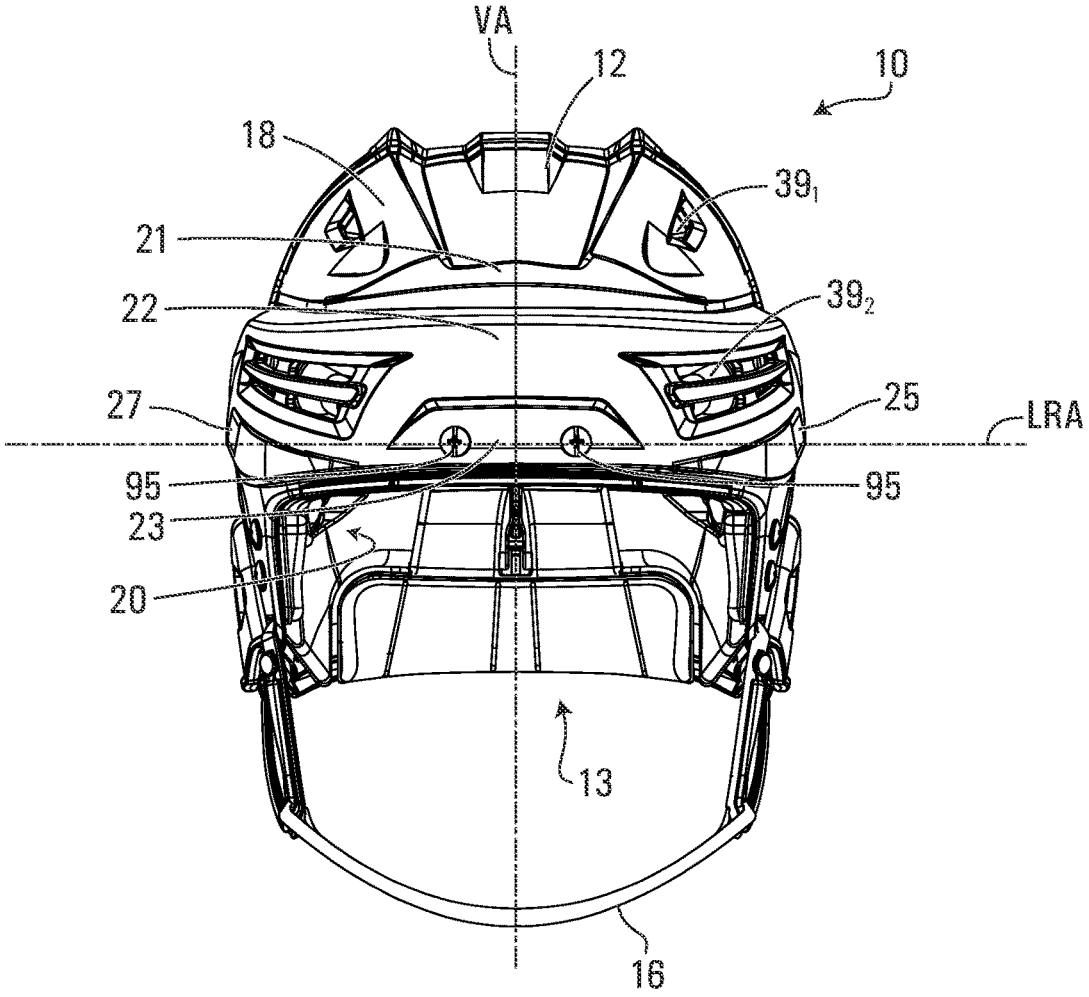
FIG. 2 is a front view of the sports helmet FIG. 1.
Figure 3:
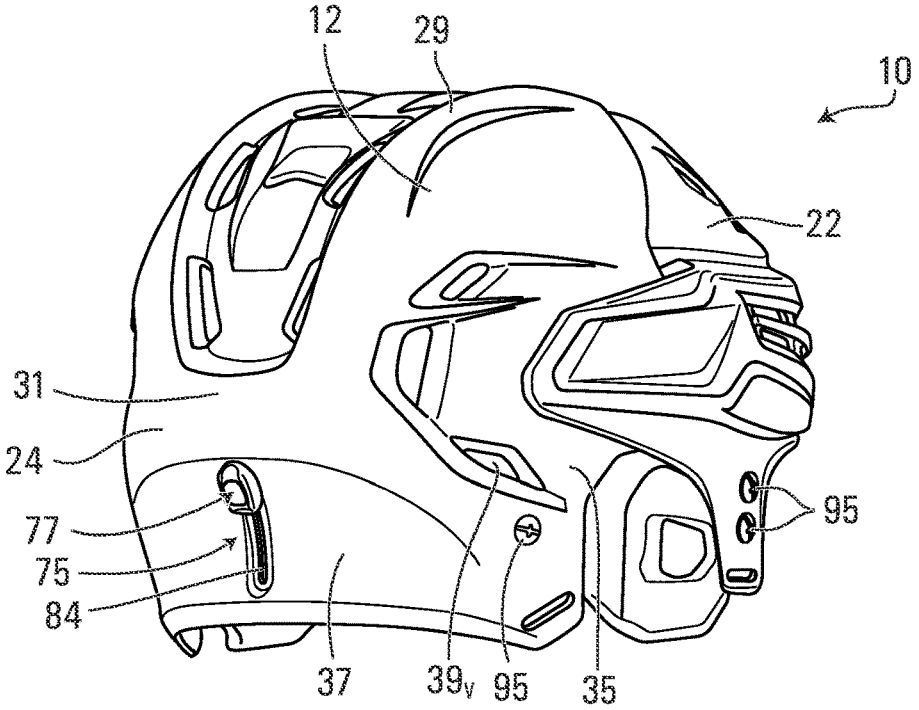
FIG. 3 is a rear perspective view of the sports helmet FIG. 1.
Figure 4:
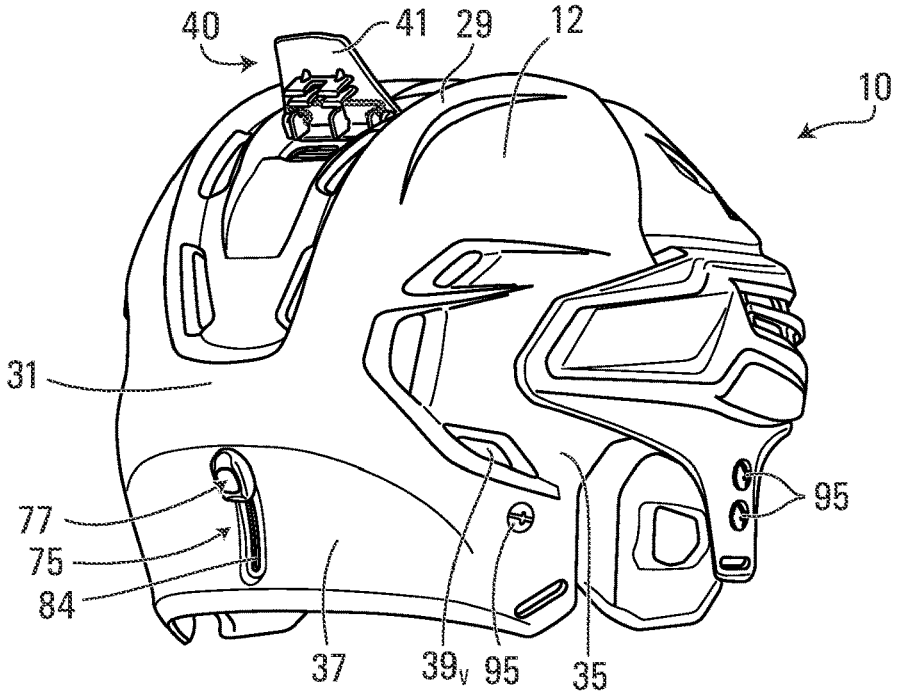
FIG. 4 is a rear perspective view of the sports helmet FIG. 1, showing the actuator in a released position and wherein the outer shell members define a first cavity for receiving the wearer's head.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

FIGS. 1 to 12 show an example of a helmet 10 for protecting a head 11 of a wearer in accordance with an embodiment of the invention. In this embodiment, the helmet 10 is a sports helmet for protecting the head 11 of the wearer who is a sports player. More particularly, in this embodiment, the sports helmet 10 is a hockey or lacrosse helmet for protecting the head 11 of the wearer who is a hockey or lacrosse player. It is noted, however, that the invention is not limited to any particular type of sports helmet. For instance, a sports helmet constructed using principles described herein in respect of the sports helmet 10 may be used for protecting the head of a player of another type of contact sport (sometimes referred to as "full-contact sport" or "collision sport") in which there are significant impact forces on the player due to player-to-player and/or player-to-object contact. For example, in one embodiment, a sports helmet constructed using principles described herein in respect of the sports helmet 10 may be a football helmet for protecting the head of a football player. Furthermore, a sports helmet constructed using principles described herein in respect of the sports helmet 10 may be for protecting the head of a wearer involved in a sport other than a contact sport (e.g., bicycling, motorcycle, skiing, snowboarding, horseback riding or another equestrian activity, etc.).

The sports helmet 10 defines a cavity 13 for receiving the wearer's head 11 to protect the wearer's head 11 when the sports helmet 10 is impacted (e.g., when the sports helmet 10 hits a board or an ice or other playing surface or is struck by a puck, ball, a lacrosse stick or a hockey stick or when the player is receiving a hit (body check) by another player and the head of the player is hit directly or indirectly). More particularly, in this embodiment, the sports helmet 10 is designed to provide protection against a radial impact in which an impact force is normal to the sports helmet 10 and thus tends to impart a translational movement to the sports helmet 10 ("radial" is used herein in a general sense to mean that the radial impact is along a direction which is perpendicular to a plane that is tangential to the helmet's external surface and, since a helmet is generally round, such impact will extend along a radial direction). In addition, the sports helmet 10 is designed to provide protection against a rotational impact which tends to impart an angular movement to the sports helmet 10. A rotational impact can be a tangential impact in which an impact force is tangential to the sports helmet 10 or, more commonly, an oblique impact in which an impact force is oblique to the sports helmet 10 and has a radial impact force component and a tangential impact force component. A rotational impact thus exerts a rotational force on the sports helmet 10, i.e., the tangential impact force in the case of a tangential impact and the tangential impact force component in the case of an oblique impact.

Figure 65:
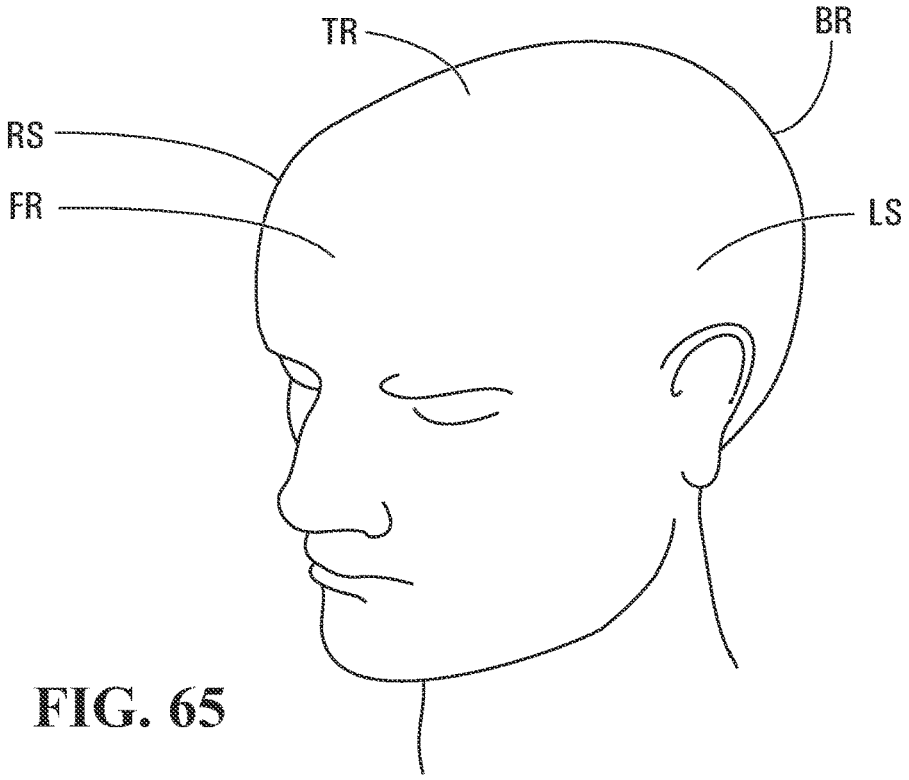
FIG. 65 is a front perspective view of the head of the wearer.
Figure 66:
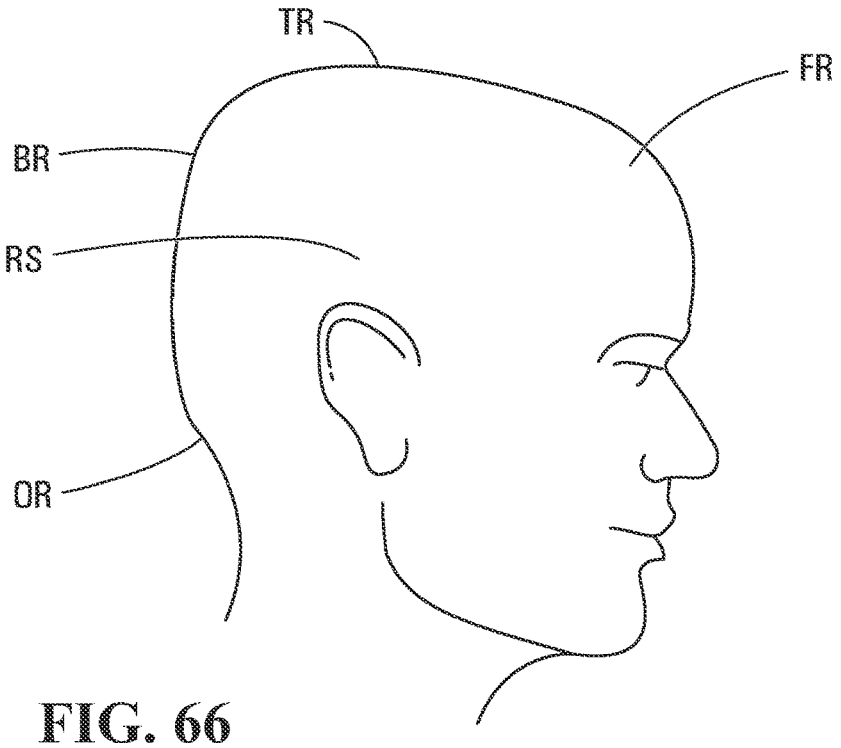
FIG. 66 is a side view of the head of the wearer.

The sports helmet 10 protects various regions of the wearer's head 11. As shown in FIGS. 65 and 66, the wearer's head 11 comprises a front region FR, a top region TR, left and right side regions LS, RS, a back region BR, and an occipital region OR. The front region FR includes a forehead and a front top part of the head 11 and generally corresponds to a frontal bone region of the head 11. The left and right side regions LS, RS are approximately located above the wearer's ears. The back region BR is opposite the front region FR and includes a rear upper part of the head 11. The occipital region OR substantially corresponds to a region around and under the head's occipital protuberance.

The sports helmet 10 has an external surface 18 and an internal surface 20 that contacts the wearer's head 11 when the sports helmet 10 is worn. The sports helmet 10 has a front-back axis FBA, a left-right axis LRA, and a vertical axis VA which are respectively generally parallel to a dorsoventral axis, a dextrosinistral axis, and a cephalocaudal axis of the wearer when the sports helmet 10 is worn and which respectively define a front-back direction, a left-right direction, and a vertical direction of the sports helmet 10. Since they are generally oriented longitudinally and transversally of the sports helmet 10, the front-back axis FBA and the left-right axis LRA can also be referred to as a longitudinal axis and a transversal axis, respectively, while the front-back direction and the left-right direction can also be referred to a longitudinal direction and a transversal direction.

In response to an impact, the sports helmet 10 absorbs energy from the impact to protect the wearer's head 11. In particular, in this embodiment, as further discussed below, the sports helmet 10 comprises a rotational impact protection device for causing an angular movement of its external surface 18 relative to its internal surface 20 in response to a rotational impact to absorb rotational energy from the rotational impact. This reduces rotational energy transmitted to the wearer's head 11 and therefore reduces angular acceleration of the wearer's brain within his/her skull.

In this embodiment, the sports helmet 10 comprises an outer shell 12, inner padding 15, and a floating liner 50, which implements the rotational impact protection device. As further discussed later, the floating liner 50 is allowed a certain degree of freedom of movement (for that reason it is referred to as "floating") and constitutes an energy-absorbing structure that takes up a certain amount of energy during a rotational impact. The sports helmet 10 also comprises ear loops 14 and a chinstrap 16 for securing the sports helmet 10 to the wearer's head 11. The sports helmet 10 further comprises ear protectors 32 for protecting the left and right ears of the wearer.

The outer shell 12 provides strength and rigidity to the sports helmet 10. To that end, the outer shell 12 is made of rigid material. For example, in various embodiments, the outer shell 12 may be made of thermoplastic material such as polyethylene, polyamide (nylon), or polycarbonate, of thermosetting resin, or of any other suitable material. The outer shell 12 has an inner surface 17 facing the inner padding 15 and an outer surface 19 opposite the inner surface 17. In this example of implementation, the outer surface 19 of the outer shell 12 constitutes the external surface 18 of the sports helmet 10.

The outer shell 12 comprises a front outer shell member 22 and a rear outer shell member 24 that are connected to one another. The front outer shell member 22 comprises a top portion 21 for facing at least part of the top region TR of the wearer's head 11, a front portion 23 for facing at least part of the front region FR of the wearer's head 11, and left and right side portions 25, 27 extending rearwardly from the front portion 23 for facing at least part of the left and right side regions LS, RS of the wearer's head 11. The rear outer shell member 24 comprises a top portion 29 for facing at least part of the top region TR of the wearer's head 11, a back portion 31 for facing at least part of the back region BR of the wearer's head 11, an occipital portion 37 for facing at least part of the occipital region OR of the wearer's head 11, and left and right side portions 33, 35 extending forwardly from the back portion 31 for facing at least part of the left and right side regions LS, RS of the wearer's head 11.

Figure 64:
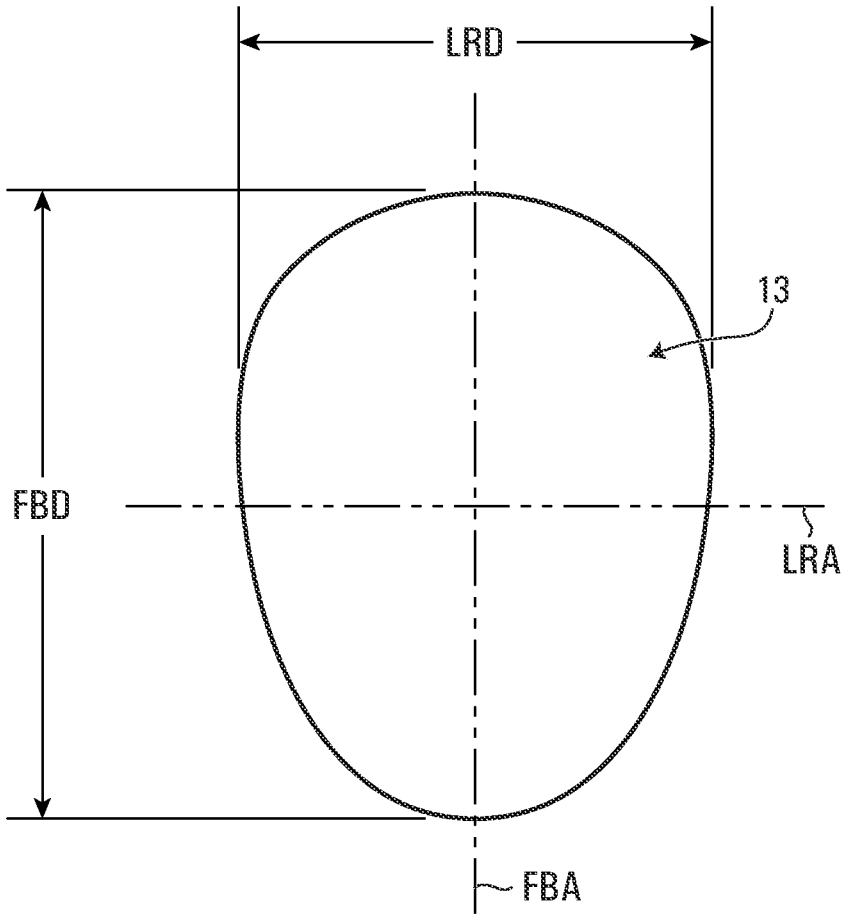
FIG. 64 is a schematic view of the cavity of the helmet.

The sports helmet 10 may be adjustable in order to adjust how it fits on the wearer's head 11. To that end, the sports helmet 10 comprises an adjustment mechanism 40 for adjusting a fit of the sports helmet 10 on the wearer's head 11. The adjustment mechanism 40 allows the fit of the sports helmet 10 to be adjusted by being operable by the wearer to vary the internal volume of the cavity 13 of the sports helmet 10. This can be done by adjusting one or more internal dimensions of the cavity 13 of the sports helmet 10, such as a front-back internal dimension FBD of the cavity 13 in the front-back direction of the sports helmet 10 and/or a left-right internal dimension LRD of the cavity 13 in the left-right direction of the sports helmet 10, as shown in FIG. 64.

Figure 5:
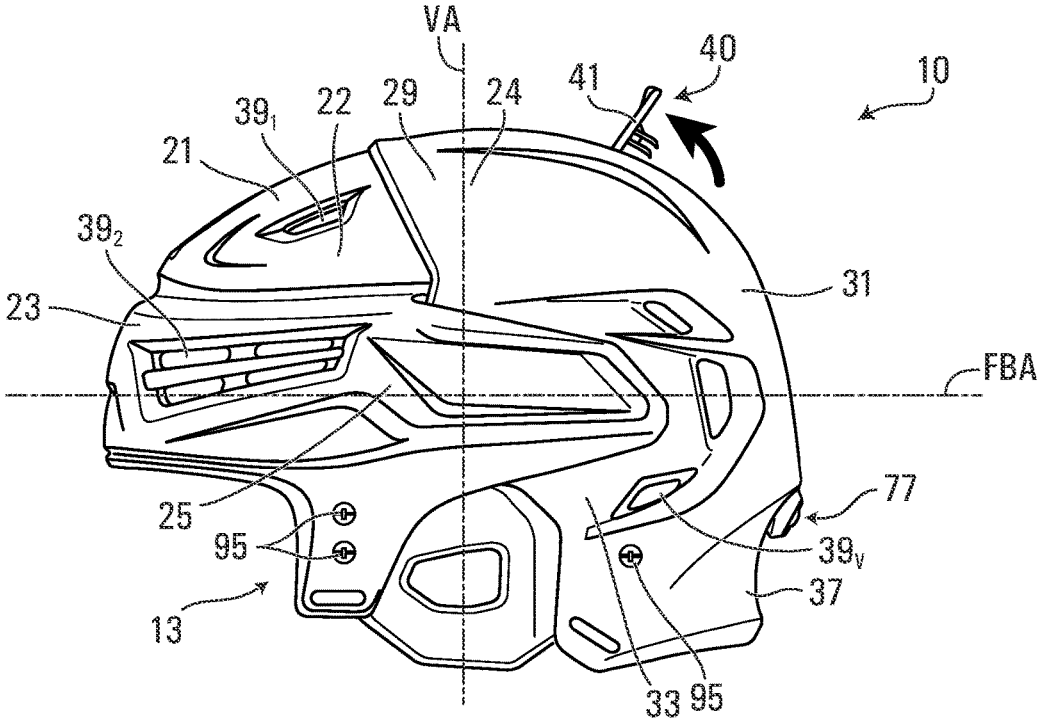
FIG. 5 is a side view of the sports helmet FIG. 4.
Figure 6:
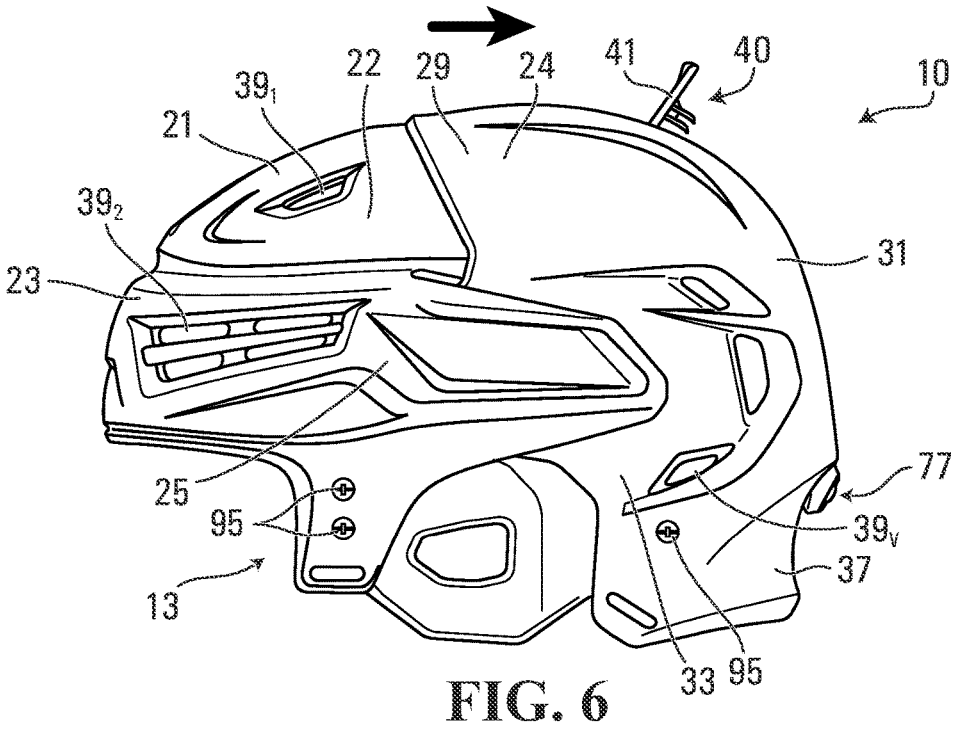
FIG. 6 is a side view of the helmet showing the actuator in the released position and showing movement of the outer shell members relative to each other.
Figure 7:
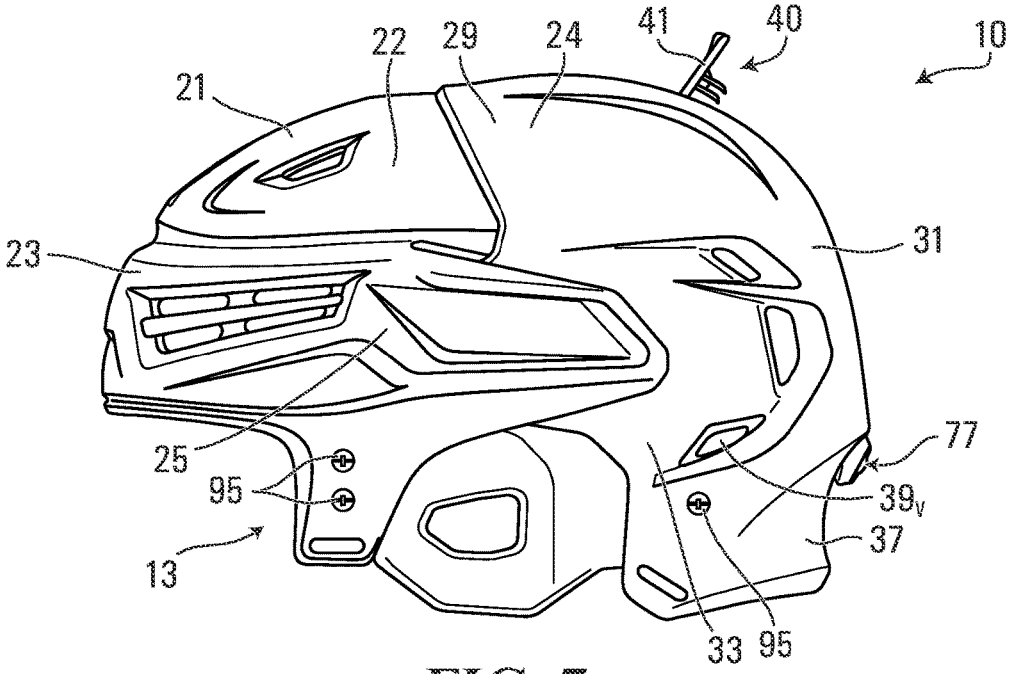
FIG. 7 is a side view of the sports helmet FIG. 1, showing the actuator in the released position and wherein the outer shell members define a second cavity for receiving the wearer's head.
Figure 8:
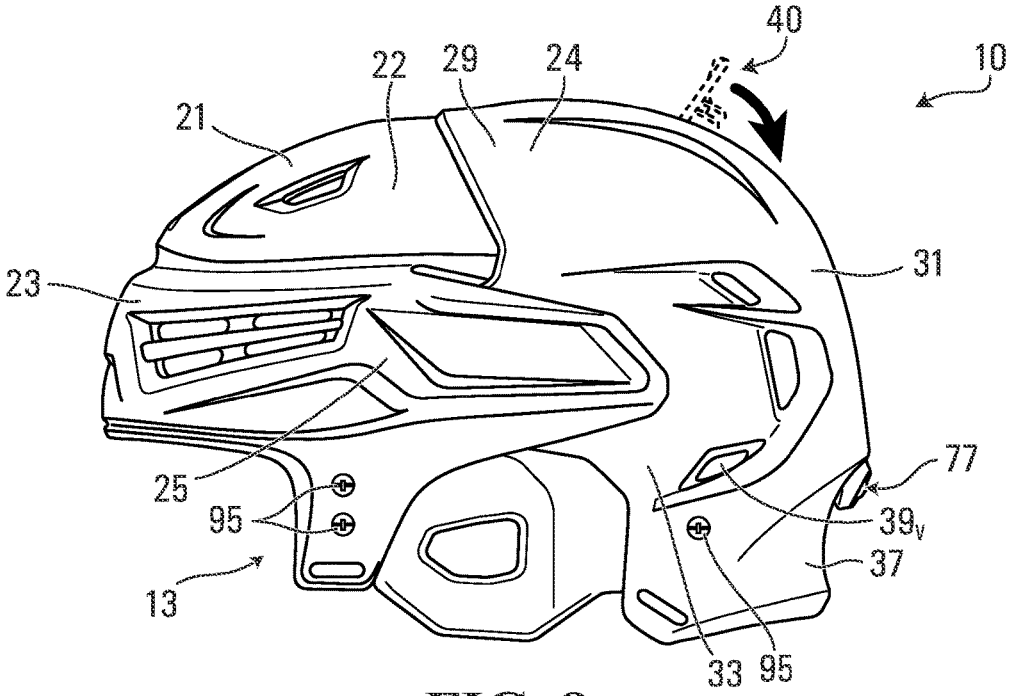
FIG. 8 is a side view of the sports helmet FIG. 7, showing movement of the actuator from the released position to a locked position.

More particularly, in this embodiment, the outer shell 12 and the inner padding 15 are adjustable to adjust the fit of the sports helmet 10 on the wearer's head 11. To that end, in this case, the front outer shell member 22 and the rear outer shell member 24 are movable relative to one another to adjust the fit of the sports helmet 10 on the wearer's head 11. The adjustment mechanism 40 is connected between the front outer shell member 22 and the rear outer shell member 24 to enable adjustment of the fit of the sports helmet 10 by moving the outer shell members 22, 24 relative to one another. In this example, relative movement of the outer shell members 22, 24 for adjustment purposes is in the front-back direction of the sports helmet 10 such that the front-back internal dimension FBD of the cavity 13 of the sports helmet 10 is adjusted. This is shown in FIGS. 5 to 8 in which the rear outer shell member 24 is moved relative to the front outer shell member 22 from a first position, which is shown in FIG. 5 and which corresponds to a relatively small size of the sports helmet 10, to a second position, which is shown in FIG. 6 and which corresponds to an intermediate size of the sports helmet 10, and to a third position, which is shown in FIGS. 7 and 8 and which corresponds to a relatively large size of the sports helmet 10.

As best shown in FIGS. 4 to 10 and 35 to 37, the adjustment mechanism 40 may comprise an actuator 41 that can be moved (in this case pivoted) by the wearer between a locked position, in which the actuator 41 engages a locking part of the front outer shell member 22 and thereby locks the outer shell members 22, 24 relative to one another, and a released position, in which the actuator 41 is disengaged from the locking part of the front outer shell member 22 and thereby permits the outer shell members 22, 24 to move relative to one another so as to adjust the size of the helmet 10.

Figure 30:
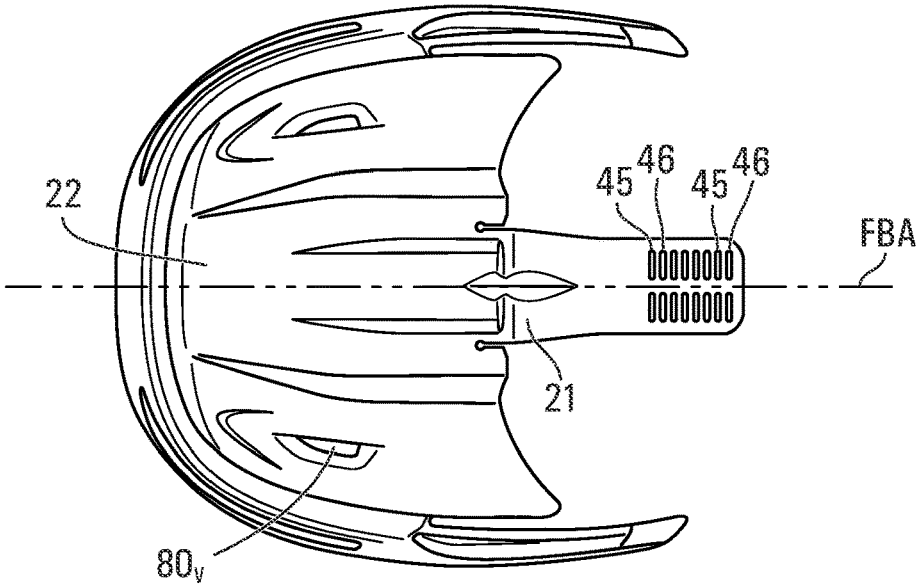
FIG. 30 is a top view of the front outer shell member of FIG. 27.
Figure 31:
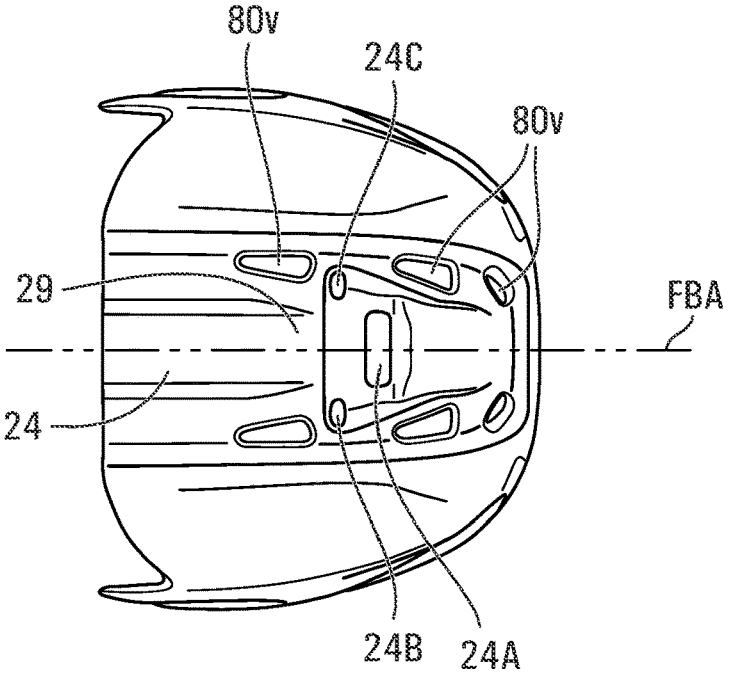
FIG. 31 is a top view of the second or rear outer shell member of FIG. 27.
Figure 32:
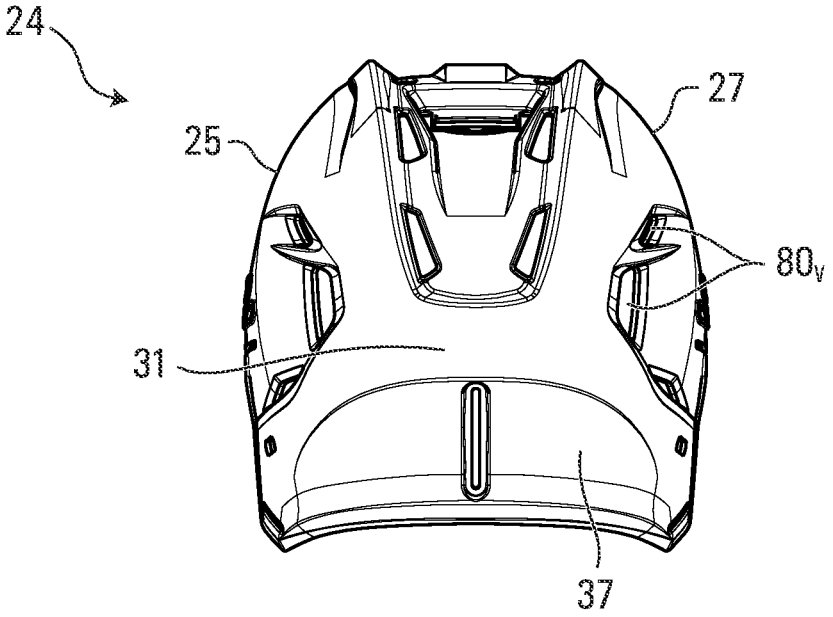
FIG. 32 is a rear view of the rear outer shell member of the outer shell.
Figure 33:
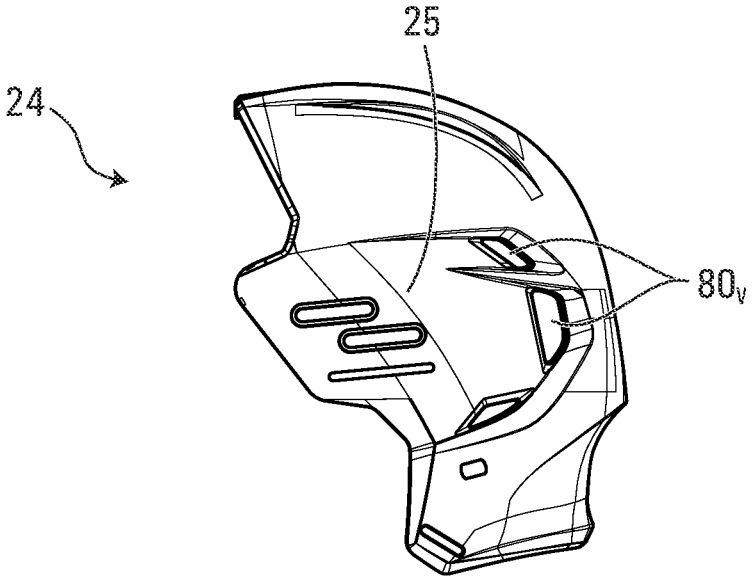
FIG. 33 is a side view of the rear outer shell member of FIG. 32.
Figure 34:
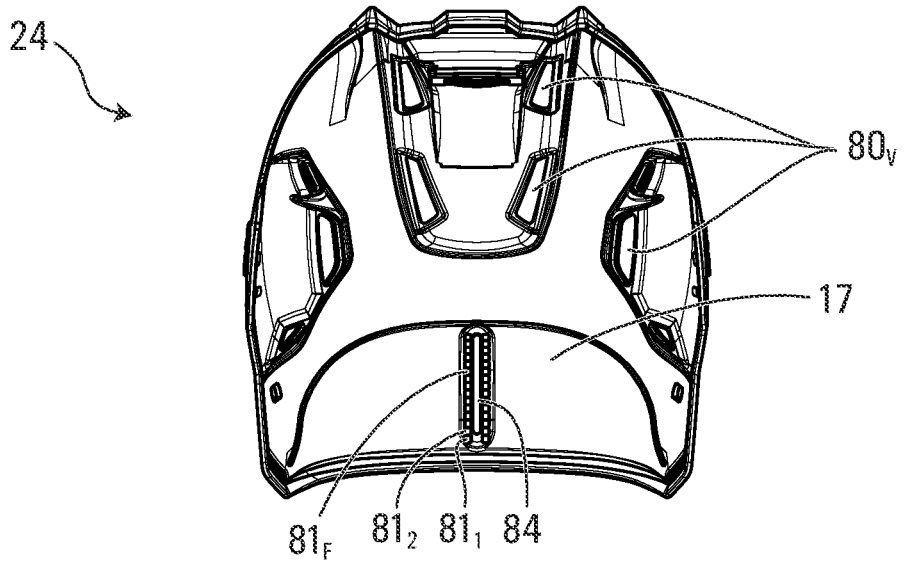
FIG. 34 is a front view of the rear outer shell member of FIG. 32.
Figure 35:
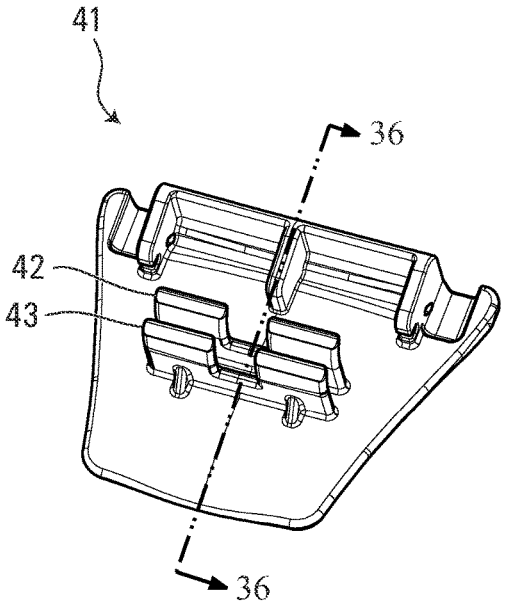
FIG. 35 is an enlarged bottom perspective view of the actuator.
Figure 37:
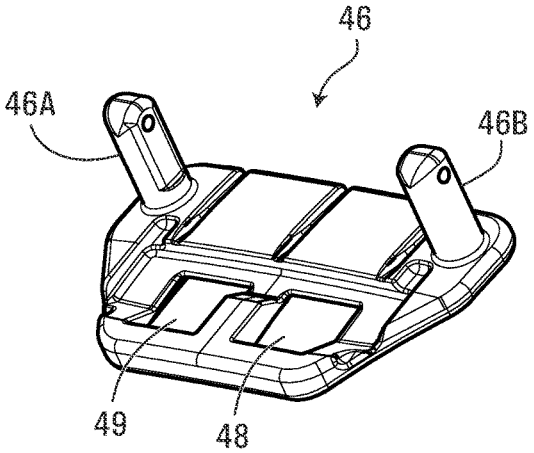
FIG. 37 is an enlarged top perspective view of a base member.
Figure 36:
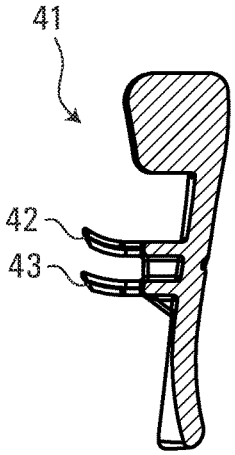
FIG. 36 is a cross-sectional view taken along line 36-36.
Figure 38:
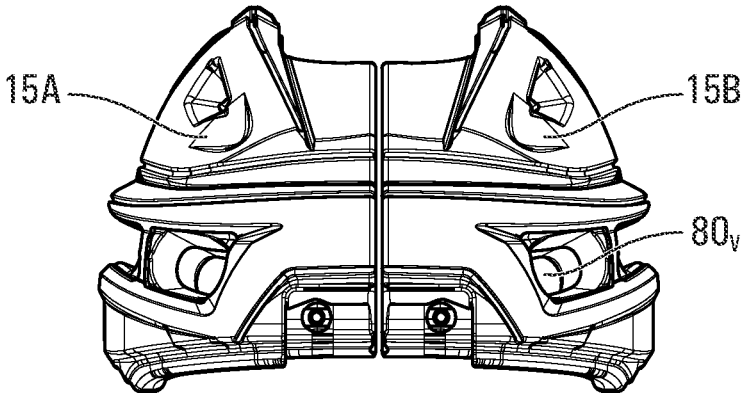
FIG. 38 is a front view of the left and right front inner pad members of the inner padding.
Figure 39:
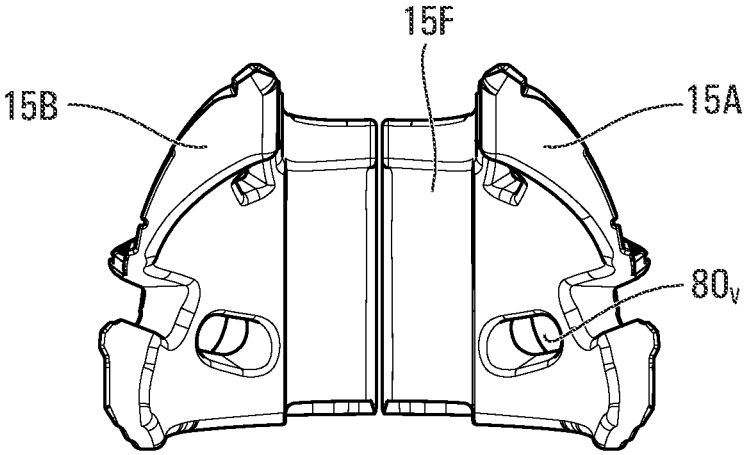
FIG. 39 is a rear view of the left and right front inner pad members of FIG. 38.

For example, the actuator 41 may comprise first and second pairs of teeth 42, 43 extending generally transversely relative to the longitudinal axis FBA. The actuator 41 can be moved (in this case pivoted) by the wearer between a locked position, in which the first and second pairs of teeth 42, 43 engage in first and second plurality of pairs of apertures 44, 45 provided on the front outer shell member 22 (as best shown in FIG. 30) and thereby locks the outer shell members 22, 24 relative to one another, and a released position, in which the first and second pairs of teeth 42, 43 of the actuator 41 are disengaged from the first and second pairs of apertures 44, 45 of the front outer shell member 22 and thereby permits the outer shell members 22, 24 to move relative to one another so as to adjust the size of the sports helmet 10. As seen in FIG. 31, the rear shell member 24 may comprise an aperture 24A in which the first and second pairs of teeth 42, 43 may extend in the locked position. It is understood that the rear shell member 24 may comprise two apertures instead of only one aperture. It is also understood that the actuator may comprise only one tooth, or only one pair of teeth instead of the first and second pairs of teeth 42, 43. As seen, in FIG. 37, the adjustment mechanism 40 may also comprise a base member 46 having first and second posts 46A, 46B to which the actuator 41 is pivotably mounted and the base member 46 may comprise first and second apertures 48, 49 for receiving the pair of first and second teeth 42, 43. Again, it is understood that the base member 46 may comprise only one aperture if the actuator 41 has only one tooth or only one pair of teeth. The base member 46 may be mounted between the inner padding 15 and the front outer shell member 22 and the first and second posts 46, 47 may extend in left and right apertures 24B, 24C provided on the rear outer shell member 24. The adjustment mechanism 40 may be implemented in various other ways in other embodiments.

As shown in FIGS. 27 to 34, the outer shell 12 may comprise a plurality of ventilation holes $\mathbf{39}_1$-$\mathbf{39}_V$ for allowing air to circulate around the wearer's head 11. In this case, each of the front and rear outer shell members 22, 24 defines respective ones of the ventilation holes $\mathbf{39}_1$-$\mathbf{39}_V$ of the outer shell 12.

The outer shell 12 may be implemented in various other ways in other embodiments. For example, in other embodiments, the outer shell 12 may be a single-piece shell. In such embodiments, the adjustment mechanism 40 may comprise an internal adjustment device located within the sports helmet 10 and having a head-facing surface movable relative to the wearer's head 11 in order to adjust the fit of the sports helmet 10. For instance, in some cases, the internal adjustment device may comprise an internal pad member movable relative to the wearer's head 11 or an inflatable member which can be inflated so that its surface can be moved closer to or further from the wearer's head 11 to adjust the fit.

Figure 12:
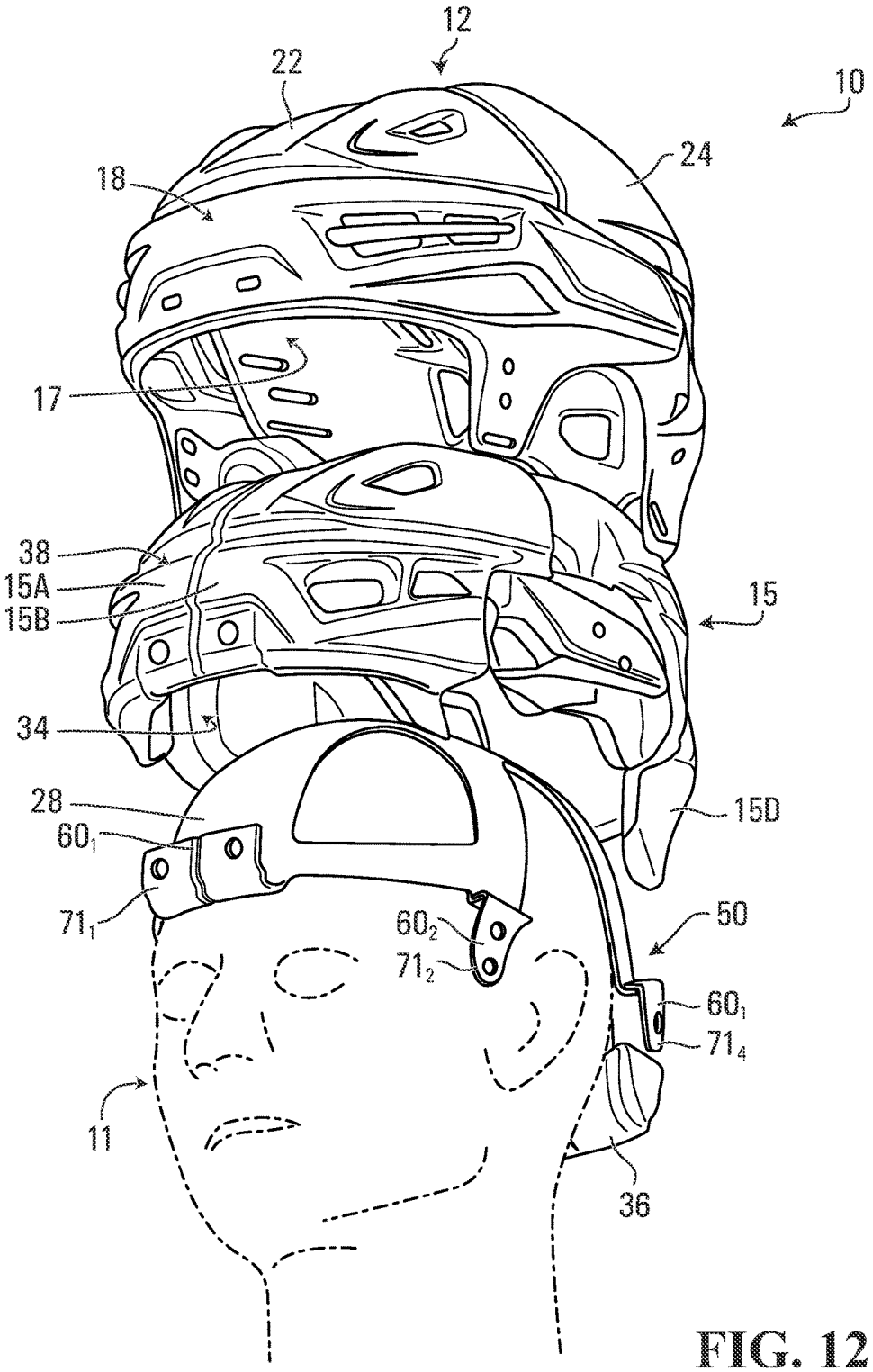
FIG. 12 is a front side perspective exploded view of the helmet of FIG. 9 showing the outer shell, inner padding and a rotational impact protection device that is implemented as a floating liner.

The inner padding 15 is disposed on the inner surface 17 of the outer shell 12 such that, in use, it is disposed between the outer shell 12 and the wearer's head 11 to absorb impact energy when the sports helmet 10 is impacted. As best seen in FIG. 12, the inner padding 15 has an outer surface 38 facing the outer shell 12 and an inner surface 34 facing the floating liner 50. The inner padding 15 may be mounted to the outer shell 12 in various ways. For example, in some embodiments, the inner padding 15 may be mounted to the outer shell 12 by one or more fasteners such as mechanical fasteners (e.g., tacks, staples, rivets, screws, etc.), an adhesive, stitches, or any other suitable fastening element. In such embodiments, the inner padding 15 is affixed to the outer shell 12 and, during movement of the front and rear outer shell members 22, 24 to adjust the size of the sports helmet 10, various parts of the inner padding 15 move along with the outer shell members 22, 24. The inner padding 15 has a three-dimensional external configuration that generally conforms to a three-dimensional internal configuration of the outer shell 12. The inner padding 15 comprises shock-absorbing material to absorb impact energy when the sports helmet 10 is impacted.

As best shown in FIGS. 9 to 11 and 38 to 45, the inner padding 15 comprises a front left inner pad member 15B for facing at least part of the front region FR and left side region LS of the wearer's head 11, a front right inner pad member 15A for facing at least part of the front region FR and right side region RS of the wearer's head 11, a rear left inner pad member 15D for facing at least part of the back region BR and left side region LS of the wearer's head 11, a rear right inner pad member 15C for facing at least part of the back region BR and right side region RS of the wearer's head 11, and a top inner pad member 15E for facing at least part of the top region TR and back region BR of the wearer's head 11. The front outer shell member 22 overlays the front right and left inner pad members 15A, 15B, the rear outer shell member 24 overlays the rear right and left inner pad members 15C, 15D and the front and rear outer shell members 22, 24 at least partially overlay the top inner pad member 15E. The inner pad members 15A, 15B, 15C, 15D, 15E of the inner padding 15 are movable relative to one another and with the outer shell members 22, 24 to allow adjustment of the fit of the sports helmet 10 using the adjustment mechanism 40. The inner padding 15 may comprise a plurality of ventilation holes $\mathbf{80}_1$-$\mathbf{80}_V$. In this case, the ventilation holes $\mathbf{80}_1$-$\mathbf{80}_V$ are aligned with respective ones of the ventilation holes $\mathbf{39}_1$-$\mathbf{39}_V$ of the outer shell 12.

Each of the inner pad members 15A, 15B, 15C, 15D, 15E of the inner padding 15 comprises shock-absorbing material to absorb impact energy when the sports helmet 10 is impacted. For example, in this embodiment, each of the inner pad members 15A, 15B, 15C, 15D, 15E comprises polymeric cellular material. For instance, the polymeric cellular material may comprise polymeric foam such as expanded polypropylene (EPP) foam, expanded polyethylene (EPE) foam, or any other suitable polymeric foam material and/or may comprise expanded polymeric microspheres (e.g., Expancel™ microspheres commercialized by Akzo Nobel). Any other material with suitable impact energy absorption may be used for the inner padding 15 in other embodiments.

Figure 9:
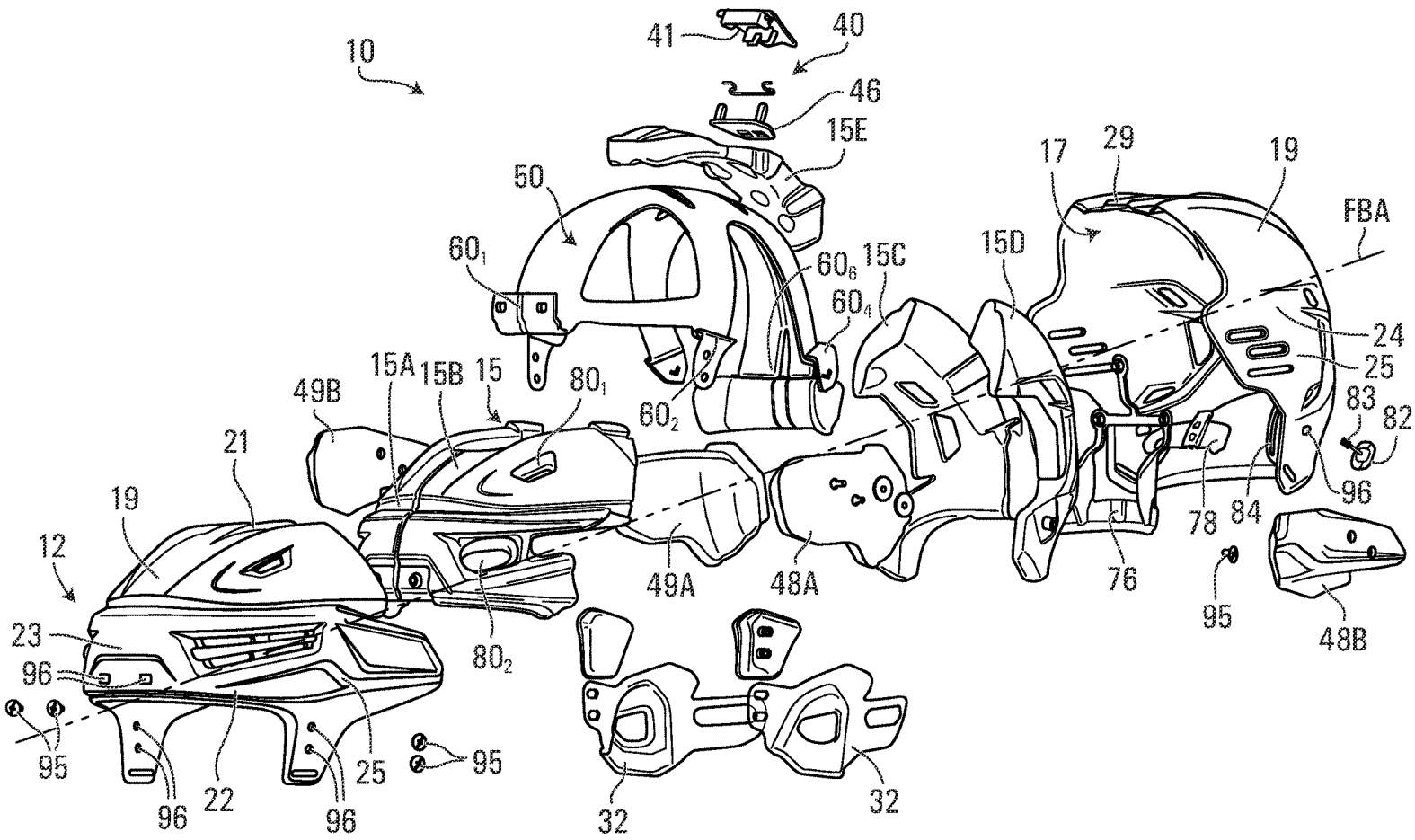
FIG. 9 is a front side perspective exploded view of the sports helmet FIG. 1 shown without the chin strap and ear loops.
Figure 10:
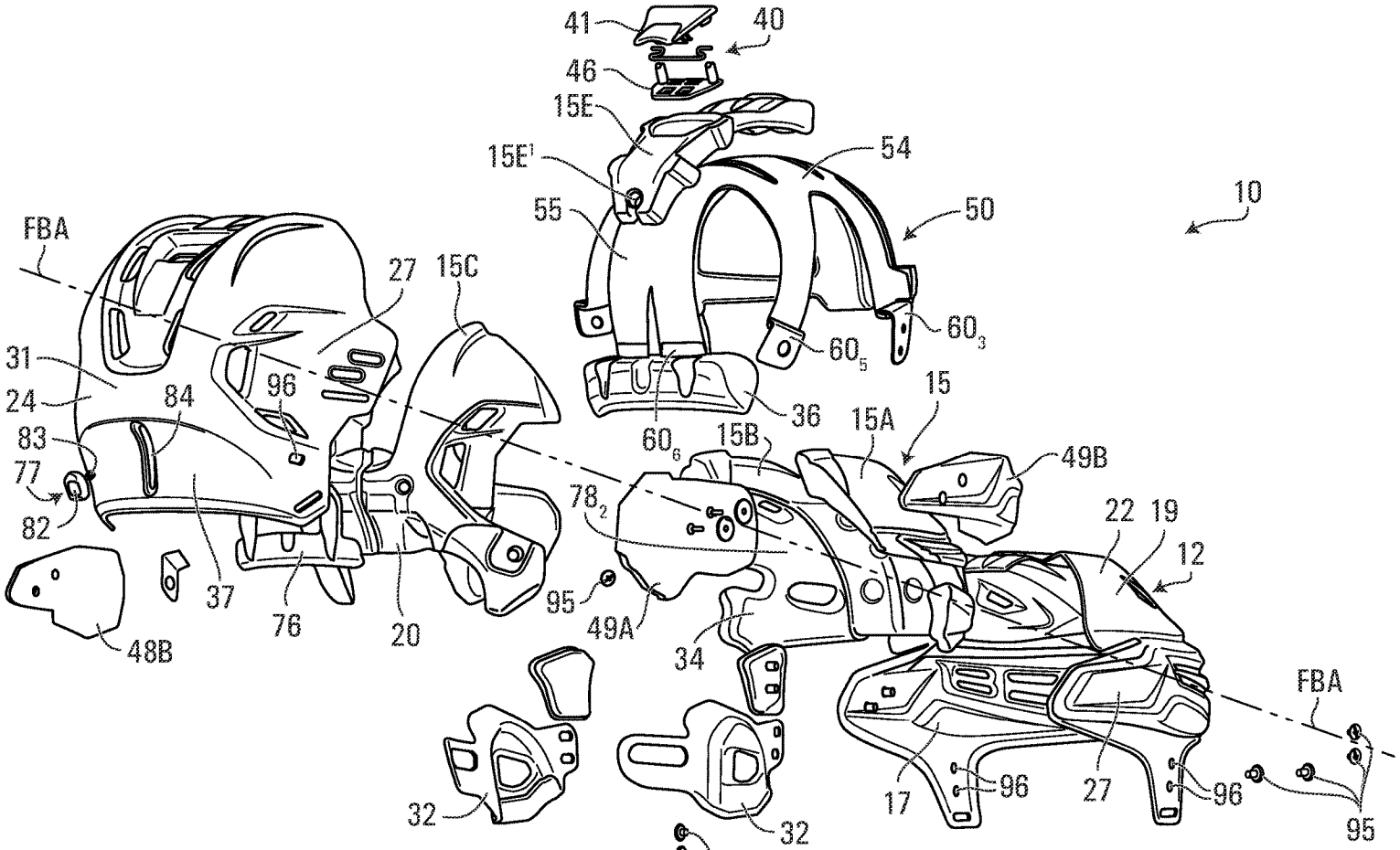
FIG. 10 is a rear side perspective exploded view of the sports helmet FIG. 9.
Figure 11:
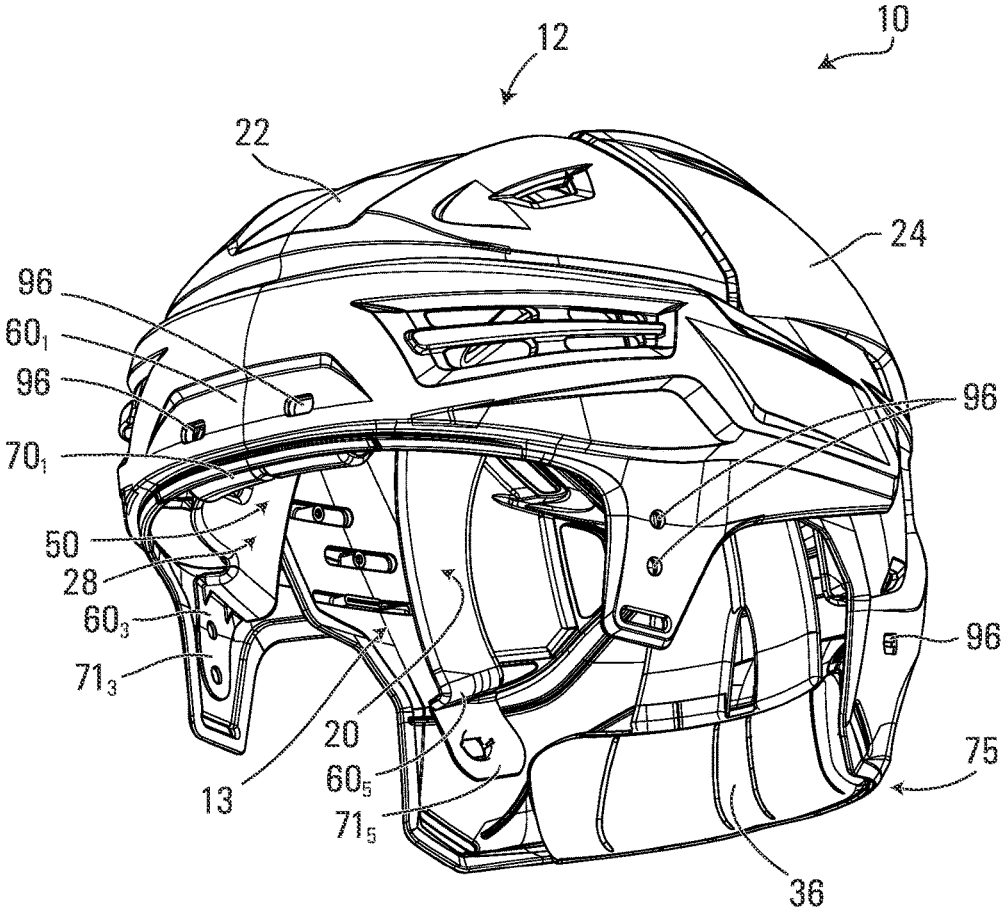
FIG. 11 is a bottom perspective view of the sports helmet FIG. 9 shown without the ear protectors and padding.

As best shown in FIGS. 9 and 10, the inner padding 15 may comprise left comfort pad members 48A, 49A for facing the left side region of the wearer's head 11 above the left ears and right comfort pad members 48B, 49B for facing the right side region of the wearer's head 11 above the right ears. The comfort pad members 48A, 48B, 49A, 49B may comprise any suitable soft material providing comfort to the wearer. For example, in some embodiments, the comfort pad members 48A, 48B, 49A, 49B may comprise polymeric foam such as polyvinyl chloride (PVC) foam or polyurethane foam (e.g., PORON XRD foam commercialized by Rogers Corporation).

The inner padding 15 may be implemented in various other ways in other embodiments. For example, in other embodiments, the inner padding 15 may comprise any number of pad members (e.g.: two pad members such as one pad member that faces at least part of the front region FR, top region TR, and left and right side regions LS, RS of the wearer's head 11 and another pad member that faces at least part of the back region BR, top region TR, and left and right side regions LS, RS of the wearer's head 11; a single pad that faces at least part of the front region FR, top region TR, left and right side regions LS, RS, and back region BR of the wearer's head 11; etc.).

The floating liner 50 provides impact protection, including rotational impact protection, when the sports helmet 10 is impacted. The liner 50 is "floating" in that it is movable relative to one or more other components of the helmet 10 in response to a rotational impact on the outer shell 12. This movement allows rotational energy from the rotational impact to be absorbed instead of being transmitted to the wearer's head 11. The floating liner 50 comprises a layer of material located between the external surface 18 and the internal surface 20 of the helmet 10. The layer of material of the floating liner 50 may include a single material constituent or different material constituents and/or may have a constant thickness or a variable thickness.

Figure 57:
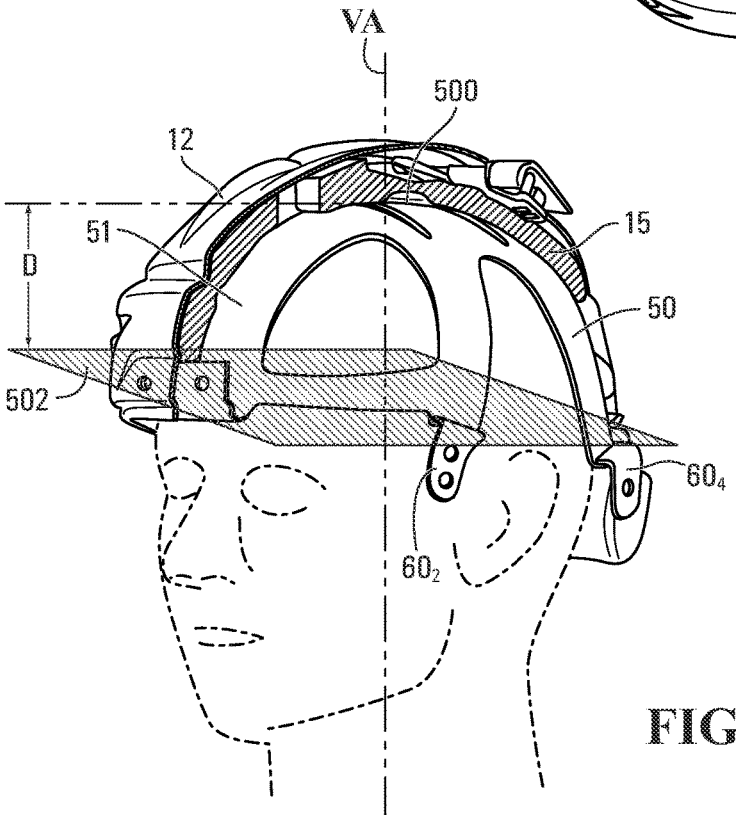
FIG. 57 is a perspective view showing the helmet on one side and the floating liner on the other side, the helmet and floating liner being on the wearer's head.
Figure 59:
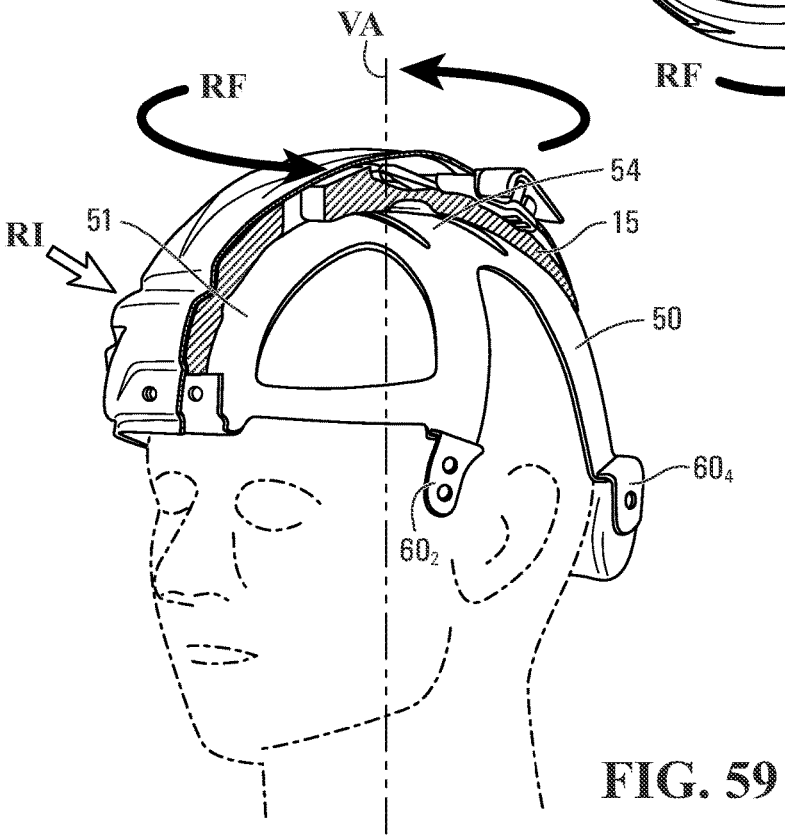
FIG. 59 shows an example of a reaction of the sports helmet FIG. 58 upon a rotational impact on the outer shell.
Figure 60:
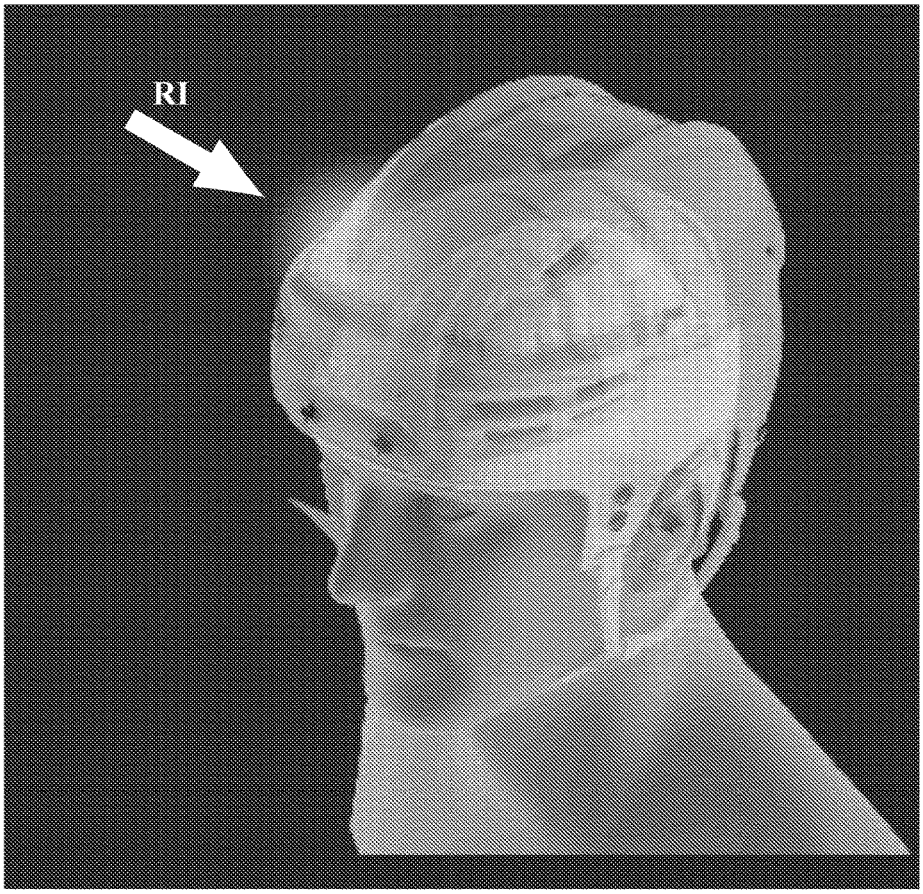
FIG. 60 is a perspective view of the helmet on the wearer's head, where the outer shell, floating liner and brain of the wearer's head are shown.

As best shown in FIGS. 12, 57 and 59, in this embodiment, the floating liner 50 is disposed between the inner padding 15 and the wearer's head 11 and the floating liner 50 is movable relative to the inner padding 15 and the outer shell 12. In particular, the floating liner 50 is movable with relation to the inner padding 15 and the outer shell 12 in response to a rotational impact on the sports helmet 10 to absorb rotational energy from the rotational impact. This reduces rotational energy transmitted to the wearer's head 11 and therefore reduces angular acceleration of the wearer's brain within his/her skull. In this embodiment, rotational energy from a rotational impact is absorbed by a frictional engagement of the floating liner 50 with the inner padding 15 in which energy is dissipated through friction and by an elastic deformation of the floating liner 50 in which energy is absorbed through stretching of the floating liner 50.

An example of how the floating liner 50 provides rotation impact protection in this embodiment is illustrated in FIGS. 56 to 63. The floating liner 50 is mounted such that, when a rotational force RF is exerted on the outer shell 12 due to a rotational impact RI on the outer shell 12, the outer shell 12 and the inner padding 15 move relative to the floating liner 50. This movement includes an angular movement of the outer shell 12 and the inner padding 15 relative to the floating liner 50 by an angle θ relative to the front-back axis FBA of the sports helmet 10. The angle θ may have various values depending on an intensity of the rotational impact RI and a construction of the sports helmet 10. For example, in some cases, the angle θ may be between 2° and 10°.

Movement of the outer shell 12 and the inner padding 15 relative to the floating liner 50 creates friction between the floating liner 50 and the inner padding 15. This friction dissipates rotational energy associated with the rotational impact RI. In addition, movement of the outer shell 12 and the inner padding 15 relative to the floating liner 50 induces an elastic deformation of the floating liner 50. More particularly, in this embodiment, the floating liner 50 stretches so as to curve in a direction of the rotational force RF. This stretching of the floating liner 50 absorbs rotational energy associated with the rotational impact RI.

In addition to its rotational impact protection, in this embodiment, the floating liner 50 also provides radial impact protection. More particularly, the floating liner 50 is elastically compressible in response to a linear impact force (i.e., a radial impact force in the case of a radial impact or a radial impact force component in the case of an oblique impact) to absorb energy by elastic compression. The floating liner 50 therefore implements a padding layer.

Figure 13:
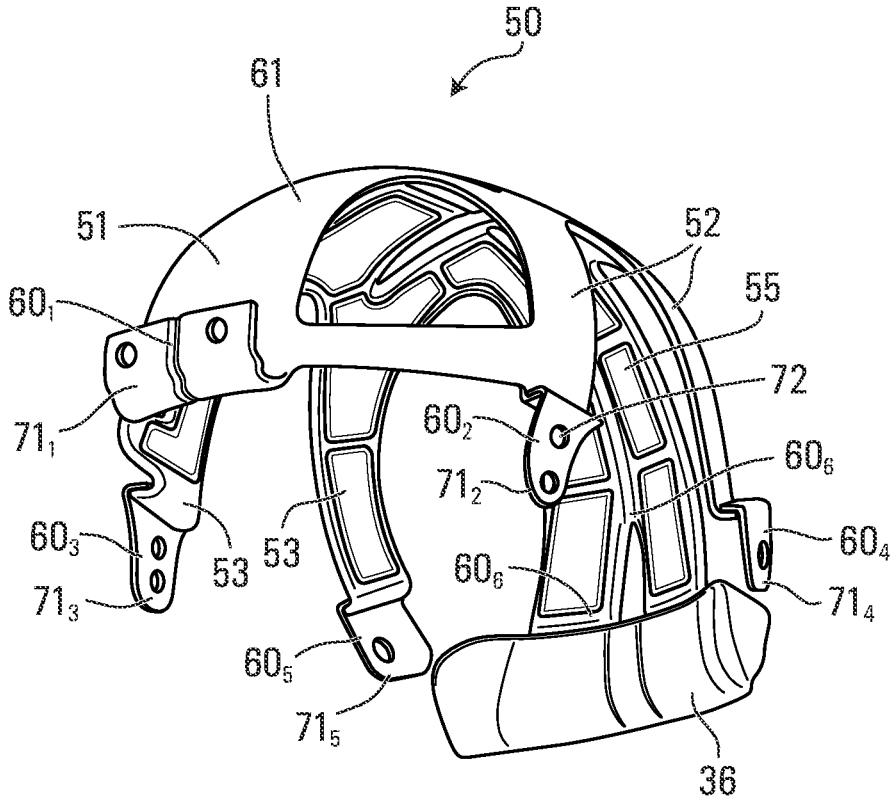
FIG. 13 is a perspective view of the floating liner of FIG. 12.
Figure 14:
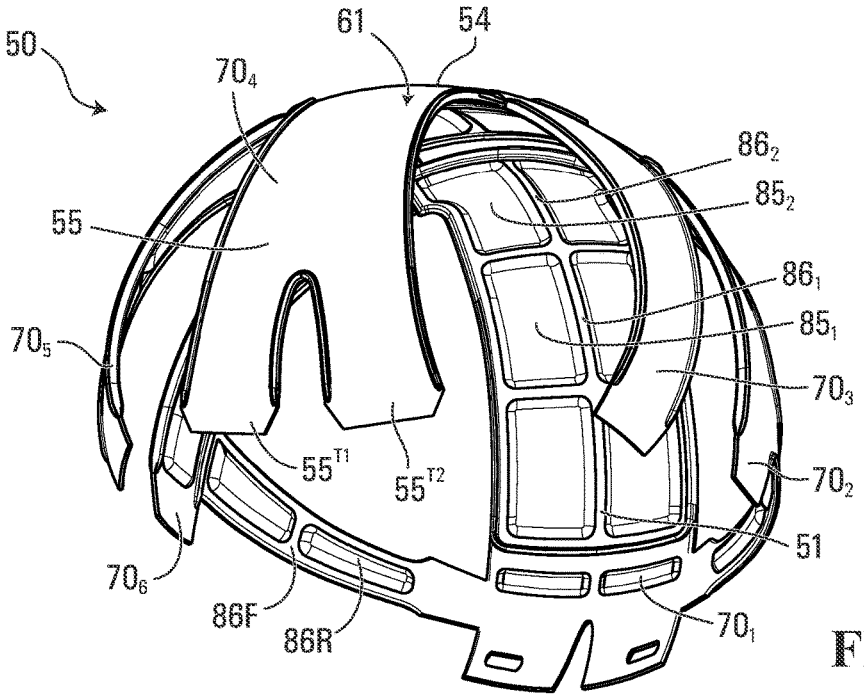
FIG. 14 is a rear bottom perspective view of the floating liner of FIG. 13 shown without the occipital pad and the fastening members.
Figure 15:
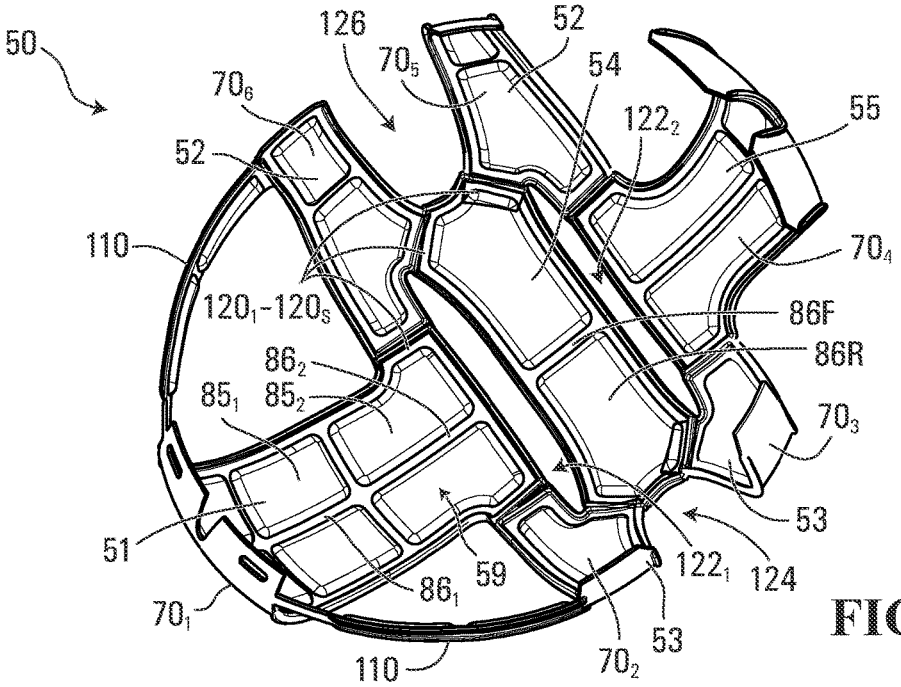
FIG. 15 is a bottom perspective view of the floating liner of FIG. 14.

With reference to FIGS. 13 to 15, the floating liner 50 comprises a front portion 51 for facing the front region FR of the wearer's head 11, left and right side portion 52, 53 for facing the left and right side regions LS, RS of the wearer's head 11, a top portion 54 for facing the top region TR of the wearer's head 11, and a back portion 55 for facing the back region BR of the wearer's head 11. These portions of the floating liner 50 are arranged such that the floating liner 50 has a dome shape for receiving the wearer's head 11. In this example, the front portion 51, side portions 52, 53, and back portion 55 comprise respective segments or branches $\mathbf{70}_1$-$\mathbf{70}_6$ extending downwardly from the top portion 54 and spaced from one another. The floating liner 50 also comprises an inner surface 59 for contacting the wearer's head 11 and an outer surface 61 facing the inner padding 15. In this case, the inner surface 59 of the floating liner 50 constitutes the internal surface 20 of the sports helmet 10 which contacts the wearer's head 11 when the sports helmet 10 is worn. The floating liner 50 may have various other shapes in other embodiments.

The floating liner 50 may be made of any suitable material to achieve its impact protection function. In this embodiment, in order to absorb energy by elastic deformation, the floating liner 50 comprises elastic material that is elastically stretchable to absorb rotational energy associated with a rotational force when the sports helmet 10 is impacted. Also, in this case, the elastic material of the floating liner 50 is elastically compressible to absorb impact energy associated with a linear force when the sports helmet 10 is impacted. The elastic material of the floating liner 50 may thus be an elastically stretchable compressible impact-absorbing material. For example, in some embodiments, the elastic material of the floating liner 50 may comprise elastomeric material (e.g., elastomeric polyurethane foam such as PORON XRD foam commercialized by Rogers Corporation or any other suitable elastomeric foam).

Figure 16:
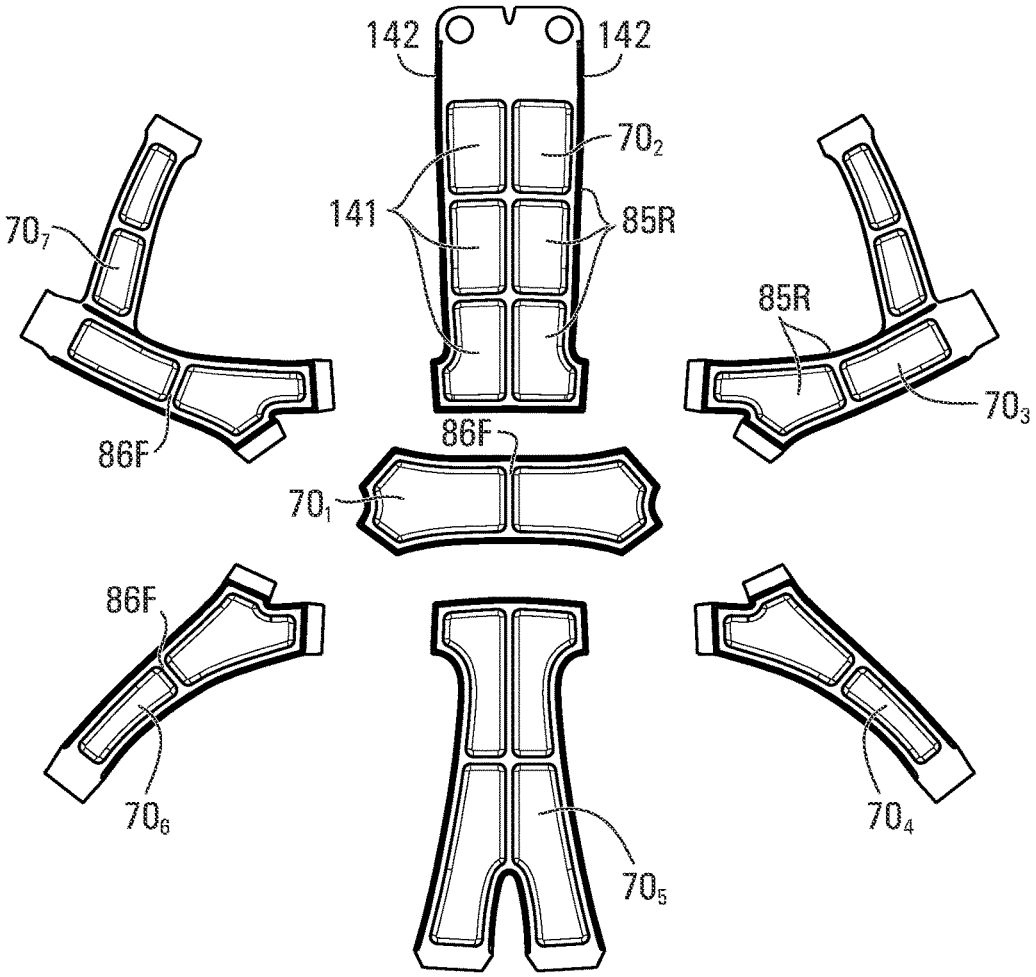
FIG. 16 is a bottom view of the floating liner of FIG. 14 showing the separate segments of the floating liner.
Figure 17:
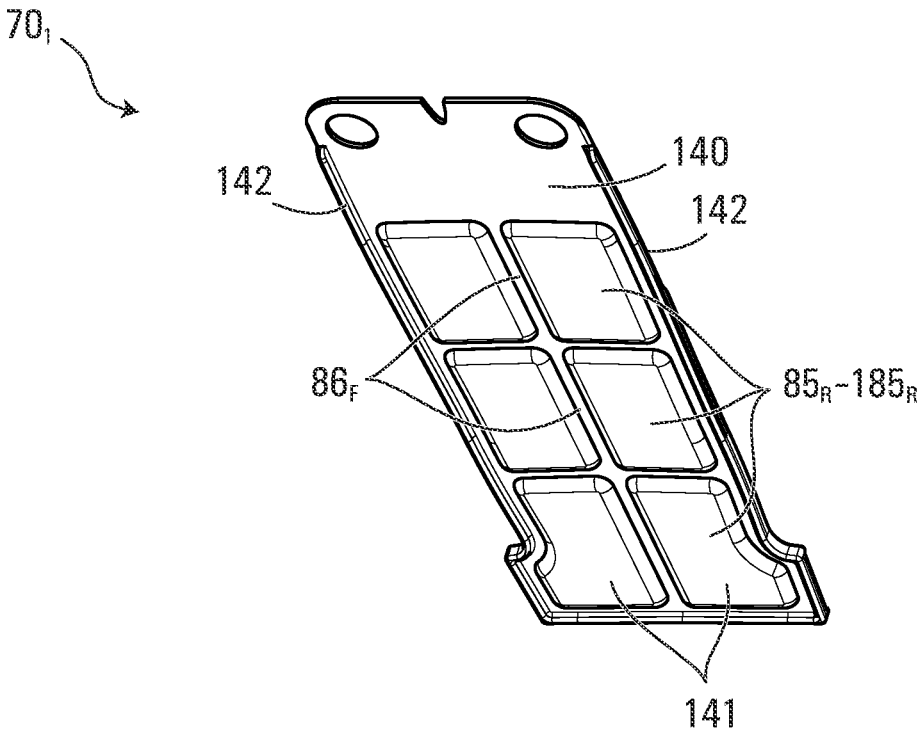
FIG. 17 is an enlarged bottom perspective view of the front segment or branch of the floating liner.
Figure 18:
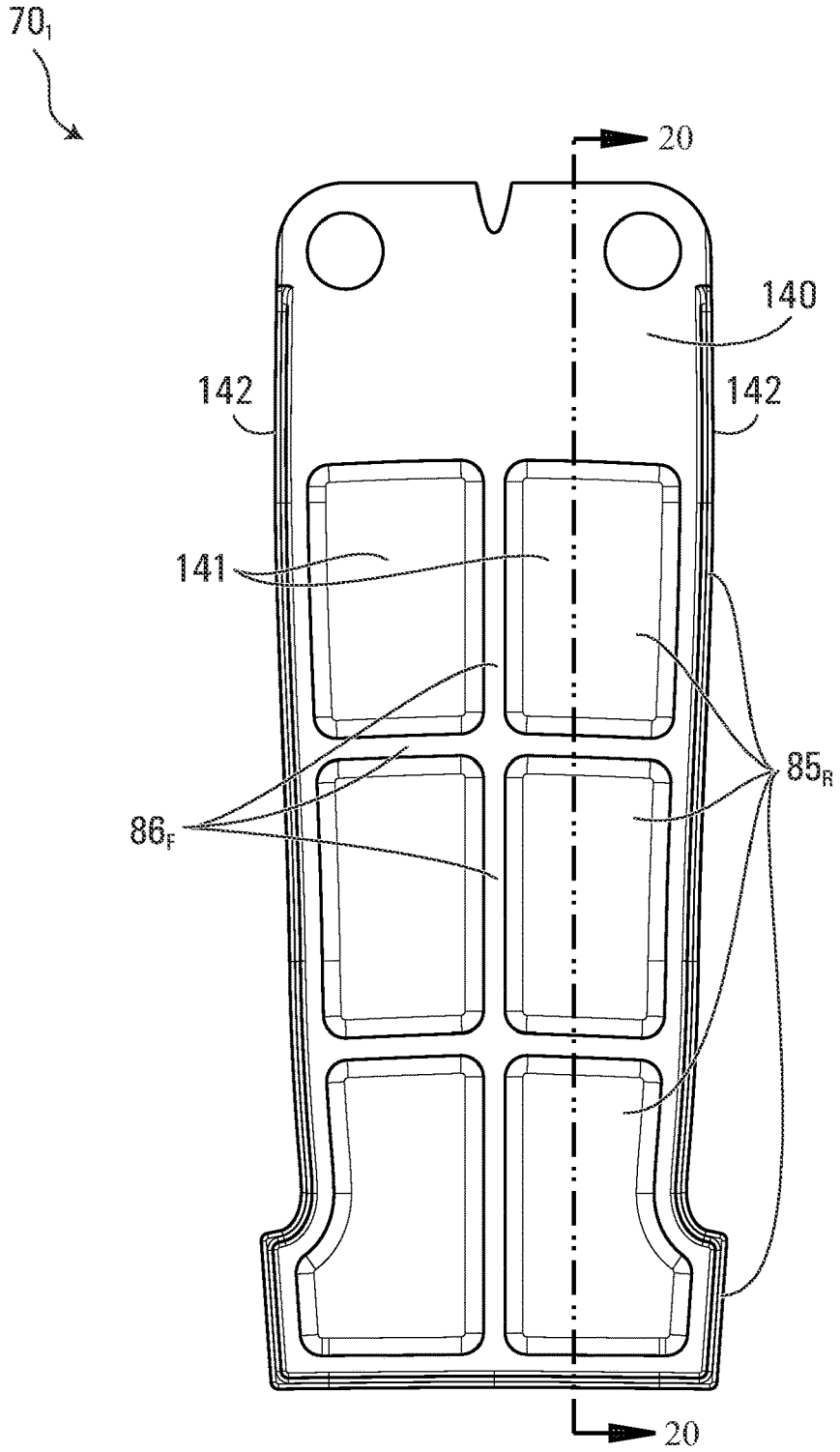
FIG. 18 is a bottom view of the front branch of FIG. 17.
Figure 19:
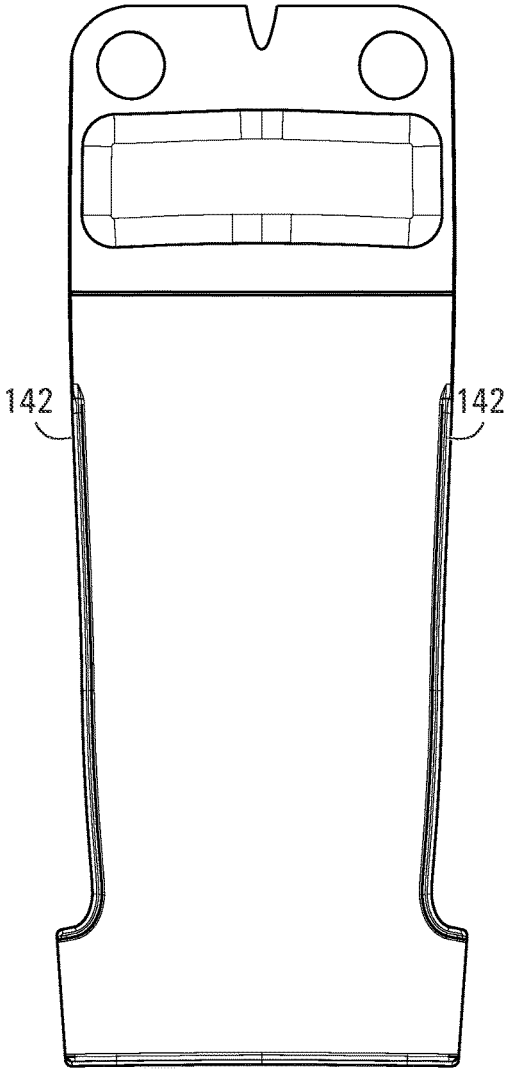
FIG. 19 is a top view of the front branch of FIG. 17.
Figure 20:
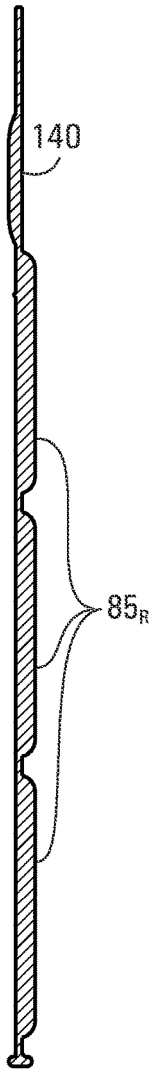
FIG. 20 is a cross-sectional view taken along line 20-20.

As shown in FIG. 16, the floating liner 50 may comprise a plurality of segments or branches $\mathbf{70}_1$-$\mathbf{70}_7$ fastened to one another to create its front portion 51, left and right side portion 52, 53, top portion 54, and back portion 55. More particularly, in this embodiment, the segments $\mathbf{70}_1$-$\mathbf{70}_7$ of the floating liner 50 are connected to one another by stitches. The floating liner 50 may be constructed in various other ways in other embodiments (e.g., it may comprise a different number and/or arrangement of segments, its segments may be fastened in other ways, or it may be a one-piece liner instead of having distinct segments).

The floating liner 50 may be fastened to a remainder of the sports helmet 10 in various ways. For example, as best shown in FIGS. 9 to 13, the floating liner 50 is fastened to the remainder of the sports helmet 10 at a plurality of fastening points $\mathbf{60}_1$-$\mathbf{60}_6$ spaced apart from one another around the sports helmet 10. More particularly, in this example, the fastening point $\mathbf{60}_1$ is a front fastening point adjacent to the front portion 23 of the front outer shell member 22, the fastening points $\mathbf{60}_2$, $\mathbf{60}_3$ are side fastening points respectively adjacent to the left and right side portions 25, 27 of the front outer shell member 22, the fastening points $\mathbf{60}_4$, $\mathbf{60}_5$ are side fastening points respectively adjacent to the left and right side portions 33, of the rear outer shell member 24, and the fastening point $\mathbf{60}_6$ is a rear fastening point adjacent to the back portion 31 of the rear outer shell member 24. In this case, the fastening points $\mathbf{60}_1$-$\mathbf{60}_6$ are distributed along a lower edge area of the sports helmet 10. Also, in this case, the fastening points $\mathbf{60}_2$, $\mathbf{60}_3$ and the fastening points $60_4$, $60_5$ are respectively located in front of and behind the ears of the wearer. The fastening points $60_1$, $60_2$, $60_3$, $60_4$, $60_5$ may be located at the respective distal ends of the segments or branches $70_1$, $70_2$, $70_3$, $70_5$, $70_6$ or adjacent these distal ends. The floating liner 50 may be connected to the remainder of the sports helmet 10 via any other number and/or relative arrangement of fastening points in other embodiments.

Figure 21:
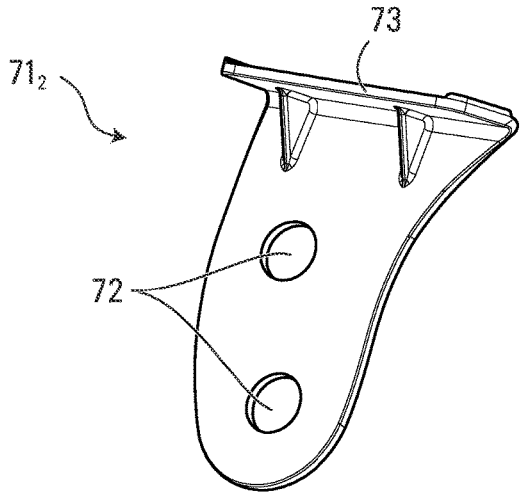
FIG. 21 is an enlarged side perspective view of a front fastening member.
Figure 22:
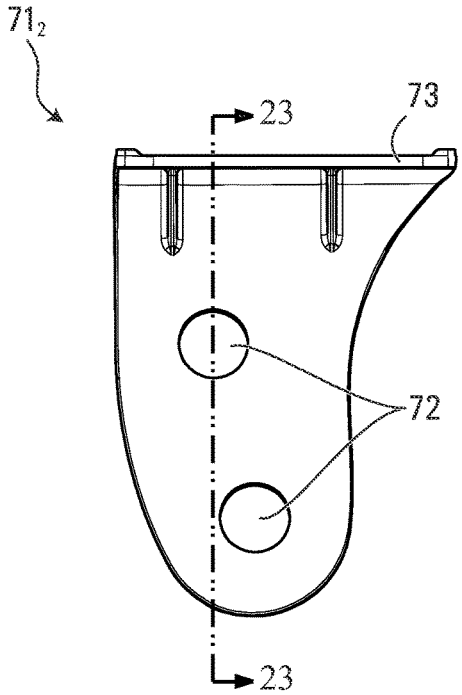
FIG. 22 is a side view of the front fastening member of FIG. 21.
Figure 23:
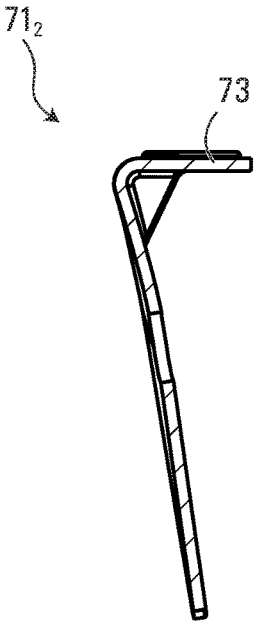
FIG. 23 is a cross-sectional view taken along line 23-23.
Figure 24:
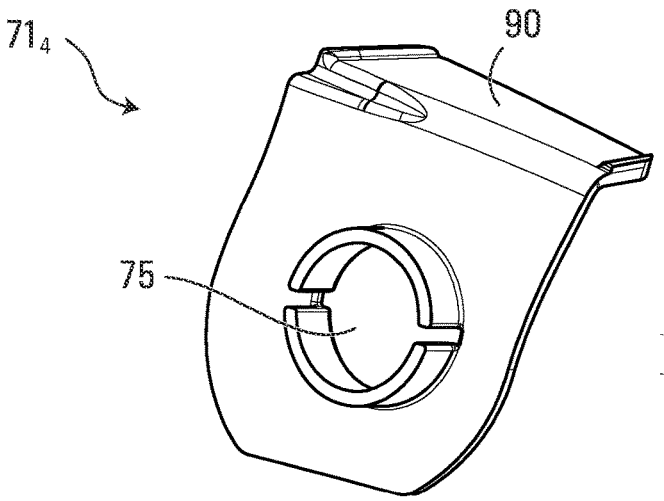
FIG. 24 is an enlarged side perspective view of a rear fastening member.
Figure 25:
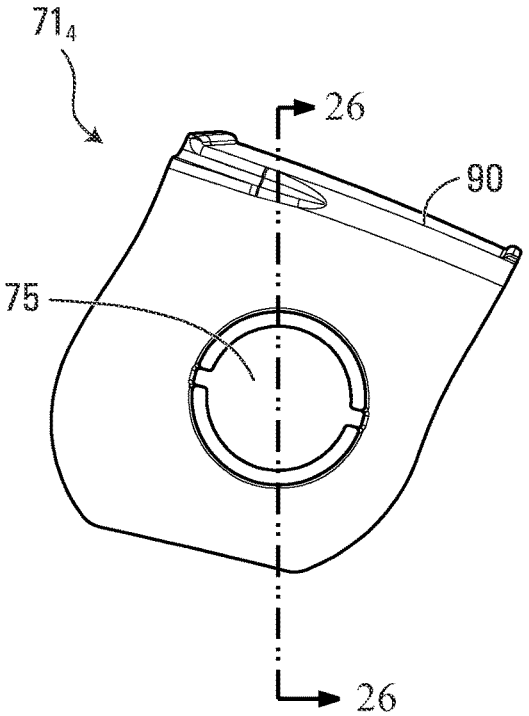
FIG. 25 is a side view of the rear fastening member of FIG. 24.
Figure 26:
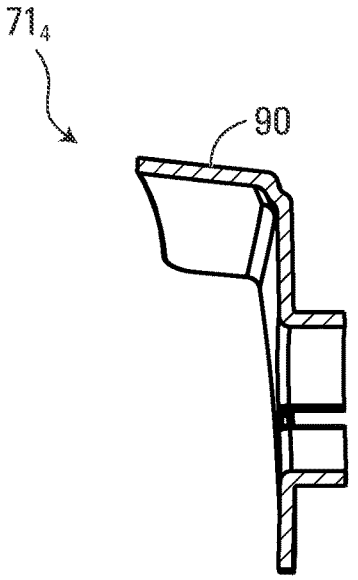
FIG. 26 is a cross-sectional view taken along line 26-26.
Figure 27:
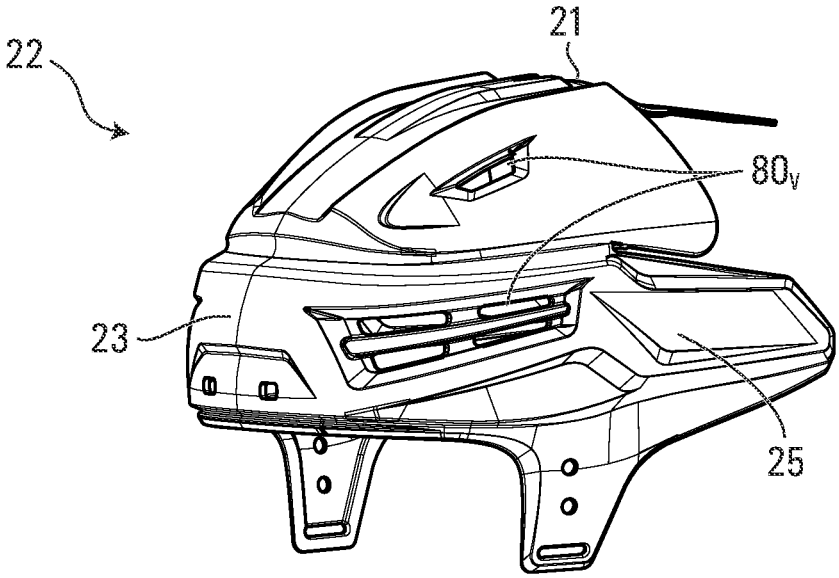
FIG. 27 is a front side perspective view of the first or front outer shell member of the outer shell.
Figure 28:
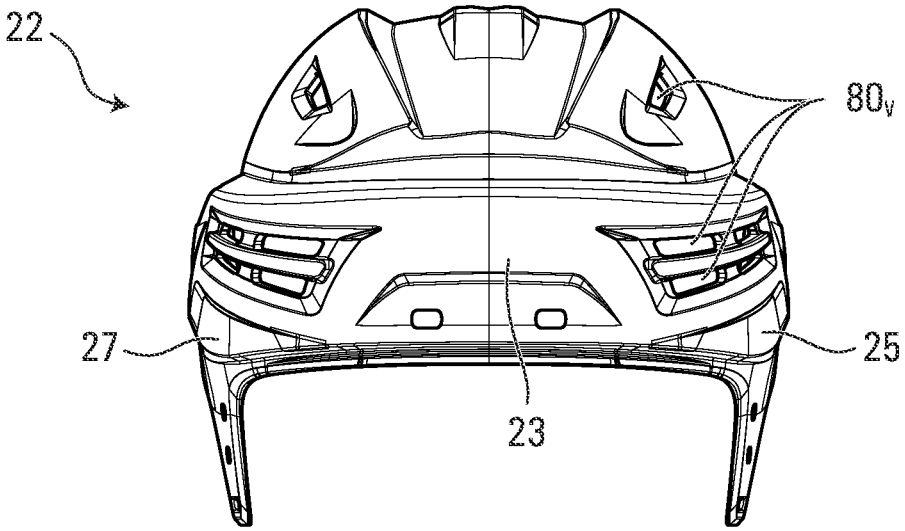
FIG. 28 is a front view of the front outer shell member of FIG. 27.
Figure 29:
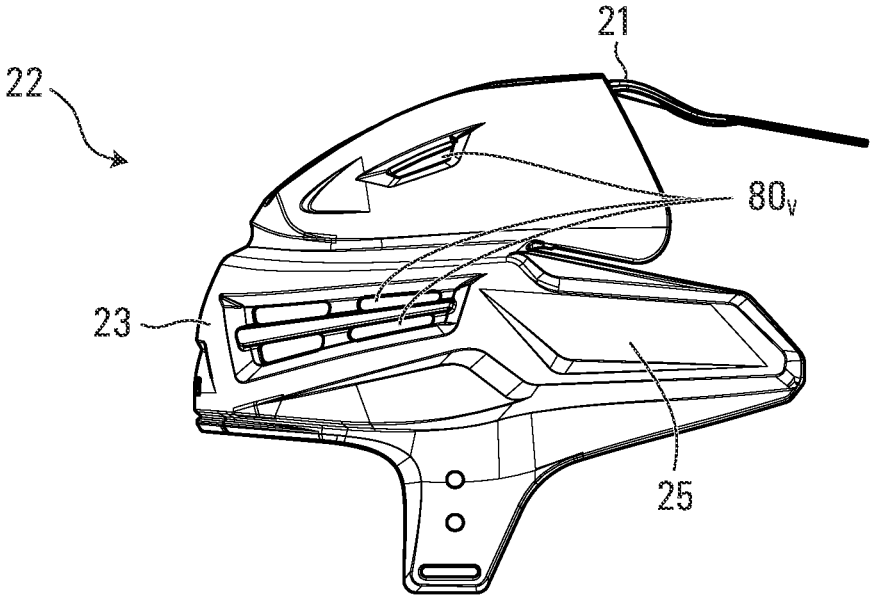
FIG. 29 is a side view of the front outer shell member of FIG. 27.

The fastening points $60_1$-$60_5$ of the floating liner 50 may comprise respectively fastening members $71_1$-$71_5$ which are fastened to the outer shell 12 and to which the floating liner 50 is attached. More particularly, the fastening members $71_1$-$71_5$ are fastened to the outer shell 12 via mechanical fasteners (e.g., screws 95) and to the floating liner 50 via stitches. For instance, as shown in FIGS. 21 to 23, the fastening member $71_2$, which could be a front fastening member, comprises two openings $72_1$-$72_2$ to receive a mechanical fastener (screws 95) to fasten it to the outer shell 12 and a stitchable portion 73 to receive stitches to fasten it to the floating liner 50. Similarly, as shown in FIGS. 24 to 26, the fastening member $71_4$, which could be a rear fastening member, comprises an opening 75 to receive a mechanical fastener (screw 95) to fasten it to the outer shell 12 and a stitchable portion 90 to receive stitches to fasten it to the floating liner 50. In this case, the stitchable portions 73 and 90 are formed as ledges projecting inwardly of the sports helmet 10. The fastening members $71_1$, $71_2$, $71_3$, $71_4$, $71_5$ may be located at the respective distal ends of the segments or branches $70_1$, $70_2$, $70_3$, $70_5$, $70_6$ or adjacent these distal ends.

The fastening members $71_1$-$75_5$ may be implemented in various other ways in other embodiments. For example, the fastening members $71_1$-$71_5$ may be affixed directly to the inner padding 15 such that the floating liner 50 is rather affixed to the inner padding 15 instead to the outer shell 12 or the fastening members $71_1$-$71_5$ may be affixed to the outer shell 12 while portions of the padding 15 are located between one or more of the fastening members $71_1$-$71_5$ and the outer shell 12 such that the floating liner 50 is affixed to the outer shell 12 through the inner padding 15.

The fastening members $71_1$-$75_5$ may be made of any suitable material. For example, in this embodiment, the fastening members $71_1$-$75_5$ are made of polymeric material (e.g., polypropylene, polyethylene, nylon, polycarbonate or polyacetal, or any other suitable plastic). In particular, in this example, the polymeric material of the fastening members $71_1$-$75_5$ is such that each of these fastening members is more rigid than the floating liner 50 to enable the floating liner 50 to stretch when the helmet 50 is rotationally impacted. The fastening members $71_1$-$75_5$ may be made of various other materials in other embodiments (e.g., metallic material).

As best shown in FIGS. 9 to 13 and 46 to 55, the sports helmet 10 may comprise an occipital adjustment device 75 having an occipital pad 36 facing the occipital region OR of the player's head and movable relative to the outer shell member 24 between different positions to adjust the fit of the sports helmet 10 on the wearer's head.

The occipital pad 36 may be made of any suitable padding material. For example, in some embodiments, the occipital pad 36 may comprise polymeric foam such as expanded polypropylene (EPP) foam, expanded polyethylene (EPE) foam, foam having two or more different densities (e.g., high-density polyethylene (HDPE) foam and low-density polyethylene foam), or any other suitable foam. Other materials may be used for the occipital pad 36 in other embodiments.

Figure 46:
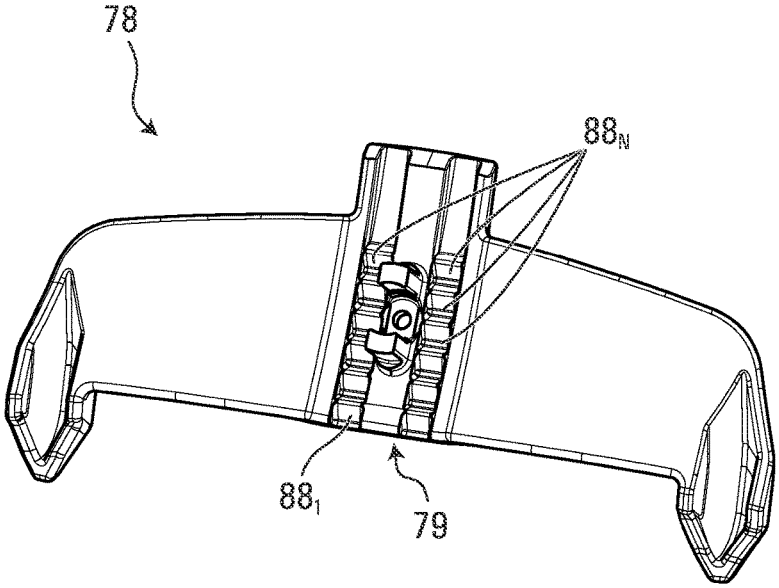
FIG. 46 is an enlarged front perspective view of a wedge of the occipital adjustment device.
Figure 48:
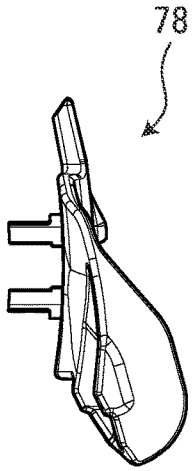
FIG. 48 is a side view of the wedge of FIG. 46.
Figure 47:
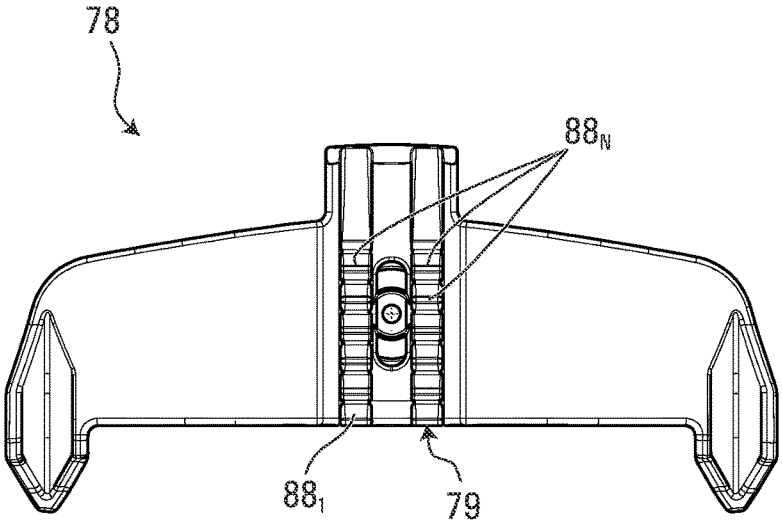
FIG. 47 is a front view of the wedge of FIG. 46.
Figure 49:
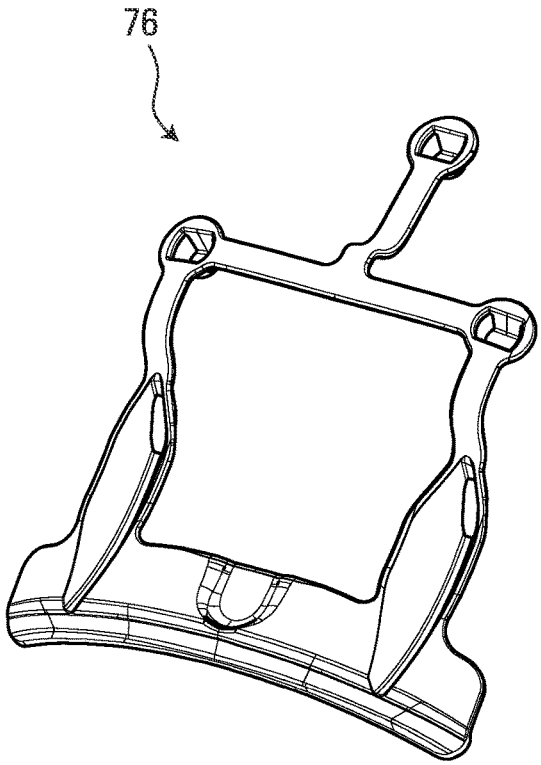
FIG. 49 is an enlarged rear perspective view of a support of the occipital adjustment device.
Figure 50:
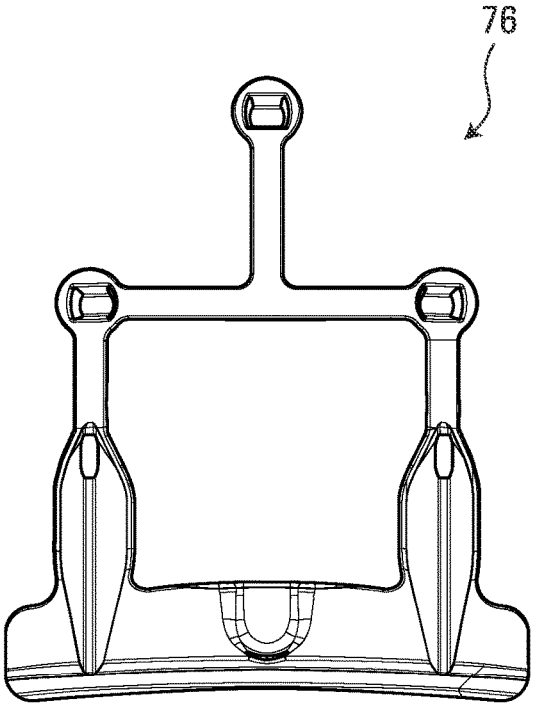
FIG. 50 is a front view of the support of FIG. 49.
Figure 51:
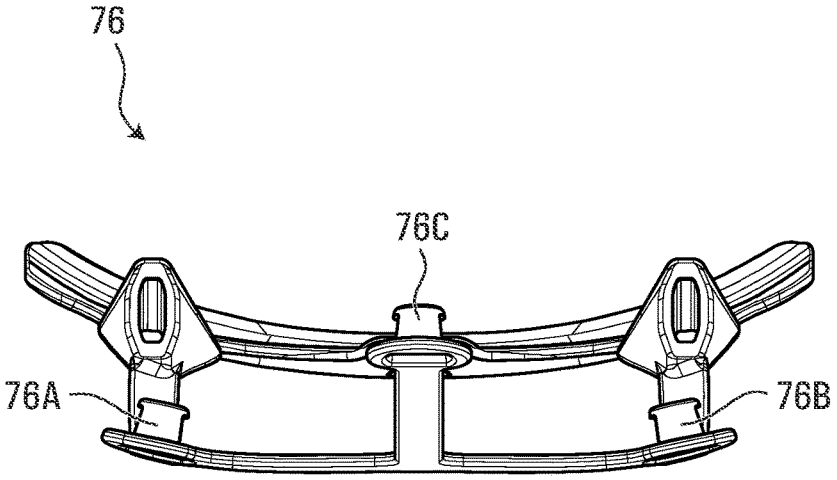
FIG. 51 is a top perspective view of the support of FIG. 49.
Figure 52:
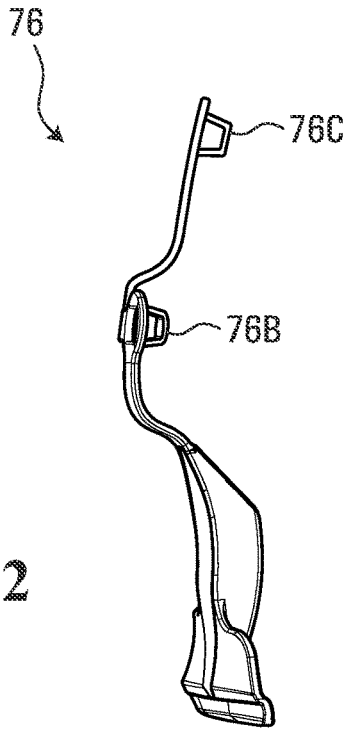
FIG. 52 is a side view of the support of FIG. 49.
Figure 53:
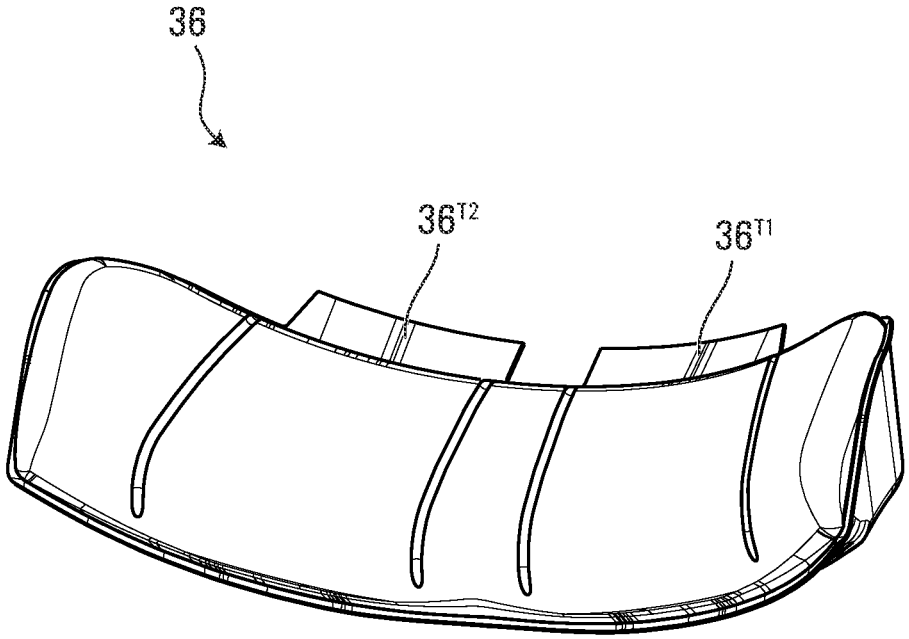
FIG. 53 is an enlarged front perspective view of an occipital pad of the occipital adjustment device.
Figure 54:
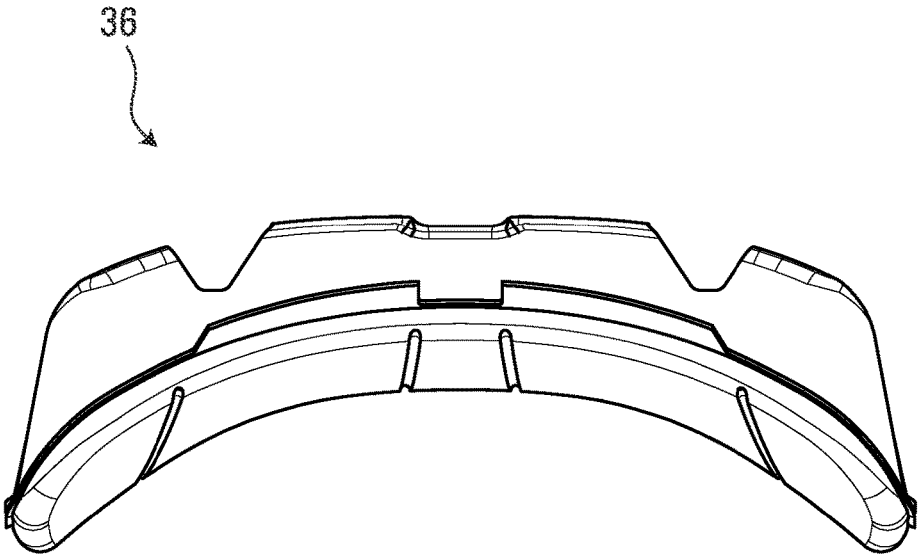
FIG. 54 is a top view of the occipital pad of FIG. 53.
Figure 55:
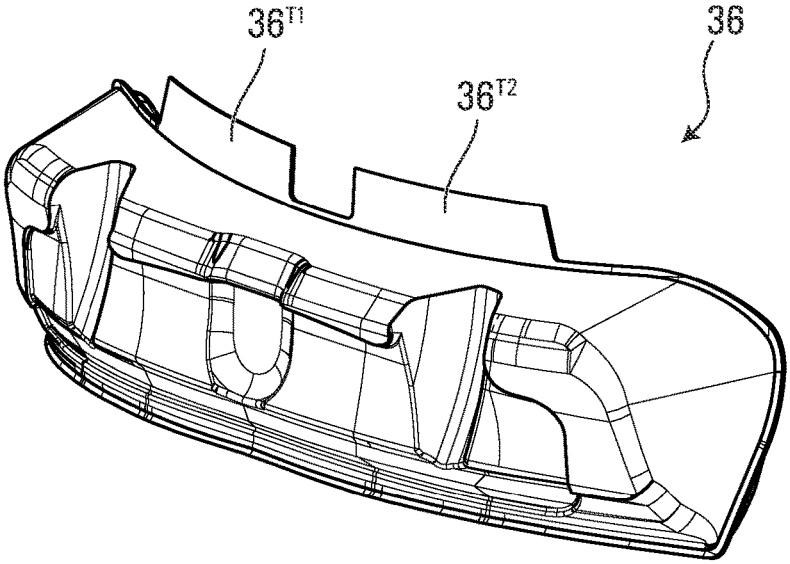
FIG. 55 is a rear perspective view of the occipital pad of FIG. 53.
Figure 56:
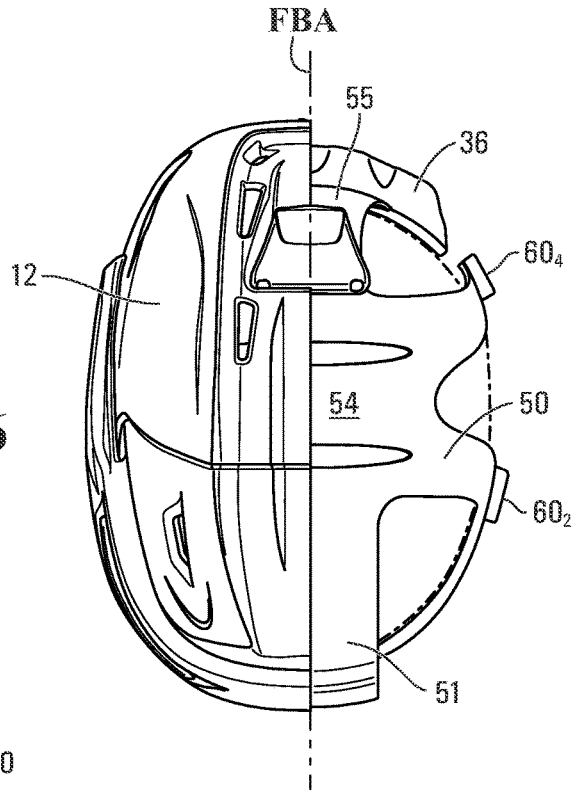
FIG. 56 is a top view showing the helmet on one side and the floating liner on the other side, the helmet and floating liner being on the wearer's head.

The occipital pad 36 is supported by a support 76 which is movable relative to the second shell member 24 in order to move the occipital pad 36. As best shown in FIG. 6, a wedge 78 is located between the second shell member 24 and the support 76. The wedge 28 is connected to an actuator 77 such that, when the player operates the actuator 77, the wedge 78 moves between different positions relative to the second shell member 24 and the support 76. As seen in FIGS. 46 to 48, the wedge 78 has a thickness that increases gradually from its top edge to its bottom edge such that downward vertical displacement of the wedge 78 between the second shell member 24 and the support 76 moves the occipital pad 36 from a first position towards a second position in which it applies a greater pressure upon the occipital region OR of the wearer's head. Movement of the occipital pad 36 allows it to be positioned in a first position in which it is closer to the back portion of the second shell member 24 and in a second position in which it is further inward of the sports helmet 10 and closer to the occipital region OR to apply more pressure on the occipital region OR than in its first position.

As best shown in FIGS. 49 to 52, the support 76 may have an upper portion with left and right connectors, projections or pins 76A, 76B that are received in apertures provided in the left and right rear inner pad members 15D, 15C (see apertures $15D_1$, $15C_1$, best shown in FIGS. 42 and 43) such that the support is mounted to the left and right rear inner pad members 15D, 15C. The upper portion of the support 76 may also comprise a member extending upwardly with a connector, projection or pin 76C that is received in an aperture $15E^1$ provided in the top inner pad member 15E (see FIG. 10) such that the top inner pad member 15E is only affixed at that point to the second shell member 24.

As best shown in FIGS. 46 and 47, the occipital adjustment device 75 may comprise a locking mechanism 79 for preventing unintentional movement of the wedge 78 and thus of the occipital pad 36. More particularly, the locking mechanism 79 comprises a plurality of protrusions $88_1$-$88_N$ on the inner surface of the wedge 78 adapted to register between a plurality of notches $81_1$-$81_F$ (best shown in FIG. 34) on the inner surface 17 of the rear outer shell member 24 to put the wedge 78 in a locked position. Any other suitable locking mechanism may be used in other embodiments.

As best shown in FIGS. 9 and 10, the actuator 77 comprises a button 82 and a post 83 extending through a slot 84 in the rear outer shell member 24, passing through an aperture provided in the wedge 78 and having a distal end with a diameter larger than that the wedge 78 for securing the actuator 77 to the wedge 78. In this example, the actuator 77 may comprise resilient material (e.g., nylon or polyacetal) characterized by an ability to return to its original shape when pressure is no longer applied on it. When the button 82 is pushed by the wearer towards the rear outer shell member 24, it is compressed and the post 83 and distal end are pushed away from the inner surface 27 of the rear outer shell member 24, thus disengaging the protrusions $88_1$-$88_N$ from the notches $81_1$-$81_F$ and allowing the wedge 78 to be moved upwardly or downwardly along the slot 84. The actuator 77 may be implemented in various other ways in other embodiments. For instance, in other embodiments, the actuator 77 may comprise a spring or any other biasing device for urging the wedge 78 in its locked position.

As best shown in FIG. 13, the fastening point $60_6$ of the floating liner 50 is located adjacent the occipital pad 36 and distal ends of the back portion 55 of the floating liner 50. The distal ends of the back portion 55 may have first and second stitchable tabs $55^{T1}$, $55^{T2}$ (see FIG. 14) and the occipital pad 36 may have corresponding first and second stitchable tabs $36^{T1}$, $36^{T2}$ (see FIGS. 53 and 55) such that the back portion 55 of the floating liner 50 is affixed to the occipital pad 36 at the fastening point $60_6$ via stitches passing through the first and second stitchable tabs $55^{T1}$, $55^{T2}$, $36^{T1}$, $36^{T2}$. Since the back portion 55 of the floating liner 50 is fastened to the occipital pad 36, movement of the occipital pad 36 during adjustment induces movement of the back portion 55 of the floating liner 50. In other words, in this case, the fastening point $60_6$ of the floating liner 50 is adjustably movable relative to the outer shell 12. This can allow the floating liner 50 to more closely conform to the wearer's head 11.

A more detailed description of the floating liner 50 and its method of operation in this embodiment are provided below.

FIGS. 14 to 16 illustrate in greater detail the structure of the floating liner 50. The floating liner 50 is that component of the sports helmet 10 which constitutes the interface between the wearer's head 11 and the helmet's inner padding 15. The floating liner 50 is designed to be movable with relation to the inner padding 15. The floating liner 50, when installed in the sports helmet 10, acquires its dome shape that generally conforms to the shape of the wearer's head 11.

The floating liner 50 is a spider-like structure that includes the top portion 54 and a series of branches which extend downwardly and connect the spider-like structure to the lower portion of the sports helmet 10 near the respective distal ends of the branches. More particularly, the floating liner 50 has an elongated band-like front segment or branch $70_1$, an opposed elongated rear band-like segment or branch $70_4$, lateral front band-like segments or branches $70_2$, $70_6$, lateral rear band-like segments or branches $70_3$, $70_5$, all extending downwardly from the top portion 54. The lateral front band-like segments or branches $70_2$, $70_6$ are provided with side extensions 110 that extend toward and connect with the front band-like segment $70_1$. The extensions 110 run generally along the lower periphery of the helmet when the floating liner 50 is installed in the sports helmet 10.

The various components of the floating liner 50 are attached to one another by stitching. In this example of implementation, stitches $120_1$-$120_S$ connect the various components of the floating liner 50 into its dome shape. Other forms of attachment may be used in other embodiments. For example, the various components can be glued to one another or the floating liner 50 can be formed as a single piece, such as by die-cutting it from a blank of material.

Upon assembly, the floating liner 50 thus has the front and rear segments or branches $70_1$, $70_4$ that are elongated and extend along the longitudinal axis FBA of the sports helmet 10. The front and rear segments or branches $70_1$, $70_4$ connect with the top portion 54 such as to define openings, slots or slits $122_1$, $122_2$ with the front and rear segments $70_1$, $70_4$. The openings, slots or slits $122_1$, $122_2$ make the floating liner 50 somewhat stretchable in the longitudinal direction (further to the inherent stretchability of the material from which the floating liner 50 is made) such as to accommodate changes in the internal volume defined by the sports helmet 10. To provide a better fit, the sports helmet 10 can be designed to be adjustable, as described in greater detail earlier. The adjustability is such that the internal volume of the sports helmet 10 changes to make it larger or smaller according to the particular size of the wearer's head 11. The openings, slots or slits $122_1$, $122_2$ can allow the floating liner 50 to expand or contract within the helmet's cavity 13 when an adjustment is made and thus prevent the floating liner 50 from bunching.

The lateral front and rear segments or branches $70_2$, $70_3$, $70_5$, $70_6$ extend along the transversal axis LRA of the sports helmet 10. Between the lateral front and rear segments or branches $70_2$, $70_3$ and $70_5$, $70_6$, left and right spaces 124, 126 are defined and these left and right spaces 124, 126 register with the respective left and right ears of the wearer. The spaces 124, 126 provide clearance to receive various components of the sports helmet 10 that protect the ears.

FIGS. 21 to 26 illustrate some of the fastening members, namely the fastening members $71_2$, $71_4$, for attaching the lateral front and rear segments or branches $70_2$, $70_3$, $70_5$, $70_6$ of the floating liner 50 to the remainder of the sports helmet 10. The fastening member $71_2$ shown in FIGS. 21 to 23 is a front fastening member that attaches the lateral front segments or branches $70_2$, $70_3$, $70_5$, $70_6$ to the sports helmet 10. The fastening members $71_2$, $71_3$ are each is in the form of a clip that is made of plastic material and to which the distal ends of the lateral front segments or branches $70_2$, $70_6$ are stitched. The fastening members $71_2$, $71_2$ are subsequently attached with screws 95 to the outer shell 12 of the sports helmet 10. The screws 95 are inserted through apertures 96 of the outer shell 12. FIGS. 24 to 26 illustrate the fastening member $71_4$ that is a rear fastening member attaching the extremity of the lateral rear segment or branch $70_5$ to the remainder of the sports helmet 10. The fastening member $71_4$ is similar to the fastening member $71_2$, except that a single screw 95 is used to mount the fastening member $71_4$ to the outer shell 12. The fastening members $71_4$, $71_5$ are each attached at their distal ends to the lateral rear segments or branches $70_2$, $70_3$, via stitches and the fastening members $71_4$, $71_5$ are subsequently attached with screws 95 passing through apertures 96 of the outer shell 12.

This arrangement is such that the floating liner 50 is retained to the outer shell 12 at a plurality of spaced apart locations that are adjacent the lower edge of the outer shell 12. It is understood that the floating liner 50 may be retained directly to the inner padding 15 via the fastening members $71_1$-$75_5$ or be retained to the outer shell 12 while portions of the inner padding 15 are located between the fastening members $71_1$-$75_5$ and outer shell 12. The floating liner 50 is retained at the front and at two locations on each side, one being in front the ear and near the temple region and the other behind the ear. At the back, the floating liner 50 connects with the occipital pad 36, which moves with relation to the outer shell 12, as described earlier.

The various components of the floating liner 50 may be made from material that has a constant thickness or the thickness may vary. In the example shown in the drawings, a variable thickness material is being used to provide, in addition to the rotational impact protection, protection against radial impacts.

Figure 40:
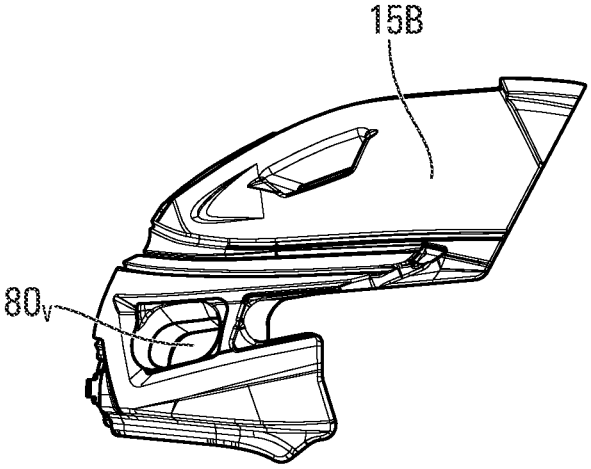
FIG. 40 is a side view of the left front inner pad member of FIG. 38.
Figure 41:
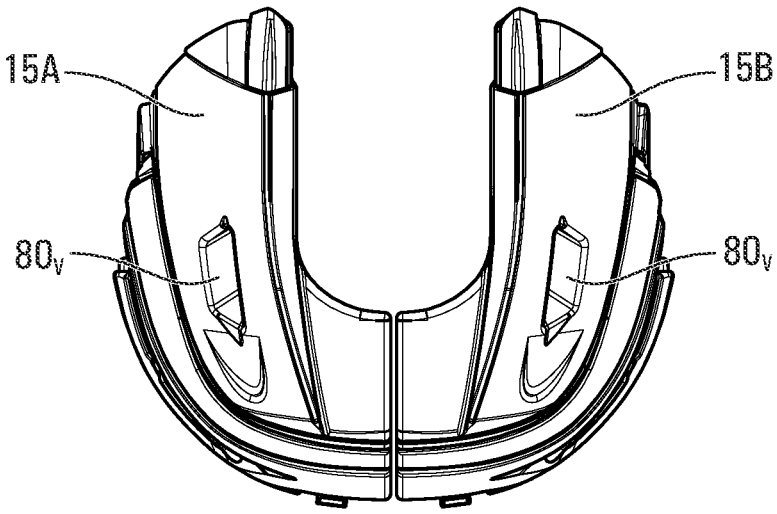
FIG. 41 is a top view of the left and right front inner pad members of FIG. 38.
Figure 42:
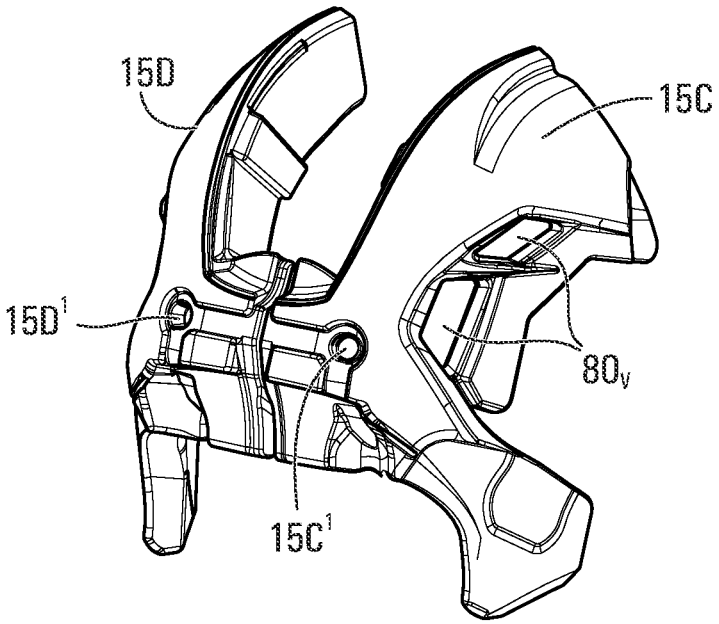
FIG. 42 is a rear perspective view of the left and right rear inner pad members of the inner padding.
Figure 43:
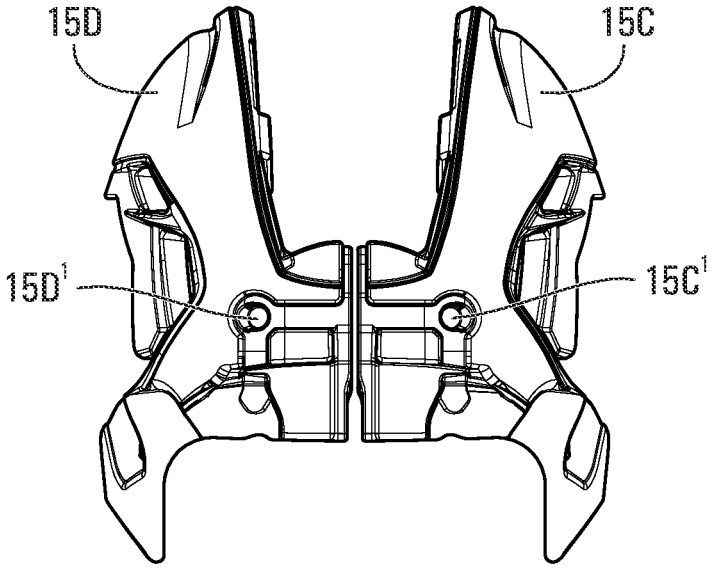
FIG. 43 is a rear view of the left and right rear inner pad members of FIG. 42.
Figure 44:
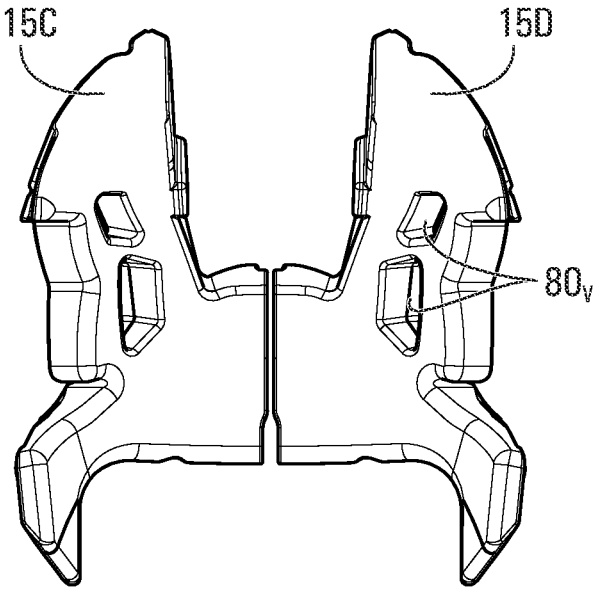
FIG. 44 is a front view of the left and right rear inner pad members of FIG. 42.
Figure 45:
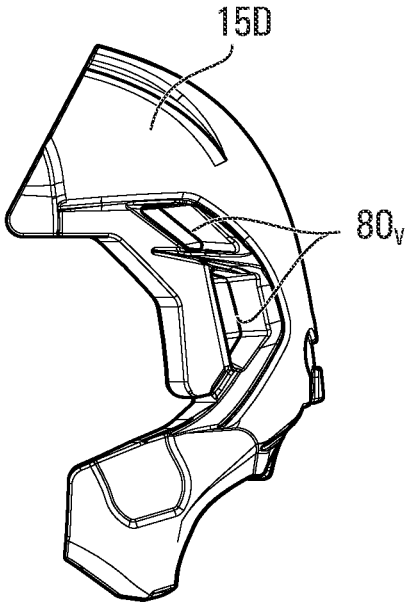
FIG. 45 is a side view of the left rear inner pad member of FIG. 42.

FIGS. 17 to 20 illustrate in greater detail the structure of the front segment or branch $70_1$ of the floating liner 50. The front segment or branch $70_1$ of the floating liner 50 is a continuous sheet of material that has a base portion 140 from which project a series of padding areas $185_1$-$185_R$. A ridge 142 is provided at least along a portion of the periphery of the front segment or branch $70_1$ of the floating liner 50. In a specific example of implementation, the thickness of the base portion 140 is of about 1 mm. The thickness of a padding area $185_i$ is of about 3 mm while the thickness of the ridge 142 is of about 3.5 mm. In some embodiments, the thickness of the floating liner 50 may not exceed 10 mm and preferably may be not exceed 5 mm. The floating liner 50 may have any other suitable thickness in other embodiments To avoid the floating liner 50 from projecting too far inwardly in the sports helmet 10 with relation to the inner surface of the inner padding 15 on which the floating liner 50 rests, the inner padding 15 can be provided with one or more recesses in which one or more parts of the floating liner 50 can fit. With reference to FIG. 40, which shows the structure of the left and right front pad members 15A, 15B of the inner padding 15, the inner padding 15 defines a recessed area 15F that registers with the front segment $\mathbf{70}_1$ of the floating liner 50. The depth of the recessed area 15F is selected generally to match or to be slightly less than the maximal thickness of the front segment $\mathbf{70}_1$ of the floating liner 50. In this fashion, when the floating liner 50 is mounted to the sports helmet 10, the front segment $\mathbf{70}_1$ of the floating liner 50 sits in the recessed area 150 and its face that is oriented toward the wearer is generally flush or only slightly projects from the inner surface of the inner padding 15.

The floating liner 50 is a component of the sports helmet 10 that contributes to protect the head 11 of the wearer during an impact that has a rotational force component and which imparts an angular movement to the head 11. As briefly discussed earlier, several energy absorption mechanisms operate in conjunction with one another to take up at least a component of the energy in the impact and thus limit the residual energy that is transmitted to the wearer's head 11.

Without intent of being bound by any particular theory, the inventors have identified four primary energy absorption mechanisms. The first is the ability of the floating liner 50 to stretch during a relative movement between the floating liner 50 and the remainder of the helmet's structure which is rigid and moves in unison during the impact. Typically, the main components of the helmet structure that move in relation to the floating liner 50 are the outer shell 12 and the inner padding 15. Conceptually speaking, the sports helmet 10 thus provides two elements that can move one with relation to the other during a rotational impact. One of the elements is the outer shell/inner padding combination. The other element is the floating liner 50 which constitutes the interface between the outer shell/inner padding combination and the wearer's head 11. The floating liner 50 is designed to closely fit on the head 11 and at the same time is attached to the outer shell 12 of the sports helmet 10 via rigid mounting points that include the fastening members $\mathbf{71}_1$ to $\mathbf{71}_5$ and the occipital pad 36. Thus, in the course of an impact that tends to impart an angular movement to the sports helmet 10, the outer shell/inner pad combination will tend to move with relation to the floating liner 50 that is in contact with the head 11. The rigid mounting points will thus distort the floating liner 50 and stretch various parts of the floating liner 50. As the material of the floating liner 50 is being stretched, it absorbs energy.

The ability of the floating liner 50 to absorb energy can be enhanced by proper selection of the material from which the floating liner 50 is made and also by the structure of the floating liner 50. From a structural point of view, the floating liner 50 is constructed as a series of elongated segments or branches (the front segment or branch $\mathbf{70}_1$, rear segment or branch $\mathbf{70}_4$, and lateral front and rear segments or branches $\mathbf{70}_2$, $\mathbf{70}_3$, $\mathbf{70}_5$, $\mathbf{70}_6$) that extend downwardly from the top portion 54 of the floating liner 50 and thus run from the top of the head 11 downwardly (when taking the head 11 of the wearer as a reference). When an angular movement occurs, the extremities of those segments or branches, which are affixed to the outer shell/inner pad combination, are pulled as the outer shell/inner pad combination angularly moves, stretching the material from which the segments are made.

From a material point of view, the material of the floating liner 50 may be such that, when stretched, at least some degree of energy is absorbed in the material. In a specific example of implementation the material can be characterized by using the ASTM D2632-01 Standard Test method for rubber property-Resilience by Vertical rebound. The material of the floating liner 50 that manifests energy absorption may have, according to this test a resilience of less than 30%, preferably less than 20%, even more preferably less than 15% and most advantageously less than 10%. A specific material that has been found to provide energy absorption in a helmet for use in hockey is sold under the trademark PORON XRD.

The second energy absorption mechanism that works in conjunction with the stretchability of the floating liner 50 is the frictional interface between the floating liner 50 and the inner padding 15. As the floating liner 50 moves with relation to the outer shell/inner padding combination, the presence of friction at the interface dissipates energy during the movement, by generating heat. From a material perspective, the degree of friction that exists between the floating liner 50 and the inner padding 15 is controlled such that enough friction exists in order to enhance energy dissipation and at the same time the friction does not exceed a level at which the movement will be inhibited.

In a specific and non-limiting example of implementation, the degree of friction between the floating liner 50 and the mating surface of the inner pad is characterized by the ASTM G115-10 Standard Guide for Measuring and Reporting Friction Coefficients. The friction coefficient between the floating liner 50 and the inner padding 15 is of at least 0.2, preferably of at least 0.3, more preferably of at least 0.4, even more preferably of at least 0.5 and most advantageously in the range of about 0.5 to about 0.6.

Note that very high coefficients of friction may not be optimal since the amount of effort required to initiate the movement between the floating liner 50 and the inner padding 15 can become too high. In this case, the sports helmet 10 may not respond to low level rotational impacts where the angular acceleration imparted to the outer shell 12 and inner padding 15 is not sufficient to overcome the friction between the floating liner 50 and the inner padding 15. It is thus preferred to keep the coefficient of friction between the floating liner 50 and the inner padding 15 to a level that does not exceed 0.75 and more preferably is at 0.7 or below.

The third energy absorption mechanism is compression of the material of the floating liner 50. This third mechanism may manifest itself when a radial impact force component has the effect of pushing the sports helmet 10 toward the head, in addition to imparting to the sports helmet 10 angular motion. The compression of the material will absorb some quantity of energy that depends on the degree of compression. From that perspective, a thicker floating liner 50 will be able to absorb more energy as a result of compression, than a thinner floating liner 50. Also, while certain areas of the material of the floating liner 50 may stretch, other areas of the floating liner's material may compress tangentially and this may also contribute to energy absorption.

The fourth energy absorption mechanism is the inertia of the outer shell 12/inner padding 15 combination. Since this structure moves with relation to the head 11 of the wearer as a result of a rotational impact, the angular motion imparted to the structure requires some amount of energy. The fourth energy absorption mechanism is independent of the floating liner 50. It should also be noted that the fourth energy absorption mechanism can be maximized by decreasing the degree of friction between the floating liner 50 and the inner padding 15. Such a decrease of friction will increase the range of movement of the outer shell 12/inner padding 15 combination such that the energy intake by the angularly accelerated mass will increase. However, a decrease of the degree of friction between the floating liner 50 and the inner padding 15 will also have the undesirable effect of decreasing the efficacy of the second energy absorption mechanism that relies on friction. The higher the friction, the more energy absorption will occur. On balance, the energy absorption mechanism that works on the basis of friction is preferred over the one that works on the basis of inertia since it is believed to be more effective. Accordingly, an interaction between the floating liner 50 and the inner padding 15 that largely favors slidability at the expense of friction is not desirable.

The various energy absorption mechanisms described above contribute differently to the overall ability of the sports helmet 10 to protect against rotational impacts. Generally, it is believed that, in the helmet structure described herein, the cumulative effect of the first three energy absorption mechanisms (i.e., the stretchability of the floating liner 50, the frictional engagement between the floating liner 50 and the inner padding 15, and the compression of the material of the floating liner 50) outweigh significantly the effect of the fourth energy absorption mechanism (i.e., the inertia of the outer shell 12/inner padding 15 combination).

Figure 61:
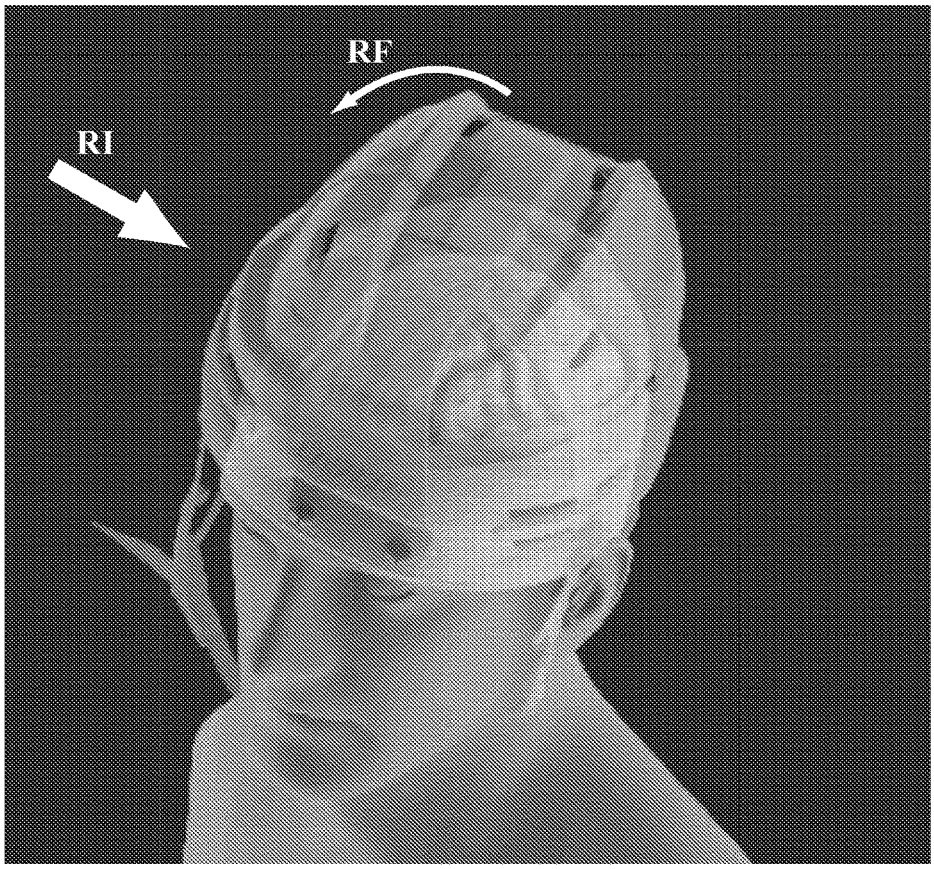
FIG. 61 is a first view of an example of a reaction of the sports helmet FIG. 61 upon a rotational impact on the outer shell.
Figure 62:
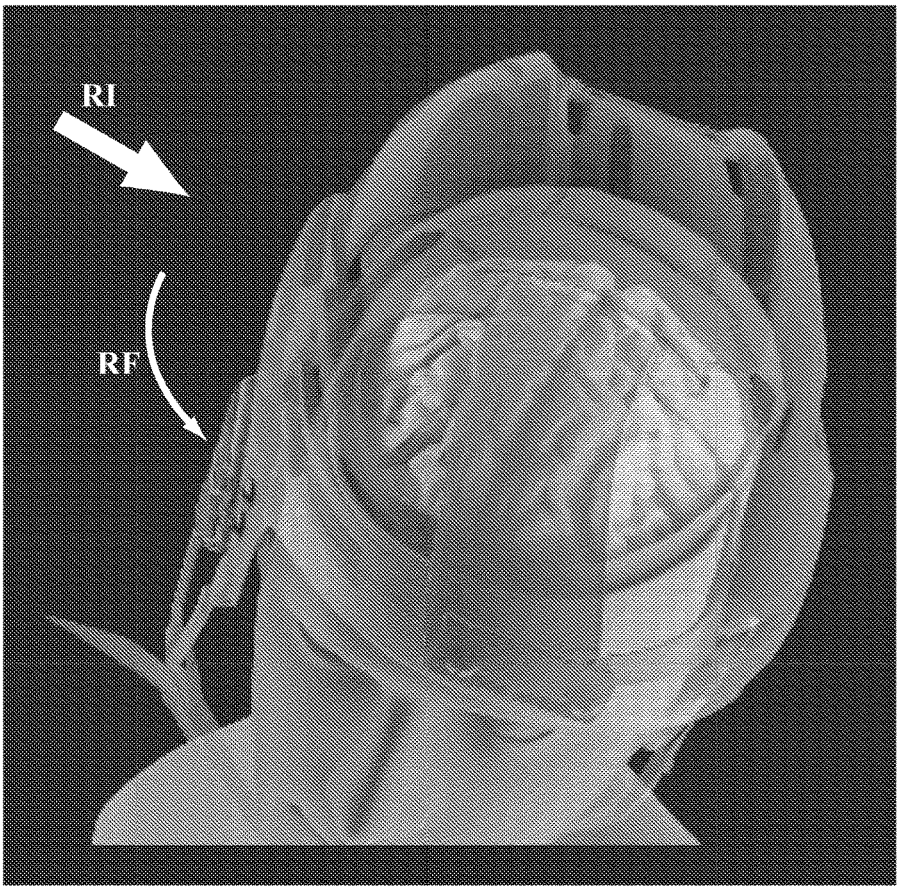
FIG. 62 is a second view of the example of a reaction of the sports helmet FIG. 61 upon a rotational impact on the outer shell.
Figure 63:
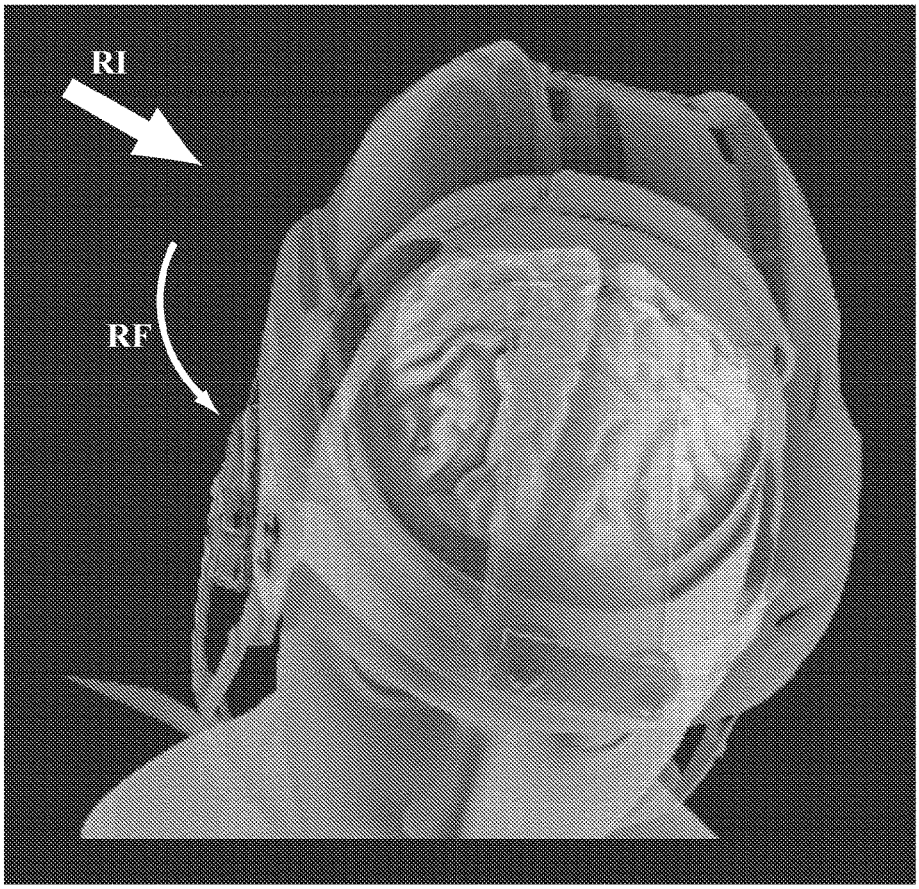
FIG. 63 is a third view of the example of a reaction of the sports helmet FIG. 61 upon a rotational impact on the outer shell.

FIGS. 61 to 64 illustrate the sequence of events that occur when the sports helmet 10 is subjected to a rotational impact RI. In FIG. 61, the impact RI is shown by the arrow. FIGS. 62 to 64 show that as a result of the impact RI, the sports helmet 10 has angularly moved by a certain amount. For instance, in some cases, this movement can be of about 2 degrees for a relatively small impact to about 10 degrees for a larger one. The part of the sports helmet 10 that has moved angularly includes the outer shell 12 and the inner padding 15 that is rigidly attached to the outer shell 12. However, during that movement, the floating liner 50 is distorted. FIGS. 62 and 63 clearly show that the front segment $\mathbf{70}_1$ has been laterally stretched, the stretching of that component causing a certain degree of energy absorption.

The sports helmet may comprise an adjustment mechanism such as a movable inner pad member or an inflatable inner member for adjusting the internal volume of the cavity 13 to adjust the fit of the sports helmet 10 on the wearer's head and the floating liner 50 is movable relative to the outer shell 12 in response to a rotational impact on the outer shell 12 to absorb rotational energy from the rotational impact and the floating liner 50 is configured to accommodate adjustments of the internal volume of the cavity 13 using the adjustment mechanism.

The sports helmet may comprise a rotational impact protection device disposed between the external surface 18 of the sports helmet 10 and the wearer's head when the sport helmet 10 is worn, the rotational impact protection device comprising a surface 59 movable relative to the external surface 18 of the sports helmet 10 in response to a rotational impact on the outer shell 12 to absorb rotational energy from the rotational impact, the surface 59 of the rotational impact protection device undergoing displacement when the adjustment mechanism is operated by the wearer to vary the internal volume of said cavity.

In one variant, the rotational impact protection device is the floating liner 50 that is movable relative to the outer shell 12 in response to a rotational impact on the outer shell 12 to absorb rotational energy from the rotational impact and that is configured to accommodate adjustments of the internal volume of the cavity 13 when the first shell member 22 and the second shell member 24 are moved relative to one another. The floating liner 50 may comprise stretchable material such that at least part of the rotational energy is absorbed by stretching of the stretchable material. The outer surface 59 of the floating liner 50 may be in frictional engagement with the inner padding 15 in response to the rotational impact such that at least part of the rotational energy is dissipated by friction between the inner padding 15 and the outer surface 59 of the floating liner 50, the outer surface 59 of the floating liner 50 having a coefficient of friction with the inner padding 15 of at least 0.2 measured according to ASTM G115-10.

Several variants of the floating liner 50 are possible in other embodiments. For example, in some embodiments, in order to better manage the energy absorption of the floating liner 50, a hybrid structure can be considered where different components have different functions. For example, it is possible to construct the floating liner 50 from two different materials, one being more energy absorbing that the other when the floating liner 50 is stretched. This could provide a more economical product where the parts of the floating liner 50 that do not stretch during a rotational impact use less expensive material, such as non-stretchable fabric, while the remainder is made up of stretchable and energy absorbing material. In one particular example, the top portion 65 could be made of non-stretchable material.

Instead of using non-stretchable material, other types of materials can be used to provide desirable attributes to the floating liner 50, such as comfort materials that have a high resiliency (those materials are stretchable but do not absorb much energy) and porous materials to absorb perspiration, among others.

In another possible variant, the friction between the floating liner 50 and the inner padding 15 can be selectively controlled by providing between these components a material that has a particular coefficient of friction. That material can be applied as a series of patches to the floating liner 50 or to the inner pad 15 such as to achieve the desired degree of friction.

In another embodiment, the inner surface of the floating liner 50 which faces the inner padding 15 may be provided with a series of projections that fit in corresponding recesses made on the inner padding 15. In this case, the projections are generally semi-spherical and are integrally formed with the remainder of the floating liner 50. The purpose of the projections is to create an interface with the inner padding 15 in which the resistance to movement is increased in order to increase the energy uptake. The mating relationship between the projections and the corresponding mating recesses in the inner padding 15 would require more energy to move the floating liner 50 with relation to the inner padding 15. More energy is required since the projections must be deformed sufficiently to move out of the corresponding recesses. The number, shape and size of the projections can vary to a great extent in various embodiments. A larger number of projections will increase the holding force and thus require a stronger effort to initiate the movement between the floating liner 50 and the inner padding 15. Larger projections will have the same effect since more material compression will be required for the projections to clear their respective recesses.

In order to allow for adjustability of the sports helmet 10, the recesses on the inner padding 15 can be made sufficiently large such that they register with respective projections in a number of different positions of the inner pad segments. In such cases, elongated recesses can be used. Each elongated recess is oriented such that it extends along the direction in which the inner pad segment moves when the helmet size is adjusted. The width of the recess generally matches the diameter of the projection. As the inner pad position changes when adjustments to the helmet size are made, the longitudinal position of the projection in the recess changes.

The reverse arrangement can also be considered, where projections are provided on the inner padding 15 and fit in corresponding recesses on the floating liner 50.

The attachment of the floating liner 50 to the sports helmet 10 is such as to enable the relative motion to occur during a rotational impact. This relative motion is made possible by the ability of the floating liner 50 to move over the inner padding 15 and also by the ability of the floating liner 50 to stretch. As discussed above, the floating liner 50 is connected to the outer shell 12 or the inner padding 15 near the lower edge of the sports helmet 10, leaving the upper part of floating liner 50 freely resting on the inner padding 15. Such a construction thus provides an interface between the floating liner 50 and the inner padding 15 that is fastener-free over a surface area of a desired extent over which the free-floating interaction is desirable.

Figure 58:
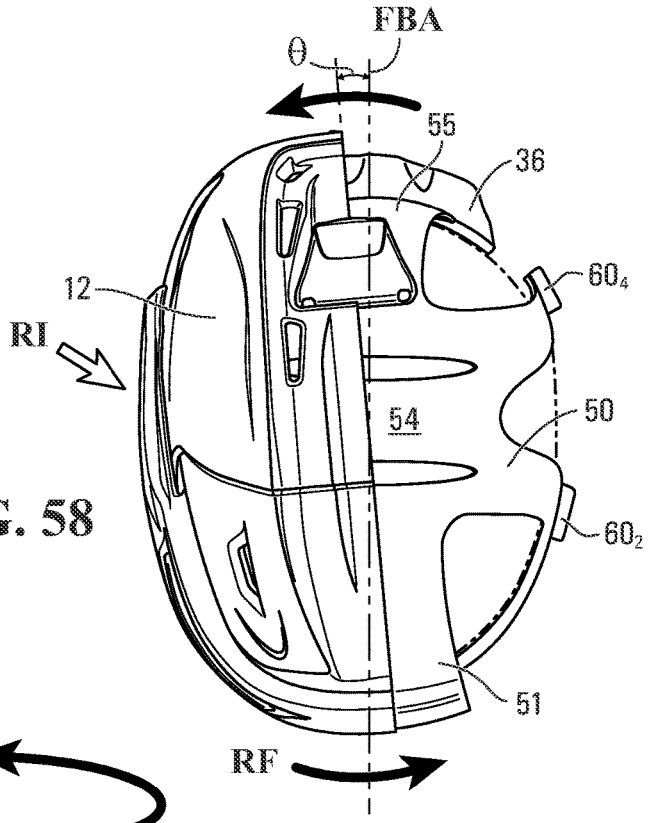
FIG. 58 shows an example of a reaction of the sports helmet FIG. 57 upon a rotational impact on the outer shell.

By "fastener-free" interface is meant an interface that does not contain any mechanical or adhesive fastener that could severely impede the ability of the two opposing surfaces that define the interface to move one with relation to the other. FIG. 57 illustrates this characteristic. The fastener-free interface area is defined between two imaginary references, one being the apex of the interface, the other the base of the interface. The apex is the highest or most outward point of the interface when the sports helmet 10 is being worn. In FIG. 58, the apex is shown by the reference numeral 500. The base of the interface is a horizontal plane that is perpendicular to the vertical axis VA of the sports helmet 10. The interface is thus the dome-shaped area defined between the opposed (or mating) surfaces of the floating liner 50 on the one hand and the inner padding 15 on the other hand, whose apex is 500 and whose base is intersected by the plane 502. In some embodiments, the distance D that separates the apex 500 and the plane 502 is less than 8 cm, more preferably less than 5 and even more preferably less than 3 cm.

The fastener-free interface area is also advantageous when the sports helmet 10 is adjustable to better fit the head 11 of the wearer. This fastener-free interface thus allows the segments or branches that make up the inner padding 15 to be moved, such as to provide adjustability to several different positions without impeding the ability of the floating liner 50 to move with relation to the inner padding 15. As indicated earlier, the sports helmet 10 is adjustable along its longitudinal axis FBA by allowing the front and the rear outer shell members 22, 24 to move one relatively to the other. As a result of this movement, the inner pad members of the inner padding 15 also move. Accordingly, each adjustment position of the outer shell 12 corresponds to a particular position of the inner pad members 15A, 15B, 15C, 15D, 15E. As the outer shell members 22, 24 are displaced along the longitudinal axis, the inner pad members 15A, 15B, 15C, 15D, 15E are also moved one with relation to the other such as to alter the void volume of the sports helmet 10.

By using a fastener-less interface between the inner padding 15 and the floating liner 50, the inner pad members 15A, 15B, 15C, 15D, 15E can move during an adjustment operation without interfering with the floating liner 50.

Note that if necessary to use some sort of fastener to retain the floating liner 50 to the upper part of the sports helmet 10, a possible arrangement can be considered where the floating liner 50 is connected to a component other than the inner padding 15. This component can be the outer shell 12. This connection can be independent from the inner padding 15 such as to allow the inner pad members 15A, 15B, 15C, 15D, 15E to move relative to one another without interfering with the floating liner 50. In a specific example (not shown in the drawings) the inner padding 15 is provided with apertures through which the connections can reach the outer shell 12. The apertures are large enough such as to provide a range of motion for the inner pad members 15A, 15B, 15C, 15D, 15E for adjustability purposes. An example of a connection is an elastic strap that connects the floating liner 50 to the outer shell 12. The strap extends to a slot through the inner padding 15 such that the inner pad members 15A, 15B, 15C, 15D, 15E can move without interfering with the strap. Note that in this example of implementation, the interface between the floating liner 50 and the inner padding 15 is still considered to be fastener-less since no fastener exists between the floating liner 50 and the inner padding 15 that fixes the floating liner 50 relative to the inner padding 15.

The floating liner 50 may be elastic and self-standing. The floating liner 50 is self-standing in that it stands on its own upwardly within the sports helmet 10 and maintains its dome shape for receiving the wearer's head 11 when the sports helmet 10 is not being worn (i.e., when the wearer's head 11 is not received in the sports helmet 10). The dome shape of the floating liner 50 is maintained without the need of suspending the floating liner 50 from the inner padding 15 or from the outer shell 12, such as by using a fastener located near the apex 500 or any other suspension mechanism.

While being elastic, the floating liner 50 has sufficient rigidity to make it self-standing. The rigidity of the floating liner 50 is sufficient to prevent the floating liner 50 from falling down outside of the cavity 13 of the sports helmet 10 under its own weight when the wearer's head 11 is not received in the sports helmet 10.

The rigidity of the floating liner 50 and its ability to be self-standing may be achieved in various ways and is a function of the floating liner's material and structure. For example, in this embodiment, to increase the rigidity of its structure, the segments of the floating liner 50 are provided with a plurality of rigidifying zones $\mathbf{85}_1$-$\mathbf{85}_R$ spaced apart from one another by a plurality of flexing zones $\mathbf{86}_1$-$\mathbf{86}_F$ such that adjacent rigidifying zones $\mathbf{85}_i$, $\mathbf{85}_j$ are more rigid than a flexing zone $\mathbf{86}_i$ in between them. The rigidifying zones $\mathbf{85}_1$-$\mathbf{85}_R$ contribute to maintain the shape of the floating liner 50 by providing additional support. The combination of the flexing zones $\mathbf{86}_1$-$\mathbf{86}_F$ and the rigidifying zones $\mathbf{85}_1$-$\mathbf{85}_R$ is selected to provide simultaneously flexibility and a degree of rigidity to cause the floating liner 50 to self-support itself.

In this embodiment, the rigidifying zones $\mathbf{85}_i$, $\mathbf{85}_j$ are more rigid than the flexing zones $\mathbf{86}_1$-$\mathbf{86}_F$ because they are thicker than the flexing zones $\mathbf{86}_1$-$\mathbf{86}_F$. More particularly, in this embodiment, the rigidifying zones $\mathbf{85}_1$-$\mathbf{85}_R$ comprise the padded areas $\mathbf{185}_1$-$\mathbf{185}_R$ and the ridges 142 of the floating liner 50 where additional material is provided. The rigidifying zones $\mathbf{85}_i$, $\mathbf{85}_j$ may be made more rigid than the flexing zones $\mathbf{86}_1$-$\mathbf{86}_F$ in other ways in other embodiments (e.g., by being made of material having a greater modulus of elasticity and/or a greater hardness than material of the flexing zones $\mathbf{86}_1$-$\mathbf{86}_F$).

Although it is sufficiently rigid to self-stand within the cavity 13 of the sports helmet 10, the floating liner 50 may also be sufficiently flexible to be manually pulled away from the inner padding 15. In this example, this may facilitate cleaning of the inner surface of the inner padding 15 and/or the outer surface 61 of the floating liner 50. More particularly, in this embodiment, the floating liner 50 can be manually pulled away from the inner padding 15 such that at least part of the floating liner 50 extends outside of the cavity 13 of the sports helmet 10. In this example, this may allow the floating liner 50 to acquire an inverted dome shape in which its outer surface 61 is generally concave (instead of generally convex when the floating liner 50 has its dome shape within the sports helmet 10) and its inner surface 59 is generally convex (instead of generally concave when the floating liner 50 has its dome shape within the sports helmet 10). In this case, the rigidity of the floating liner 50 allows it to be self-standing even in its inverted dome shape.

While in this embodiment the floating liner 50 is implemented in a particular way, the floating liner 50 may be implemented in various other ways in other embodiments. For example, in other embodiments, the floating liner 50 may be made of materials other than those discussed herein, may have a shape different than that discussed herein, and/or may be located elsewhere between the external surface 18 and the internal surface 20 of the helmet 10 (e.g., between the outer shell 12 and the inner padding 15).

Moreover, although in embodiments considered above the rotational impact protection device is implemented by the floating liner 50, the rotational impact protection device may be implemented in various other ways in other embodiments. For example, in other embodiments, the inner padding 15 may implement the rotational impact protection device by allowing an angular movement of the external surface 18 of the helmet 10 relative to the inner surface 34 of the inner padding 15 in response to a rotational impact to absorb rotational energy from the rotational impact. For instance, in some embodiments, each of the inner pad members 15A, 15B, 15C, 15D, 15E may comprise elastically shearable material which can shear in response to a rotational impact to allow an angular movement of the external surface 18 of the helmet 10 relative to the inner surface 34 of the inner padding 15 (e.g., each of the inner pad members 15A, 15B, 15C, 15D, 15E of the inner padding 15 may comprise a shear pad). In other embodiments, the inner pad members 15A, 15B, 15C, 15D, 15E of the inner padding 15 may not necessarily themselves shear, but may be mounted to an elastically shearable layer disposed between the outer shell 12 and the inner padding 15. For example, the shearable material of the inner padding 15 and/or the shearable layer may be a gel, an elastomer, or any other suitable material that can elastically shear.

Any feature of any embodiment discussed herein may be combined with any feature of any other embodiment discussed herein in some examples of implementation.

Various embodiments and examples have been presented for the purpose of describing, but not limiting, the invention. Various modifications and enhancements will become apparent to those of ordinary skill in the art and are within the scope of the invention, which is defined by the appended claims.

The invention claimed is:

1. A hockey or lacrosse helmet for protecting the head of a player, the hockey or lacrosse helmet comprising:

(a) a rigid outer shell defining an external surface of the helmet, the rigid outer shell comprising a plurality of shell members movable relative to one another to adjust the fit of the helmet on the player's head;

(b) an inner padding configured to conform to the head of the player, the inner padding being configured to decrease a radial acceleration of the head of the player as a result of a radial impact acting against the outer shell, said inner padding comprising a plurality of inner pad members, the inner pad members being associated with respective ones of the shell members so that when the shell members move relative to one another a corresponding movement is imparted to the associated inner pad members;

(c) a rotational impact cushioning arrangement comprising at least one thin and flexible piece of damping material configured to reduce a rotational acceleration of the head of the player as a result of a rotational impact acting against the outer shell, the thin and flexible piece of damping material having a main surface and a thickness, the main surface having an extent that is greater than the thickness, the thin and flexible piece of damping material residing at a location which is adjacent the head of the player when the helmet is worn and the main surface being oriented towards the head of the player when the helmet is worn, the location of the thin and flexible piece of damping material being such that displacement of the shell members relative to one another produces a movement of the thin and flexible piece of damping material relative to at least one of the inner pad members, wherein the thin and flexible piece of damping material is configured such that a rotational impact on the outer shell induces a lateral distortion of the thin and flexible piece of damping material in a direction along the main surface thereof; and (d) an adjustment mechanism operable by the player and configured to allow the shell members to move relative to one another to perform an adjustment of the fit of the helmet on the player's head.

2. The hockey or lacrosse helmet as defined in claim 1, wherein the adjustment mechanism includes a hand-operated actuator located on an outer surface of the outer shell.

3. The hockey or lacrosse helmet as defined in claim 1, wherein the inner padding defines an inner surface configured to face the head of the player, the inner surface including a recessed area receiving the thin and flexible piece of damping material.

4. The hockey or lacrosse helmet as defined in claim 3, wherein the recessed area is characterized by a depth, the depth being less than a maximal thickness of the thin and flexible piece of damping material.

5. The hockey or lacrosse helmet as defined in claim 1, wherein the location of the thin and flexible piece of damping material is between the head of the player and the inner padding when the helmet is worn.

6. The hockey or lacrosse helmet as defined in claim 1, wherein the thickness of the thin and flexible piece of damping material does not exceed 10 mm.

7. The hockey or lacrosse helmet as defined in claim 1, wherein the thickness of the thin and flexible piece of damping material does not exceed 5 mm.

8. The hockey or lacrosse helmet as defined in claim 1, wherein the thin and flexible piece of damping material includes an edge portion extending along at least a portion of a periphery of the thin and flexible piece of damping material, the edge portion having a thickness that is different from a portion of the thin and flexible piece of damping material located inwardly of the edge portion.

9. The hockey or lacrosse helmet as defined in claim 8, wherein the edge of portion forms a ridge.

10. The hockey or lacrosse helmet as defined in claim 1, wherein the thin and flexible piece of damping material is configured to face a front region of the player's head when the helmet is worn.

11. The hockey or lacrosse helmet as defined in claim 1, wherein the thin and flexible piece of damping material is configured to face a side region of the player's head when the helmet is worn.

12. The hockey or lacrosse helmet as defined in claim 1, wherein the thin and flexible piece of damping material is affixed to a shell member of the plurality of shell members.

13. The hockey or lacrosse helmet as defined in claim 1, including an occipital pad configured for facing an occipital region of the player's head and movable relative to the rigid outer shell between different positions to adjust the fit of the hockey or lacrosse helmet on the player's head.

14. The hockey or lacrosse helmet as defined in claim 13, wherein the adjustment mechanism is a first adjustment mechanism, the hockey or lacrosse helmet including a second adjustment mechanism operable by the player and configured to adjust a position of the occipital pad relative to the rigid outer shell.

15. The hockey or lacrosse helmet as defined in claim 14, wherein the thin and flexible piece of damping material is configured to move relative to the head of the player in response to displacement of the occipital pad relative to the rigid outer shell.

16. The hockey or lacrosse helmet as defined in claim 1, wherein the rotational impact cushioning arrangement includes a plurality of pieces of thin and flexible damping material, the plurality of pieces being located such that the main surfaces thereof are oriented towards different areas of the head of the player when the helmet is worn.

* * * * *